US012741782B2

(12) United States Patent
Sollie et al.

(10) Patent No.: US 12,741,782 B2
(45) Date of Patent: Sep. 22, 2026

(54) COLLAPSIBLE TRAY AND METHODS THEREFOR

(71) Applicant: Pratt Corrugated Holdings, Inc., Brookhaven, GA (US)

(72) Inventors: Greg Sollie, Sharpsburg, GA (US); Christopher M. Stanton, Peachtree City, GA (US); Brad Armstrong, Sharpsburg, GA (US); Paul Ott, Sharpsburg, GA (US); Alex Tanner, Atlanta, GA (US); Shifeng Chen, Newport News, VA (US)

(73) Assignee: Pratt Corrugated Holdings, Inc., Brookhaven, GA (US)

( * ) Notice: Subject to any disclaimer, the term of this patent is extended or adjusted under 35 U.S.C. 154(b) by 0 days.

(21) Appl. No.: 19/181,118

(22) Filed: Apr. 16, 2025

(65) Prior Publication Data

US 2025/0388360 A1 Dec. 25, 2025

Related U.S. Application Data

(62) Division of application No. 18/222,293, filed on Jul. 14, 2023, now Pat. No. 12,304,706.

(Continued)

(51) Int. Cl.

| | |
|---|---|
| ***B65D 5/60*** | (2006.01) |
| ***B65D 77/04*** | (2006.01) |
| ***B65D 81/38*** | (2006.01) |

(52) U.S. Cl.

CPC ..... *B65D 5/60* (2013.01); *B65D 77/04* (2013.01); *B65D 81/3888* (2013.01)

(58) Field of Classification Search

CPC ..... B65D 5/60; B65D 5/3635; B65D 5/4266; B65D 5/443; B65D 5/6652; B65D 77/04;

(Continued)

(56) References Cited

U.S. PATENT DOCUMENTS 2,505,442 A 4/1950 Manville
2,551,324 A 5/1951 Frieders et al.

(Continued)

FOREIGN PATENT DOCUMENTS

AU 2024203860 B2 4/2026
GB 2205083 A * 11/1988 ..... B65D 5/3642

(Continued)

OTHER PUBLICATIONS

Sollie, Greg; Requirement for Restriction/Election for U.S. Appl. No. 18/222,293, filed Jul. 14, 2023, mailed Jul. 26, 2024, 6 pgs.

(Continued)

*Primary Examiner* — Christopher R Demeree
(74) *Attorney, Agent, or Firm* — Smith, Gambrell & Russell, LLP

(57) ABSTRACT

A method of assembling a meal kit tray from a single blank including a bottom panel, wherein the bottom panel is configured to support a bag containing refrigerated items and a cold pack, wherein the single blank further comprises a bottom panel; a side panel extending outwardly from at least a portion of the bottom panel, the side panel joined to the bottom panel along a first fold line defining a joint, wherein the first fold line is interrupted by at least one perforation line segment defining a standoff; and a wing extending outwardly from the side panel, the wing joined to the side panel along a second fold line defining a joint, the wing defining a free end; wherein the method comprises the steps of rotating the side panel upwardly about the first fold line to cause the standoff to separate from the side panel; and rotating the wing downwardly about the second fold line.

9 Claims, 35 Drawing Sheets

Related U.S. Application Data

(60) Provisional application No. 63/466,836, filed on May 16, 2023, provisional application No. 63/447,380, filed on Feb. 22, 2023, provisional application No. 63/441,946, filed on Jan. 30, 2023.

(58) Field of Classification Search
CPC .. B65D 81/3888; B65D 81/09; B65D 5/5038; B65D 81/3853; B65D 5/22; B65D 5/0015; B65D 1/225; B65D 5/20; B31B 2100/0024; B31B 2120/30; B31B 2120/302
USPC ..... 229/5.5, 117.01, 117.07, 149, 125, 142, 229/147, 915, 178; 206/815
See application file for complete search history.

(56) References Cited

U.S. PATENT DOCUMENTS

| | | | | |
|---|---|---|---|---|
| 3,362,610 | A | 1/1968 | Van Dyke | |
| 4,257,550 | A * | 3/1981 | Frohlicher | B65D 5/665 229/149 |
| 4,874,620 | A | 10/1989 | Mendenhall et al. | |
| 4,982,064 | A | 1/1991 | Hartman et al. | |
| 5,492,410 | A | 2/1996 | Cocozza | |
| RE35,875 | E | 8/1998 | Shuert | |
| 5,857,612 | A | 1/1999 | Smith et al. | |
| 6,471,826 | B2 | 10/2002 | Glover et al. | |
| 7,862,688 | B2 | 1/2011 | Thomas | |
| 8,308,900 | B2 | 11/2012 | Covarrubias et al. | |
| D881,011 | S | 4/2020 | Wolf | |
| D919,432 | S | 5/2021 | Muse et al. | |
| 11,261,017 | B2 | 3/2022 | Waltermire et al. | |
| 11,365,025 | B2 | 6/2022 | Birnstihl | |
| 11,958,777 | B2 | 4/2024 | Schabel, Jr. et al. | |
| D1,042,111 | S | 9/2024 | Zhu | |
| 12,091,233 | B2 | 9/2024 | Melchor | |
| 12,304,706 | B2 | 5/2025 | Sollie et al. | |
| D1,083,588 | S | 7/2025 | Ott et al. | |
| 12,441,508 | B2 | 10/2025 | Sollie et al. | |
| 12,448,171 | B2 | 10/2025 | Sollie et al. | |
| D1,106,816 | S | 12/2025 | Ott et al. | |
| 12,497,229 | B2 | 12/2025 | Sollie | |
| 12,497,230 | B2 | 12/2025 | Ott et al. | |
| 12,643,730 | B2 | 6/2026 | Sollie et al. | |
| 12,703,536 | B2 | 8/2026 | Sollie et al. | |
| 2008/0121681 | A1 | 5/2008 | Wiedmeyer | |
| 2010/0008603 | A1 | 1/2010 | Smith et al. | |
| 2011/0240515 | A1 | 10/2011 | Ridgeway | |
| 2012/0305435 | A1 | 12/2012 | Matta et al. | |
| 2015/0158656 | A1* | 6/2015 | McKinnon | B31B 50/142 220/592.2 |
| 2018/0327172 | A1 | 11/2018 | Waltermire et al. | |
| 2019/0359412 | A1 | 11/2019 | Sollie et al. | |
| 2020/0346841 | A1 | 11/2020 | Sollie et al. | |
| 2023/0079525 | A1* | 3/2023 | Tuano | B65D 5/2009 229/128 |
| 2024/0253848 | A1 | 8/2024 | Sollie et al. | |
| 2025/0242991 | A1 | 7/2025 | Sollie | |
| 2026/0015125 | A1 | 1/2026 | Sollie et al. | |
| 2026/0042572 | A1 | 2/2026 | Sollie et al. | |
| 2026/0054912 | A1 | 2/2026 | Ott et al. | |
| 2026/0077939 | A1 | 3/2026 | Sollie | |

FOREIGN PATENT DOCUMENTS

| | | | |
|---|---|---|---|
| JP | 2001213478 | A * | 8/2001 |
| JP | D1713371 | | 4/2022 |
| KR | 20210089477 | A | 7/2021 |
| KR | 301248487 | | 2/2024 |
| WO | 2025165790 | | 8/2025 |

OTHER PUBLICATIONS

Sollie, Greg; Non-Final Office Action for U.S. Appl. No. 18/222,293, filed Jul. 14, 2023, mailed Oct. 11, 2024, 36 pgs.
Sollie, Greg; Notice of Allowance for U.S. Appl. No. 18/222,293, filed Jul. 14, 2023, mailed Dec. 19, 2024, 5 pgs.
Sollie, Greg; Notice of Allowance for U.S. Appl. No. 18/425,552, filed Jan. 29, 2024, mailed Aug. 12, 2025, 16 pgs.
Sollie, Greg; Applicant-Initiated Interview Summary for U.S. Appl. No. 18/386,187, filed Nov. 1, 2023, mailed Aug. 1, 2025, 2 pgs.
Sollie, Greg; Final Office Action for U.S. Appl. No. 19/070,793, filed Mar. 5, 2025, mailed Oct. 1, 2025, 24 pgs.
Sollie, Greg; Final Office Action for U.S. Appl. No. 19/070,799, filed Mar. 5, 2025, mailed Oct. 1, 2025, 22 pgs.
Sollie, Greg; Final Office Action for U.S. Appl. No. 19/070,803, filed Mar. 5, 2025, mailed Oct. 7, 2025, 24 pgs.
Sollie, Greg; Final Office Action for U.S. Appl. No. 18/222,272, filed Jul. 14, 2023, mailed Jul. 30, 2025, 83 pgs.
Ott, Paul; Notice of Allowance for U.S. Appl. No. 19/079,307, filed Mar. 13, 2025, mailed Jul. 29, 2025, 9 pgs.
Sollie, Greg; Examination Report No. 2 for Australian Application No. 2024203860, filed Jun. 6, 2024, mailed Sep. 12, 2025, 5 pgs.
Olympia-Tile—4' x 4'—Vulcanized Rubber Gym Tile. Date first available: Oct. 23, 2021. Site visited: Jul. 21, 2025. Available online: https://amarcoproducts.com/products/sport-weight-room-flooring/rubber-gym-tile/ot-48-vulcanized-rubber-gym-tile (Year: 2021).
Ott, Paul; Corrected Notice of Allowance for Design U.S. Appl. No. 30/010,324, filed Jun. 26, 2025, mailed Oct. 20, 2025, 12 pgs.
Ott, Paul; Notice of Allowance for Design U.S. Appl. No. 30/010,324, filed Jun. 26, 2025, mailed Aug. 5, 2025, 10 pgs.
Pratt Retail Specialties 22 in. x 43 ft. Rafter Corrugated Attic Baffle. Date first available: Jan. 23, 2025. Site visited: Jul. 21, 2025. Available online: https://www.homedepot.com/p/Pratt-Retail-Special ties-22-in-x-43-ft-Rafter-Corrugated-Attic-Baffle-Pack-of-50-22x43AB50P/333011583 (Year: 2025).
Dish Pack Partition Kit S-4751—Uline. Date first available: Nov. 28, 2009. Site visited: Dec. 17, 2025. Available online: https://www.uline.com/ProducUDetail/S-4751/Moving-Boxes/Dish-Pack-Partition-Kit (Year: 2009).
Ott, Paul; Ex Parte Quayle Action for Design U.S. Appl. No. 30/034,229, filed Nov. 24, 2025, mailed Jan. 29, 2026, 7 pgs.
Sollie, Greg; Applicant-Initiated Interview Summary for U.S. Appl. No. 19/070,809, filed Mar. 5, 2025, Jan. 30, 2026, 3 pgs.
Sollie, Greg; Examination Report for Australian Patent Application No. 2024203862, filed Jun. 6, 2024, mailed Jan. 20, 2026, 4 pgs.
Sollie, Greg; Notice of Allowance for U.S. Appl. No. 19/070,793, filed Mar. 5, 2025, mailed Feb. 4, 2026, 19 pgs.
Sollie, Greg; Non-Final Office Action for U.S. Appl. No. 19/362,134, filed Oct. 17, 2025, mailed Feb. 5, 2026, 16 pgs.
Ott, Paul; Non-Final Office Action for U.S. Appl. No. 19/375,093, filed Oct. 30, 2025, mailed Feb. 19, 2026, 15 pgs.
Sollie, Greg; Non-Final Office Action for U.S. Appl. No. 19/394,993, filed Nov. 20, 2025, mailed Feb. 23, 2026, 12 pgs.
Sollie, Greg; Non-Final Office Action for U.S. Appl. No. 19/070,809, filed Mar. 5, 2025, mailed Feb. 25, 2026, 15 pgs.
Sollie, Greg; Examination Report for Australian Patent Application No. 2024203863, filed Jun. 6, 2024, mailed Feb. 26, 2026, 4 pgs.
Sollie, Greg; Final Office Action for U.S. Appl. No. 18/386,187, filed Nov. 1, 2023, mailed Mar. 10, 2026, 27 pgs.
Sollie, Greg; Examination Report for New Zealand Patent Application No. 811748, filed Jun. 6, 2024, mailed Feb. 23, 2026, 6 pgs.
Sollie, Greg; Examination Report for New Zealand Patent Application No. 811747, filed Jun. 6, 2024, mailed Feb. 19, 2026, 4 pgs.
Sollie, Greg; Non-Final Office Action for U.S. Appl. No. 18/386,187, filed Nov. 1, 2023, mailed Oct. 27, 2025, 29 pgs.
Sollie, Greg; Final Office Action for U.S. Appl. No. 19/070,809, filed Mar. 5, 2025, mailed Oct. 28, 2025, 17 pgs.
Sollie, Greg; Non-Final Office Action for U.S. Appl. No. 18/222,272, filed Jul. 14, 2023, mailed Nov. 21, 2025, 97 pgs.
Sollie, Greg; Requirement for Restriction/Election for U.S. Appl. No. 19/362,134, filed Oct. 17, 2025, mailed Nov. 13, 2025, 6 pgs.
Sollie, Greg; Examination Report for New Zealand Application No. 811776, filed Jun. 6, 2024, mailed Nov. 10, 2025, 3 pgs.

(56) References Cited

OTHER PUBLICATIONS

Sollie, Greg; Examination Report for New Zealand Patent Application No. 811747, filed Jun. 6, 2024, mailed Nov. 10, 2025, 3 pgs.
Sollie, Greg; Examination Report for New Zealand Patent Application No. 811748, filed Jun. 6, 2024, mailed Nov. 10, 2025, 4 pgs.
Sollie, Greg; Examination Report for New Zealand Patent Application No. 811749, filed Jun. 6, 2024, mailed Nov. 10, 2025, 3 pgs.
Sollie, Greg; Notice of Allowance for U.S. Appl. No. 19/362,134, filed Oct. 17, 2025, mailed May 27, 2026, 14 pgs.
Ott, Paul; Notice of Allowance for U.S. Appl. No. 19/375,093, filed Oct. 30, 2025, mailed Jun. 1, 2026, 15 pgs.
Sollie, Greg; Notice of Allowance for U.S. Appl. No. 19/394,993, filed Nov. 20, 2025, mailed Jun. 1, 2026, 18 pgs.
Sollie, Greg; Applicant-Initiated Interview Summary for U.S. Appl. No. 19/070,799, filed Mar. 5, 2025, mailed May 19, 2026, 4 pgs.
Sollie, Greg; Examination Report for Australian Patent Application No. 2024203863, filed Jun. 6, 2024, mailed Apr. 21, 2026, 4 pgs.
Sollie, Greg; Examination Report for Australian Patent Application No. 2024203862, filed Jun. 6, 2024, mailed Apr. 21, 2026, 4 pgs.
Sollie, Greg; Non-Final Office Action for U.S. Appl. No. 19/070,799, filed Mar. 5, 2025, mailed Apr. 9, 2026, 28 ogs.
Sollie, Greg; Notice of Allowance for U.S. Appl. No. 18/222,272, filed Jul. 14, 2023, mailed Apr. 7, 2026, 61 pgs.
Sollie, Greg; Examination Report for Australian Patent Application No. 2024203861, filed Jun. 6, 2024, mailed Mar. 12, 2026, 6 pgs.
Sollie, Greg; Notice of Acceptance for Australian Patent Application No. 2024203862, filed Jun. 6, 2024, mailed May 14, 2026, 4 pgs.
Sollie, Greg; Examination Report for New Zealand Patent Application No. 811747, filed Jun. 6, 2024, mailed Jul. 1, 2026, 1 pg.
Sollie, Greg; Notice of Acceptance for Australian Patent Application No. 2024203861, filed Jun. 6, 2024, mailed May 14, 2026, 4 pgs.
Sollie, Greg; Final Office Action for U.S. Appl. No. 19/070,809, filed Mar. 5, 2025, mailed Jun. 15, 2026, 21 pgs.
Sollie, Greg; Non-Final Office Action for U.S. Appl. No. 19/070,799, filed Mar. 5, 2025, mailed Jun. 15, 2026, 24 pgs.
Sollie, Greg; Notice of Acceptance for Australian Patent Application No. 2024203863, filed Jun. 6, 2024, mailed May 13, 2026, 4 pgs.
Ott, Paul; Notice of Allowance for U.S. Appl. No. 30/034,229, filed Nov. 24, 2025, mailed Jun. 24, 2026, 17 pgs.

* cited by examiner

COLLAPSIBLE TRAY AND METHODS THEREFOR

CROSS-REFERENCE TO RELATED APPLICATIONS

This application is a divisional of U.S. application Ser. No. 18/222,293, filed on Jul. 14, 2023, which claims the benefit of U.S. Provisional Application No. 63/441,946, filed Jan. 30, 2023, U.S. Provisional Application No. 63/447,380, filed Feb. 22, 2023, and U.S. Provisional Application No. 63/466,836, filed May 16, 2023, each of which is hereby specifically incorporated by reference herein in its entirety.

TECHNICAL FIELD

Field of Use

This disclosure relates to a modular packaging system. More specifically, this disclosure relates to a tray insertable into an outer (shipping) box for supporting a central packing container (for example, a bag) for meal kits at a predetermined height above a bottom of the outer box. A version of the tray disclosed herein is collapsible, as are the bag and outer box. All of these components work in conjunction with one another and with a custom gel-pack set to define the modular packaging system.

Related Art

Boxes are commonly used to ship food. The food shipped can be a single perishable item or a combination of perishable items, such as a food kit of the type made popular by companies such as Hello Fresh®. A food kit includes a bag containing one or more food items inside the bag, and one or more cooling elements to maintain the food items in a refrigerated condition during shipment.

SUMMARY

Room for improvement exists within the art to provide a means inside a meal kit shipping box that is specifically configured to securely support meal kits contained in bags while maximizing use of air inside the shipping box to aid in maintaining the meal kit in a refrigerated state. Further room for improvement exists in providing simplicity of manufacture of a meal kit tray insertable within a shipping box to provide the aforementioned advantages.

It is to be understood that this summary is not an extensive overview of the disclosure. This summary is exemplary and not restrictive, and it is intended to neither identify key or critical elements of the disclosure nor delineate the scope thereof. The sole purpose of this summary is to explain and exemplify certain concepts of the disclosure as an introduction to the following complete and extensive detailed description.

In one aspect, disclosed is a method of assembling a meal kit tray from a single blank comprising a bottom panel, wherein the bottom panel is configured to support a bag containing refrigerated items and a cold pack, the bottom panel defining a first end, a second end, a third end, and a fourth end, wherein the single blank further comprises a bottom panel defining a first end, a second end, a third end, and a fourth end, the bottom panel configured to support a bottom of a bag comprising a portion of a meal kit; a side panel extending outwardly from at least a portion of the second end of the bottom panel, the side panel joined to the bottom panel along a first fold line defining a joint between the bottom panel and the side panel, the side panel defining a first end, a second end, a third end, and a fourth end, wherein the first fold line is interrupted by at least one perforation line segment defining a standoff extending laterally from the first fold line and terminating in a standoff edge, each standoff configured to separate from the side panel as the side panel is rotated upwardly about the first fold line during assembly of the blank into a meal kit tray; and a wing extending outwardly from the third end of the side panel, the wing joined to the side panel along a second fold line defining a joint between the side panel and the wing, the wing defining a front end, a rear end, a proximal end, and a free end; wherein the method comprises the steps of rotating the side panel upwardly about the first fold line to cause each standoff to separate from the side panel; and rotating the wing downwardly about the second fold line.

In a further aspect, disclosed is a method of collapsing a meal kit tray assembled from a single blank comprising a bottom panel, wherein the bottom panel is configured to support a bag containing refrigerated items and a cold pack, the bottom panel defining a first end, a second end, a third end, and a fourth end, wherein the single blank further comprises a bottom panel defining a first end, a second end, a third end, and a fourth end, the bottom panel configured to support a bottom of a bag comprising a portion of a meal kit; a side panel extending outwardly from at least a portion of the second end of the bottom panel, the side panel joined to the bottom panel along a first fold line defining a joint between the bottom panel and the side panel, the side panel defining a first end, a second end, a third end, and a fourth end; a wing extending outwardly from the third end of the side panel, the wing joined to the side panel along a second fold line defining a joint between the side panel and the wing, the wing defining a front end, a rear end, a proximal end, and a free end; and an end panel extending from the first end of the bottom panel, the end panel joined to the bottom panel along a third fold line defining a joint between the bottom panel and the end panel, the end panel defining a first end, a second end, a third end, and a fourth end, wherein the end panel defines a corner located at an intersection of the first end of the end panel with the fourth end of the end panel, wherein a transverse fold line extends from the corner to the second end of the end panel, the transverse fold line subdividing the end panel into a primary section and a secondary section; and wherein the method comprises the step of causing the secondary section to be folded atop the primary section.

Various implementations described in the present disclosure may comprise additional systems, methods, features, and advantages, which may not necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims. The features and advantages of such implementations may be realized and obtained by means of the systems, methods, features particularly pointed out in the appended claims. These and other features will become more fully apparent from the following description and appended claims, or may be learned by the practice of such exemplary implementations as set forth hereinafter.

BRIEF DESCRIPTION OF THE DRAWINGS

The accompanying drawings, which are incorporated in and constitute a part of this specification, illustrate several aspects of the disclosure and together with the description, serve to explain various principles of the disclosure. The drawings are not necessarily drawn to scale. Corresponding features and components throughout the figures may be designated by matching reference characters for the sake of consistency and clarity.

DETAILED DESCRIPTION

Figure 1:
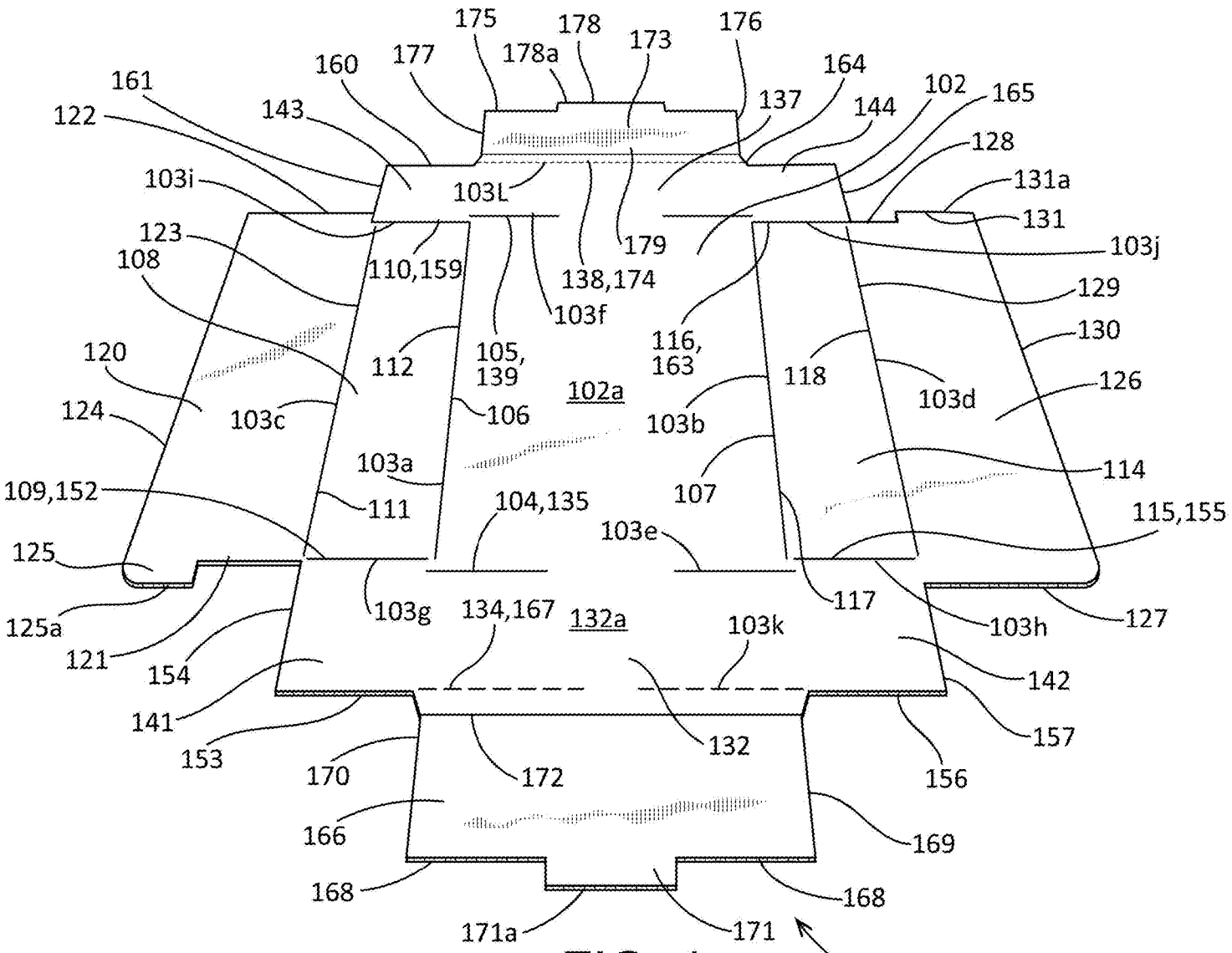
FIG. 1 is a top perspective view of a blank for a meal kit tray constructed in accordance with an aspect of the current disclosure.

The present disclosure can be understood more readily by reference to the following detailed description, examples, drawings, and claims, and their previous and following description. However, before the present devices, systems, and/or methods are disclosed and described, it is to be understood that this disclosure is not limited to the specific devices, systems, and/or methods disclosed unless otherwise specified, as such can, of course, vary. It is also to be understood that the terminology used herein is for the purpose of describing particular aspects only and is not intended to be limiting.

The following description is provided as an enabling teaching of the present devices, systems, and/or methods in their best, currently known aspect. To this end, those skilled in the relevant art will recognize and appreciate that many changes can be made to the various aspects described herein, while still obtaining the beneficial results of the present disclosure. It will also be apparent that some of the desired benefits of the present disclosure can be obtained by selecting some of the features of the present disclosure without utilizing other features. Accordingly, those who work in the art will recognize that many modifications and adaptations to the present disclosure are possible and can even be desirable in certain circumstances and are a part of the present disclosure. Thus, the following description is provided as illustrative of the principles of the present disclosure and not in limitation thereof.

As used throughout, the singular forms "a," "an" and "the" include plural referents unless the context clearly dictates otherwise. Thus, for example, reference to a quantity of one of a particular element can comprise two or more such elements unless the context indicates otherwise. In addition, any of the elements described herein can be a first such element, a second such element, and so forth (e.g., a first widget and a second widget, even if only a "widget" is referenced).

Ranges can be expressed herein as from "about" one particular value, and/or to "about" another particular value. When such a range is expressed, another aspect comprises from the one particular value and/or to the other particular value. Similarly, when values are expressed as approximations, by use of the antecedent "about" or "substantially," it will be understood that the particular value forms another aspect. It will be further understood that the endpoints of each of the ranges are significant both in relation to the other endpoint, and independently of the other endpoint.

For purposes of the current disclosure, a material property or dimension measuring about X or substantially X on a particular measurement scale measures within a range between X plus an industry-standard upper tolerance for the specified measurement and X minus an industry-standard lower tolerance for the specified measurement. Because tolerances can vary between different materials, processes and between different models, the tolerance for a particular measurement of a particular component can fall within a range of tolerances.

As used herein, the terms "optional" or "optionally" mean that the subsequently described event or circumstance may or may not occur, and that the description comprises instances where said event or circumstance occurs and instances where it does not.

The word "or" as used herein means any one member of a particular list and also comprises any combination of members of that list. The phrase "at least one of A and B" as used herein means "only A, only B, or both A and B"; while the phrase "one of A and B" means "A or B."

To simplify the description of various elements disclosed herein, the conventions of "left," "right," "front," "rear," "top," "bottom," "upper," "lower," "inside," "outside," "inboard," "outboard," "horizontal," and/or "vertical" may be referenced. Unless stated otherwise, "front" describes that end of a blank or an assembled box or any portion thereof nearest to a primary or initial point of opening; "rear" is that end of the blank or the assembled box or any portion thereof that is opposite or distal the front; "left" is that which is to the left of or facing left from a person facing towards the front; and "right" is that which is to the right of or facing right from that same person facing towards the front. "Horizontal" or "horizontal orientation" describes that which is in a plane extending from left to right and aligned with the horizon. "Vertical" or "vertical orientation" describes that which is in a plane that is angled at 90 degrees to the horizontal.

As disclosed in the figures disclosing blanks 100 (FIG. 1) and 1200 (FIG. 12), various line thicknesses and types can indicate certain characteristics of the geometry. In some aspects, a thicker solid line can indicate the edge of a part; a thinner solid line can indicate a bend line; a dash or dashed line can indicate a hidden edge (and edge covered by other geometry), a perforated cut or connection, or a boundary or boundaries of a detail view; a dot-dash line can indicate material that is cut away and not shown for clarity, and a double dot-dash line can indicate a boundary or boundaries of separately claimable elements. Unless otherwise specified, a geometric center of any thicker lines determine the shape and position of the disclosed geometry. Any dimensions disclosed in the figures are exemplary only, and it is contemplated that the blank 100 and a meal kit tray 1000 formed therefrom (FIGS. 8-11) can be any shape and size. In some aspects, for example and without limitation, the meal kit tray 1000 can be used for bagged meal kits such as those sold by Hello Fresh®.

Figure 21:
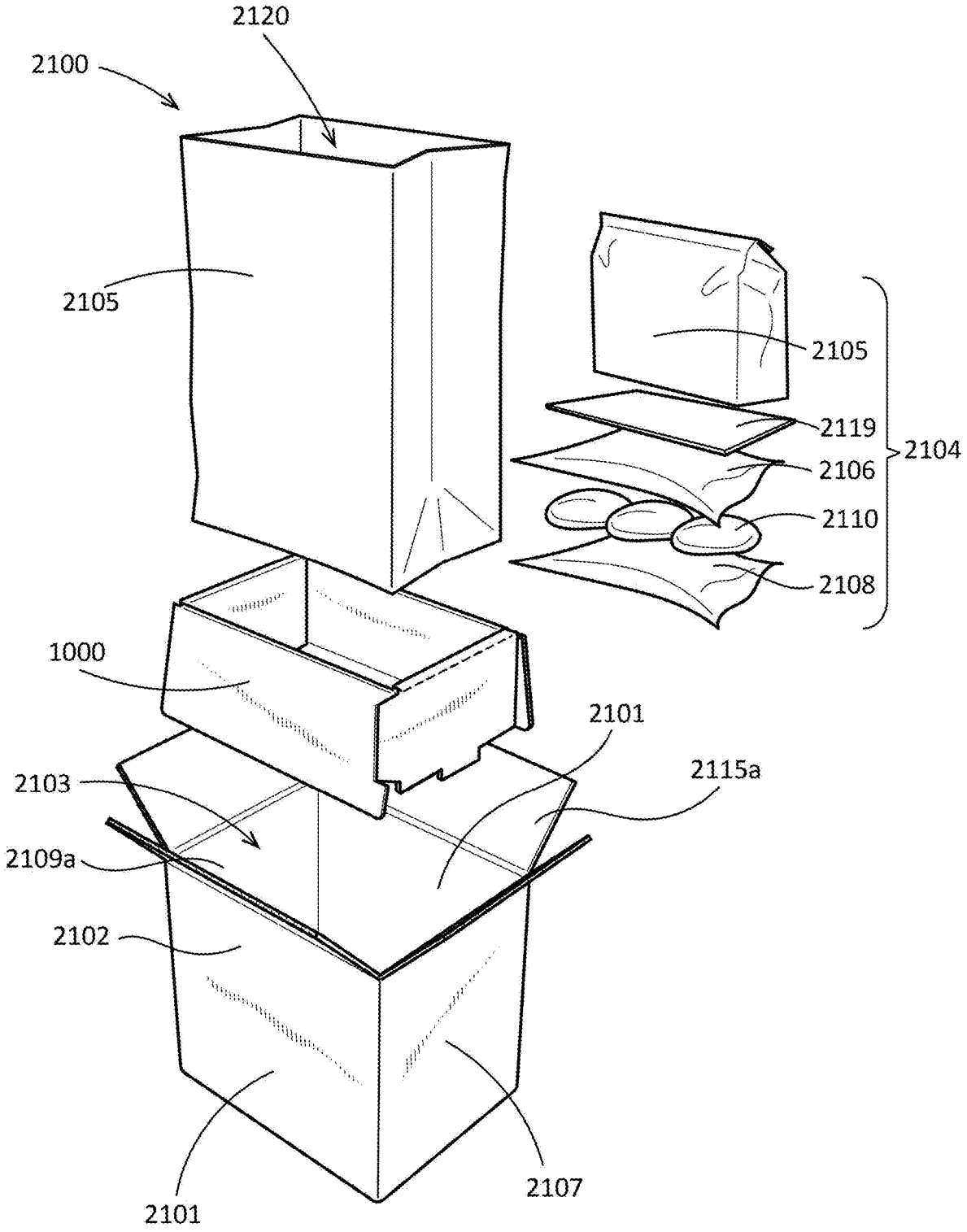
FIG. 21 is an exploded perspective view of a meal kit shipping assembly and an exploded view of a meal kit of the meal kit shipping assembly.

FIG. 1 shows a top perspective view of the blank 100 for the meal kit tray 1000 (FIG. 10) in accordance with an aspect of the current disclosure. The blank 100 can comprise a bottom panel 102 having an upper surface 102*a*, the bottom panel 102 defining a first end 104, a second end 105, a third end 106, and a fourth end 107. The bottom panel 102 can be configured to support a bottom of a bag 2105 (FIG. 21) comprising a portion of a meal kit, such as that to be discussed with regard to meal kit 2104 (FIG. 21). As shown, the second end 105 can be distal from the first end 104, and the fourth end 107 can be distal from the third end 106. In some aspects, as shown, the bottom panel 102 can define a rectangular shape. In other aspects, the bottom panel 102 can define a non-rectangular shape such as polygonal shape with fewer than four or more than four sides or ends 104, 105, 106, 107 or even a rounded shape. Adjacent ends such as the ends 104, 107, the ends 107, 106, the ends 106, 105, and the ends 105, 104 can intersect at corners of the bottom panel 102.

A first side panel 108 can extend outwardly from at least a portion of the third end 106 of the bottom panel 102. The first side panel 108 can thereby be joined to the bottom panel 102 along a fold line 103*a* defining a joint between the panels 102, 108. The first side panel 108 can define a first end 109, a second end 110, a third end 111, and a fourth end 112. As shown, the second end 110 can be distal from the first end 109, and the fourth end 112 can be distal from the third end 111. In some aspects, as shown, the first side panel 108 can define a rectangular shape. In other aspects, the first side panel 108 can define a non-rectangular shape such as polygonal shape with fewer than four or more than four sides or ends 109,110,111,112 or even a rounded shape. Adjacent ends such as the ends 109,111, the ends 111, 110, the ends 110,112, and the ends 112, 109, can intersect at corners of the first side panel 108.

A second side panel 114 can extend outwardly from at least a portion of the fourth end 107 of the bottom panel 102. The second side panel 114 can thereby be joined to the bottom panel 102 along a fold line 103*b* defining a joint between the panels 102,114. The second side panel 114 can define a first end 115, a second end 116, a third end 117, and a fourth end 118. As shown, the second end 116 can be distal from the first end 105, and the fourth end 118 can be distal from the third end 117. In some aspects, as shown, the first side panel 108 can define a rectangular shape. In other aspects, the second side panel 114 can define a non-rectangular shape such as polygonal shape with fewer than four or more than four sides or ends 115, 116, 117,118 or even a rounded shape. Adjacent ends such as the ends 115, 117, the ends 117,116, the ends 116, 118, and the ends 118,115, can intersect at corners of the second side panel 114.

Still referring to FIG. 1, the blank 100 can further comprise a first wing 120, which can extend outwardly from the third end 111 of the first side panel 108. The first wing 120 can thereby be joined to the first side panel 108 along a fold line 103*c* defining a joint between the first side panel 108 and the first wing 120. The first wing 120 can define a front end 121, a rear end 122, a proximal end 123, and a free end 124. As shown, the rear end 122 can be distal from the front end 121, and the free end 124 can be distal from the proximal end 123. In some aspects, as shown, the first wing 120 can define a rectangular shape and, in some aspects, a square shape. Adjacent ends 124, 122, the ends 122, 123, and the ends 123, 121 can intersect at corners of the first wing 120. In some aspects, any of the panels of the blank 100 and the meal kit tray 1000 that are described as being rectangular can be substantially rectangular (i.e., rectangular in shape minus any notches, chamfers, or other edge treatments). In some aspects, any of the panels of the blank 100 and the meal kit tray 1000 that are described as being or defining some non-rectangular shape can be substantially that shape (i.e., that shape minus any notches, chamfers, or other edge treatments).

A portion of the front end 121 of the first wing 120 can extend forward to form a first end engagement tab 125 terminating at a front tab edge 125*a*. Once the blank 100 is fully assembled into the meal kit tray 1000 (FIGS. 8-11), and the meal kit tray 1000 is inserted into an outer box 2102 (FIGS. 21-23), the front tab edge 125*a* can frictionally engage an inside wall 2107*a* (FIG. 24) of a front end 2107 (FIG. 21) of the outer box 2102 to help secure the meal kit tray 1000 within the outer box 2102.

A second wing 126 can extend outwardly from the fourth end 118 of the second side panel 114. The second wing 120 can thereby be joined to the second side panel 114 along a fold line 103*d* defining a joint between the second side panel 114 and the second wing 126. The second wing 126 can define a front end 127, a rear end 128, a proximal end 129, and a free end 130. As shown, the rear end 128 can be distal from the front end 127, and the free end 130 can be distal from the proximal end 129. In some aspects, as shown, the second wing 126 can define a rectangular shape and, in some aspects, a square shape. Adjacent ends 127,129, the ends 129,128, and the ends 130, 127, can intersect at corners of the second wing 126.

A portion of the rear end 128 of the second wing 126 can extend rearwardly to form a second end engagement tab 131 terminating at a rear tab edge 131*a*. Once the blank 100 is fully assembled into the meal kit tray 1000 (FIGS. 8-11), and the meal kit tray 1000 is inserted into the outer box 2102 (FIGS. 21-24), the rear tab edge 131*a* can frictionally engage an inside wall 2109*a* (FIG. 21) of a rear end 2109 (FIG. 21) of the outer box 2102 to help secure the meal kit tray 1000 within the outer box 2102. This frictional engagement, when considered in conjunction with the frictional engagement by the front tab edge 125*a*, can further secure the meal kit tray 1000 within the outer box 2102.

Figure 2A:
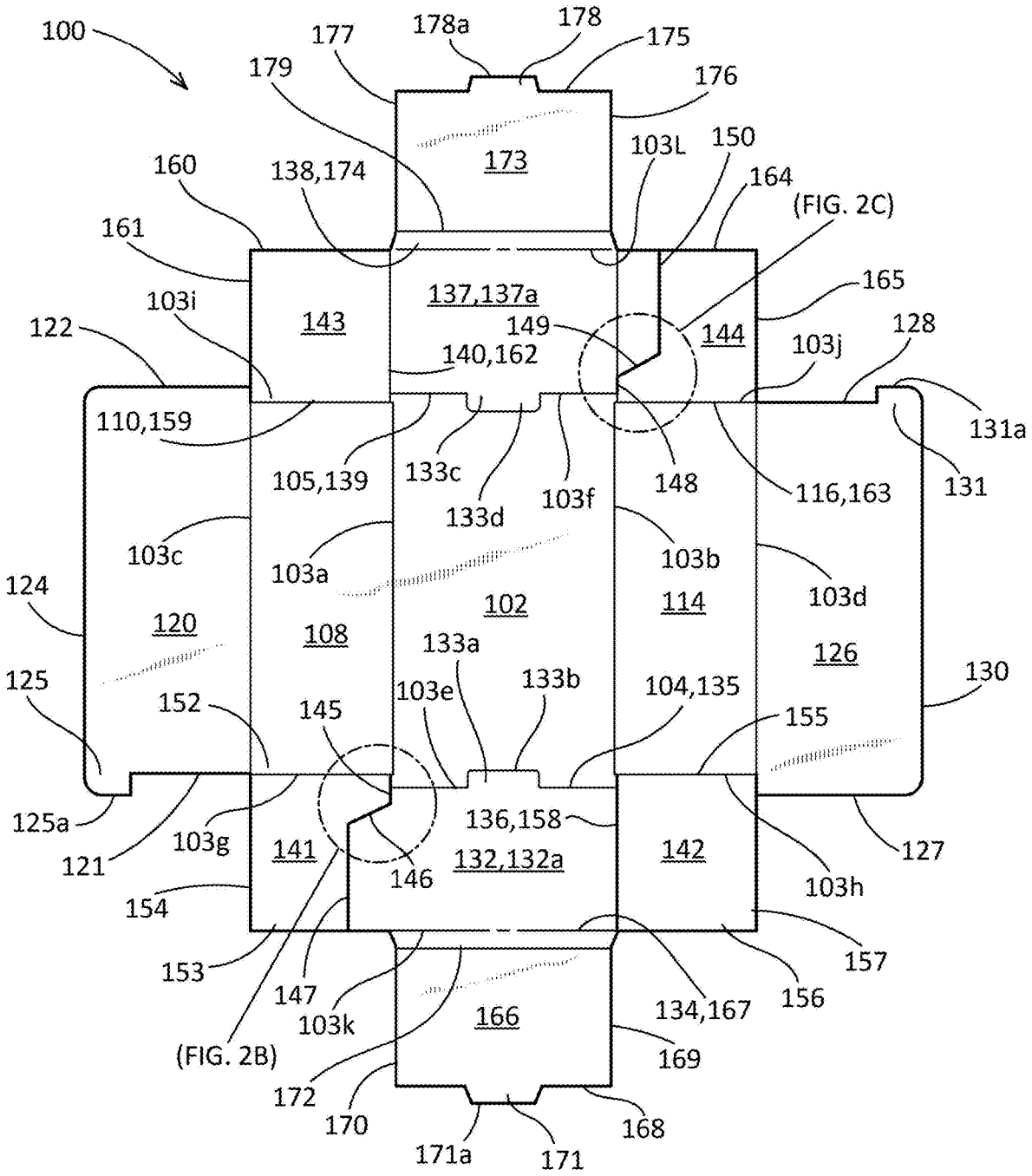
FIG. 2A is a top plan view of the blank of FIG. 1.

Still referring to FIG. 1, but now in conjunction with FIG. 2A, the blank 100 may further comprise a front end panel 132 extending forward from the first end 104 of the bottom panel 102. The front end panel 132 can thereby be joined to the bottom panel 102 along a fold line 103*e* defining a joint between the panels 102, 132. Fold line 103*e* may be interrupted by a perforation line defining a first bottom tab 133*a* (FIG. 2A) projecting rearwardly from a second end 135 of the front end panel 132, the first bottom tab 133*a* terminating in a first bottom tab edge 133*b* (FIG. 2A). As the front end panel 132 is rotated upwardly about fold line 103*e* during assembly of the blank 100 into the meal kit tray 1000, the first bottom tab 133*a* can separate from the bottom panel 102 and rotate downwardly until the first bottom tab 133*a* extends downwardly beneath the bottom panel 102 in an orientation substantially perpendicular to the bottom panel 102. Furthermore, the separation of the first bottom tab 133*a* from the bottom panel 102 can create an opening between the bottom panel 102 and the front end panel 132, the opening sized to accommodate a front locking tab 171, to be described herein. The front end panel 132 can further define a first end 134, the second end 135, and a third end 136 (FIG. 2A).

The blank 100 may further comprise a rear end panel 137 extending rearwardly from the second end 105 of the bottom panel 102. The rear end panel 137 can thereby be joined to the bottom panel 102 along a fold line 103*f* defining a joint between the panels 102, 137. Fold line 103*f* may be interrupted a perforation line defining a second bottom tab 133*c* (FIG. 2A) projecting rearwardly from the second end 139 of the rear end panel 137, the second bottom tab 133*c* terminating in a second bottom tab edge 133*d* (FIG. 2A). As the rear end panel 137 is rotated upwardly about fold line 103*f* during assembly of the blank 100 into the meal kit tray 1000, the second bottom tab 133*c* can separate from the bottom panel 102 and rotate downwardly until the second bottom tab 133*c* extends downwardly beneath the bottom panel 102 in an orientation substantially perpendicular to the bottom panel 102. Furthermore, the separation of the second bottom tab 133*c* from the bottom panel 102 can create an opening between the bottom panel 102 and the rear end panel 137, the opening sized to accommodate a rear locking tab 178, to be described herein. The rear end panel 137 can define a first end 138, a second end 139, and a third end 140 (FIG. 2A).

The blank 100 may further comprise a first reinforcement panel 141 extending forward from the first end 109 of the first side panel 108, a second reinforcement panel 142 extending forward from the first end 115 of the second side panel 114, a third reinforcement panel 143 extending rearwardly from the second end 110 of the first side panel 108, and a fourth reinforcement panel 144 extending rearwardly from the second end 116 of the second side panel 114. The first reinforcement panel 141 can thereby be joined to the first side panel 108 along a fold line 103*g* defining a joint between the panels 108,141; the second reinforcement panel 142 can thereby be joined to the second side panel 114 along a fold line 103*h* defining a joint between the panels 114,142; the third reinforcement panel 143 can thereby be joined to the first side panel 108 along a fold line 103*i* defining a joint between the panels 108,143; and the fourth reinforcement panel 144 can thereby be joined to the second side panel 114 along a fold line 103*j* defining a joint between the panels 114, 144.

Referring to FIG. 2A, the front end panel 132 may further define a fourth end comprising perforation segments 145, 146, 147, and the rear end panel 137 may further define a fourth end comprising perforation segments 148, 149, 150.

Segments 145, 146, 147 facilitate the selective separation of the front end panel 132 from the first reinforcement panel 141 during assembly of the blank 100 into the meal kit tray 1000. Similarly, segments 148, 149, 150 facilitate the selective separation of the rear end panel 137 from the fourth reinforcement panel 144 during assembly of the blank 100 into the meal kit tray 1000. Additionally, the third end 136 of the front end panel 132 may be defined by a perforation to facilitate the selective separation of the front end panel 132 from the second reinforcement panel 142 during the assembly, and the third end 140 of the rear end panel 137 may be defined by a perforation to facilitate the selective separation of the rear end panel 137 from the third reinforcement panel 143 during the assembly. Alternatively, the aforementioned lines described as perforations may be cut lines so that the aforementioned separations exist before assembly of the blank 100 into the meal kit tray 1000. As shown, the third end 136 of the front end panel 132 can be distal from the fourth end 145, 146, 147, and the first end 134 of the front end panel can be distal from the second end 135. Front end panel 132 may define a first exterior surface 132*a* bounded by the panel ends 134, 135, 136, and 145, 146, 147, with a second exterior surface 132*b* (FIGS. 7-9) opposite the first exterior surface 132*a*, the second exterior surface 132*b* bounded by same panel ends 134, 135, 136, and 145, 146, 147. Similarly, the third end 140 of the rear end panel 137 can be distal from the fourth end 148, 149, 150, and the first end 138 of the rear end panel 137 can be distal from the second end 139. Rear end panel 137 may define a first exterior surface 137*a* bounded by the panel ends 138, 139, 140, and 148, 149, 150, with a second exterior surface 137*b* (not shown) opposite the first exterior surface 137*a*, the second exterior surface 137*b* bounded by same panel ends 138, 139,140, and 148, 149, 150.

Referring to FIGS. FIGS. 1 and 2A, the first reinforcement panel 141 can define a proximal end 152, a distal end 153, a top end 154, and a separable end defined by the sections (end portions) 145, 146, 147. As shown, the distal end 153 can be distal from the proximal end 152, and the top end 154 can be distal from the separable end 145, 146, 147. In some aspects, as shown, the first reinforcement panel 141 can define a rectangular shape and, in some aspects, a square shape. Adjacent ends 152, 154, the ends 154, 153, the end 153 and end portion 147, and the end portion 145 and the proximal end 152, can intersect at corners of the first reinforcement panel 141.

The second reinforcement panel 142 can define a proximal end 155, a distal end 156, a top end 157, and a separable end 158 that is coextensive with the third end 136 of the front end panel 132, the third end 136 being defined by a perforated line, as described above. As shown, the distal end 156 can be distal from the proximal end 155, and the top end 157 can be distal from the separable end 158. In some aspects, as shown, the second reinforcement panel 142 can define a rectangular shape and, in some aspects, a square shape. Adjacent ends 155, 157, the ends 157, 156, the ends 156, 158, and the ends 158, 155 can intersect at corners of the second reinforcement panel 142.

The third reinforcement panel 143 can define a proximal end 159, a distal end 160, a top end 161, and a separable end 162 that is coextensive with third end 140 of the rear end panel 137, the third end 140 being defined by a perforated line, as described above. As shown, the distal end 160 can be distal from the proximal end 159, and the top end 161 can be distal from the separable end 162. In some aspects, as shown, the third reinforcement panel 143 can define a rectangular shape and, in some aspects, a square shape. Adjacent ends 159,161, the ends 161, 160, the ends 160, 162, and the ends 162, 159 can intersect at corners of the third reinforcement panel 143.

The fourth reinforcement panel 144 can define a proximal end 163, a distal end 164, a top end 165, and a separable end defined by the sections (end portions) 148, 149, 150. As shown, the distal end 164 can be distal from the proximal end 163, and the top end 165 can be distal from the separable end 148, 149, 150. In some aspects, as shown, the fourth reinforcement panel 144 can define a rectangular shape and, in some aspects, a square shape. Adjacent ends 163, 164, the ends 165, 164, the end 164 and end portion 150, and the end portion 148 and the proximal end 163 can intersect at corners of the fourth reinforcement panel 144.

Figure 2B:
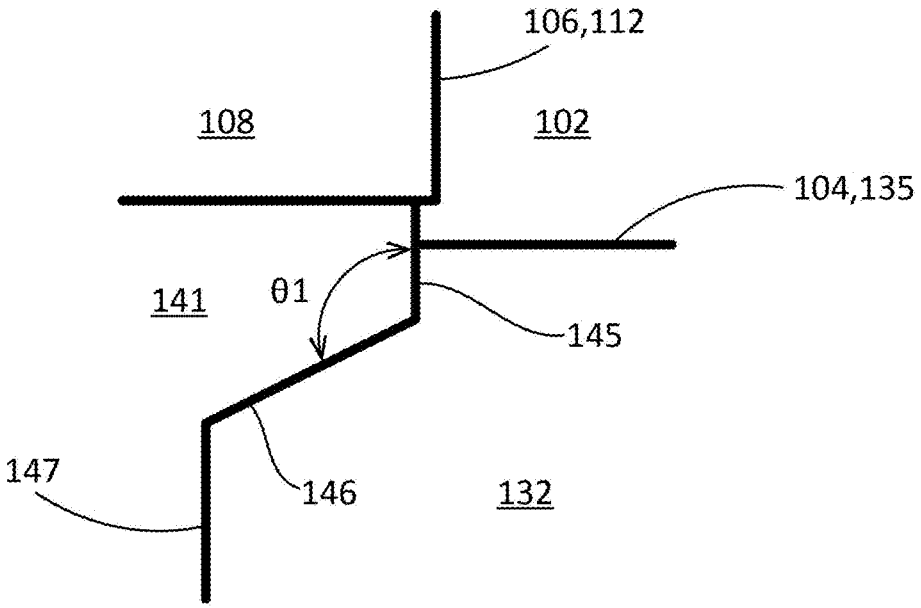
FIG. 2B is an enlargement of a first portion of FIG. 2A, detailing a joint between a first reinforcement panel and a front end panel of the blank of FIG. 1.

FIG. 2B illustrates in detail the joint between the front end panel 132 and the first reinforcement panel 141 of the blank 100 (FIG. 1). More specifically, FIG. 2B details the fourth end 145, 146, 147 of the front end panel 132. As shown, the first perforation segment 145 can extend substantially perpendicularly to the second end 135 of the front end panel 132, the second perforation segment 146 can extend from the first perforation segment 145 at a first obtuse angle θ1 to the first perforation segment 145, and the third perforation segment 147 can extend from the second perforation segment 146 in a direction substantially parallel to the first perforation segment 145.

Figure 2C:
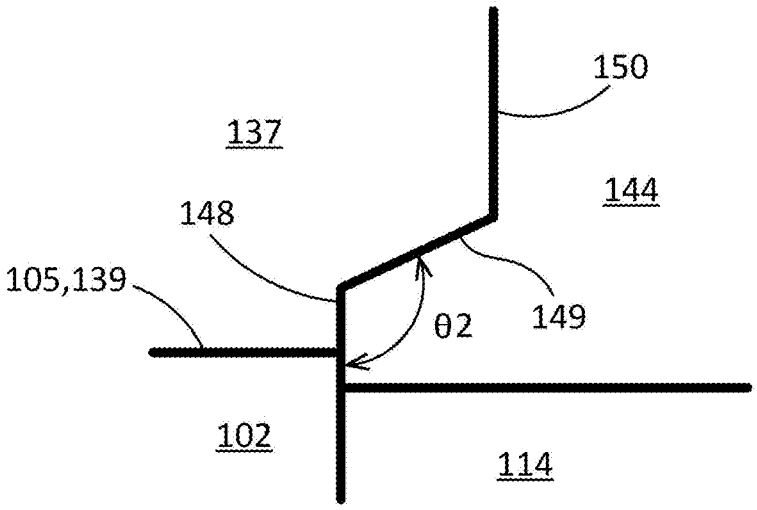
FIG. 2C is an enlargement of a second portion of FIG. 2A, detailing a joint between a fourth reinforcement panel and a rear end panel of the blank of FIG. 1.

FIG. 2C illustrates in detail the joint between the rear end panel 137 and the fourth reinforcement panel 144 of the blank 100 (FIG. 1). More specifically, FIG. 2C details the fourth end 148, 149, 150 of the rear end panel 137. As shown, the first perforation segment 148 extends substantially perpendicularly to the second end 139 of the rear end panel 137, the second perforation segment 149 extends from the first perforation segment 148 at a second obtuse angle $\theta_2$ to the first perforation segment 148, and the third perforation segment 150 extends from the second perforation segment 149 in a direction substantially parallel to the first perforation segment 148.

Referring again to FIGS. FIGS. 1 and 2A, the blank 100 may further comprise a front reinforcement flap 166 extending forward from the first end 134 of the front end panel 132. The front reinforcement flap 166 can thereby be joined to the front end panel 132 along a fold line 103*k* defining a joint between the front end panel 132 and the front reinforcement flap 166. The front reinforcement flap 166 can define a first end 167, a second end 168, a third end 169, and a fourth end 170. As shown, the second end 168 can be distal from the first end 167, and the fourth end 170 can be distal from the third end 169. In some aspects, as shown, the front reinforcement flap 166 can define a rectangular shape and, in some aspects, a square shape. Adjacent ends 167, 169, the ends 169, 168, the ends 168, 170, and the ends 170, 167, can intersect at corners of the front reinforcement flap 166. A portion of the second end 168 may extend forward from the remainder of the second end 168 to define the front locking tab 171 that terminates in a front locking tab edge 171*a*. The front reinforcement flap 166 can further define a secondary fold line 172 spaced from the fold line 103*k* and extending between the third end 169 and the fourth end 170. The secondary fold line 172, like any of the fold lines disclosed herein, can be formed into the material of the blank 100 in any manner known in the art. Secondary fold line 172 can facilitate the double folding of the front reinforcement flap 166 over the top ends 154, 157 of the first reinforcement panel 141 and the second reinforcement panel 142, respectively, during assembly of the blank 100 into the meal kit tray 1000, as will be described in further detail with regard to FIG. 7.

The blank 100 may further comprise a rear reinforcement flap 173 extending rearwardly from the first end 138 of the rear end panel 137. The rear reinforcement flap 173 can thereby be joined to the rear end panel 137 along a fold line 103L defining a joint between the rear end panel 137 and the rear reinforcement flap 173. The rear reinforcement flap 173 can define a first end 174, a second end 175, a third end 176, and a fourth end 177. As shown, the second end 175 can be distal from the first end 174, and the fourth end 177 can be distal from the third end 176. In some aspects, as shown, the rear reinforcement flap 173 can define a rectangular shape and, in some aspects, a square shape. Adjacent ends 174, 177, the ends 177,175, the ends 175, 176, and the ends 176, 174, can intersect at corners of the rear reinforcement flap 173. A portion of the second end 175 may extend rearwardly from the remainder of the second end 175 to define the rear locking tab 178 that terminates in a rear locking tab edge 178*a*. The rear reinforcement flap 173 can further define a secondary fold line 179 spaced rearwardly of the fold line 103L and extending between the third end 176 and the fourth end 177. The secondary fold line 179, like any of the fold lines disclosed herein, can be formed into the material of the blank 100 in any manner known in the art. Secondary fold line 179 can facilitate the double folding of the rear reinforcement flap 173 over the top ends 161, 165 of the third reinforcement panel 143 and the fourth reinforcement panel 144, respectively, during assembly of the blank 100 into the meal kit tray 1000, as will be described in further detail with regard to FIG. 7.

The openings in the bottom panel 102 that are respectively formed when the front bottom tab 133*a* and rear bottom tab 133*c* separate from the bottom panel 102 can be sized to receive and lockably engage at least a portion of the front locking tab 171 and the rear locking tab 178, respectively, upon assembly of the blank 100 into the meal kit tray 1000. Although the aforementioned openings may be slot-shaped, they can assume any shape that can suitably accommodate and lockably engage at least a portion of the locking tabs 171,178.

FIGS. 3-7 illustrate successive stages in the assembly of the blank 100 into the meal kit tray 1000 (FIGS. 8-11).

Figure 3:
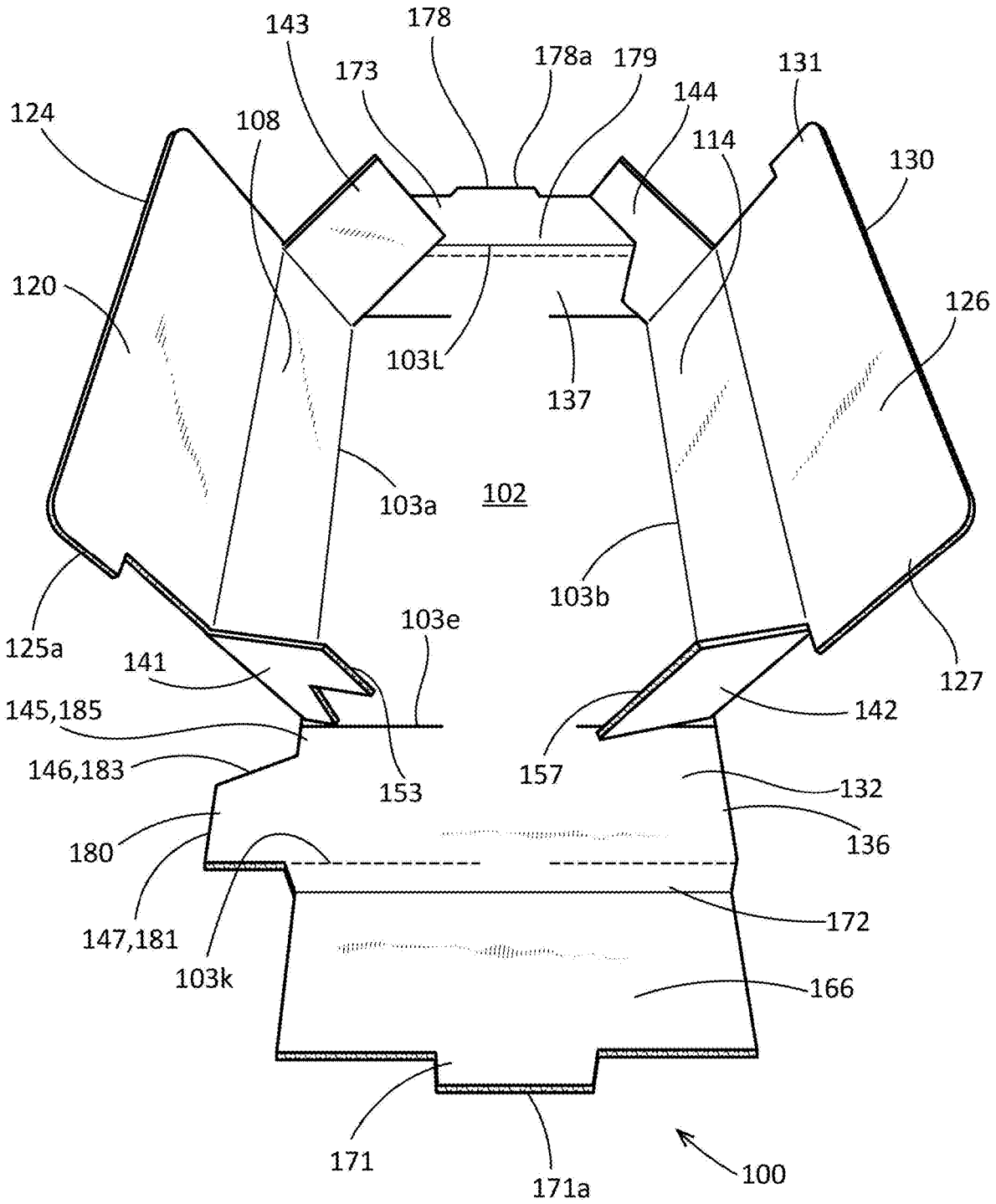
FIG. 3 is a top perspective view of the blank of FIG. 1, the blank shown undergoing a folding method to form a meal kit tray from the blank.
Figure 9:
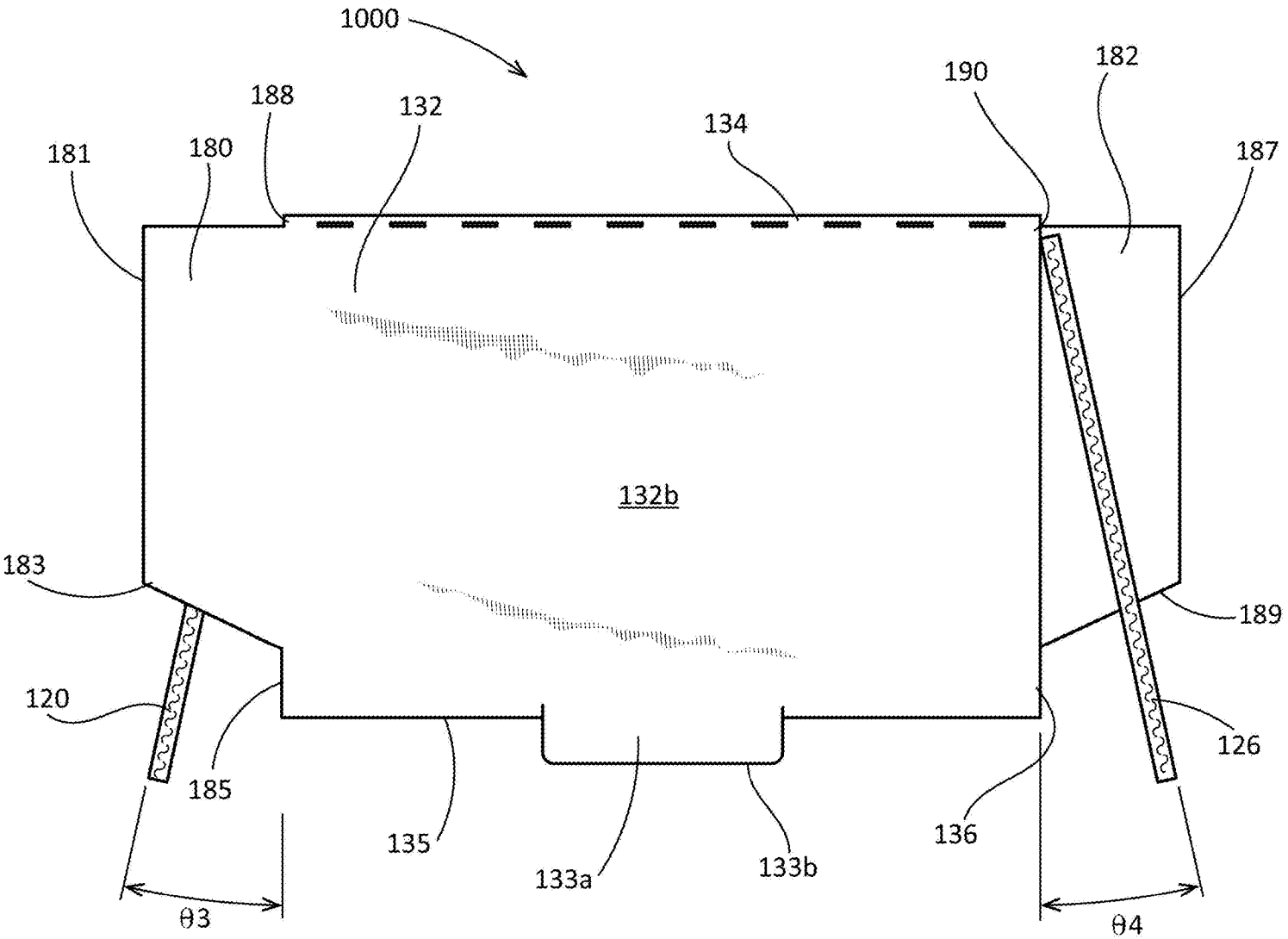
FIG. 9 is a front view of the assembled meal kit tray of FIG. 8.

In FIG. 3, the blank 100 is depicted early in the assembly process, in which the first side panel 108 is rotated upwardly about fold line 103*a*, and the second side panel 114 is rotated upwardly about fold line 103*b*. The first reinforcement panel 141 and the second reinforcement panel 142 are shown as both having separated from the front end panel 132. Similarly, the third reinforcement panel 143 and the fourth reinforcement panel 144 are shown as both having separated from the rear end panel 137. These separations result from the upward rotation of the first side panel 108, which remains connected to the first reinforcement panel 141 and to the third reinforcement panel 143 via fold lines 103*g*, 103*i*, respectively (FIGS. FIGS. 1 and 2A), and from the upward rotation of the second side panel 114, which remains connected to the second reinforcement panel 141 and the third reinforcement panel 143. One end of the separated front end panel 132 can define a first side engagement tab 180, formed from the separation of the first reinforcement panel 141 from the front end panel 132 along the perforation segments 145,146, 147, with a leading vertical edge 181 of the first side engagement tab 180 formed from the panel separation along perforation segment 147, an angled edge 183 extending at an angle from the leading vertical edge 181, the angled edge 183 formed from the panel separation along perforation segment 146, and a recessed vertical edge 185, the recessed vertical edge 185 formed from the panel separation along perforation segment 145. The third end 136 of the front end panel 132 is opposite the first side engagement tab 180. Similarly, as best seen in FIG. 9, one end of the rear end panel 137 defines a second side engagement tab 182 formed from the separation of the fourth reinforcement panel 144 from the rear end panel 137 along the perforation segments 148, 149, 150 to (FIG. 2C), with a leading edge 187 of the second side engagement tab 182 formed from the panel separation along perforation segment 150, and with an angled edge 189 extending at an angle from the leading vertical edge 187, the angled edge 187 formed from the panel separation along perforation segment 149. The third end 140 (FIG. 2A) of the rear end panel 137 is opposite the second side engagement tab 182. The leading edges 181, 187 of the respective side engagement tabs 180, 182 are configured to engage an inside wall of opposed sides of an outer box 2102 (FIGS. 21-24) when the meal kit tray 1000 is inserted into the outer box 2102.

FIG. 3 also shows that the reinforcement panels 141, 143, now detached from the end panels 132,137, respectively, have begun to be rotated inwardly about respective fold lines 103*g*, 103*i* (FIGS. FIGS. 1 and 2A) shared with the first side panel 108, and that the reinforcement panels 142, 144, now detached from the end panels 132, 137, respectively, have begun to be rotated inwardly about respective fold lines 103*h*, 103*j* (FIGS. FIGS. 1 and 2A) shared with the second side panel 114.

Figure 4:
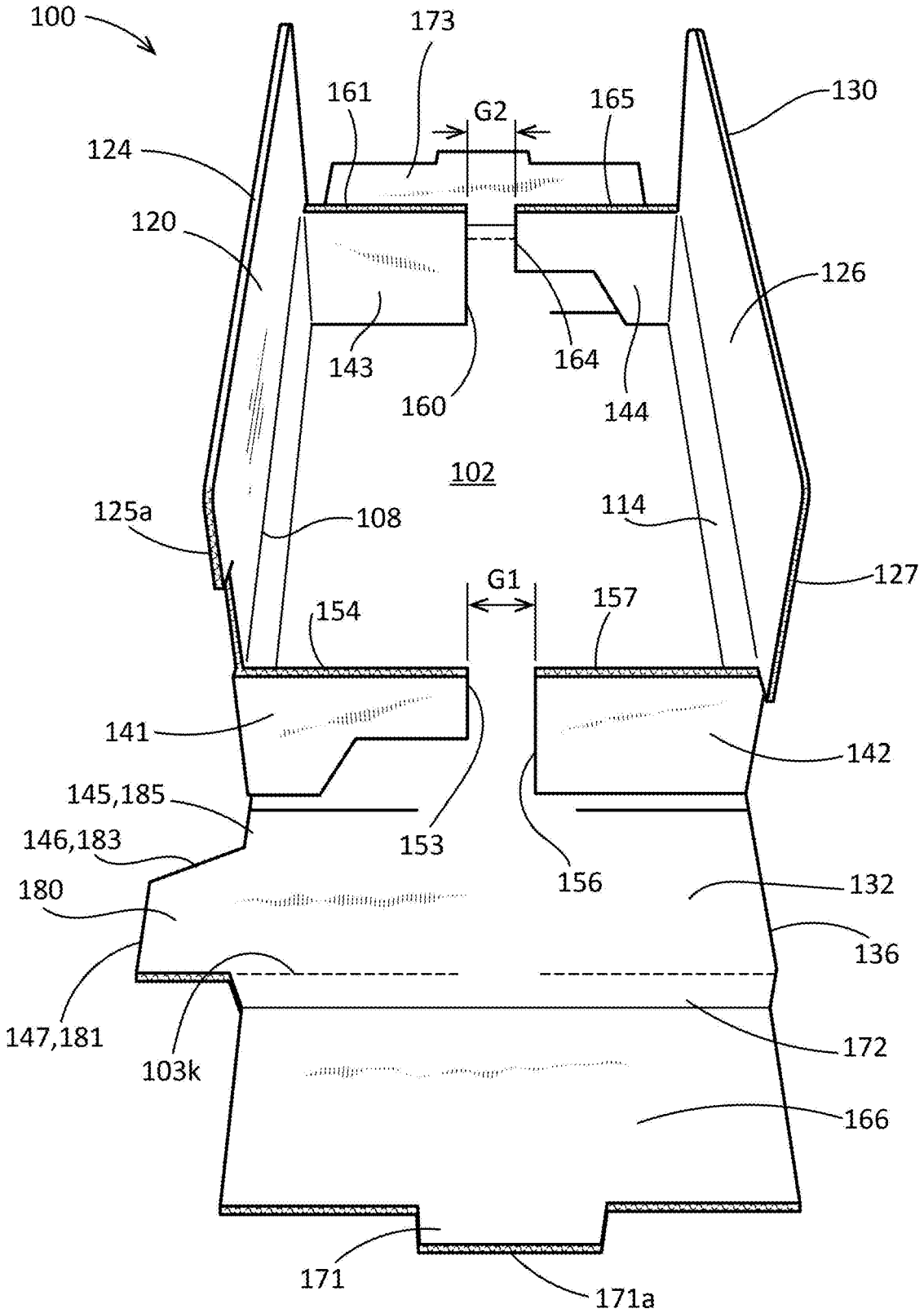
FIG. 4 is a top perspective view of the blank of FIG. 1, showing the blank in a further assembled condition resulting from continued folding after reaching the position illustrated in FIG. 3.

In FIG. 4, the upward rotation of side panels 108, 114 is shown having been completed, such that the free end 124 of the first wing 120 and the free end 130 of the second wing 126 point straight up. In other words, the side panels 108, 114 and the wings 120, 126 are all substantially perpendicular to the bottom panel 102. FIG. 4 also shows completion of the inward rotation of the reinforcement panels 141, 142, 143,144, such that reinforcement panels 141,143 extend substantially perpendicularly to the first side panel 108, and reinforcement panels 142, 144 extend substantially perpendicularly to the second side panel 114. In these positions, a gap G1 can be defined between the distal end 153 of the first reinforcement panel 141 and the distal end 156 of the second reinforcement panel 142, and a gap G2 can be defined between the distal end 160 of the third reinforcement panel 143 and the distal end 164 of the fourth reinforcement panel 144. Gaps G1, G2 may, but need not, be of equal magnitude.

Figure 5:
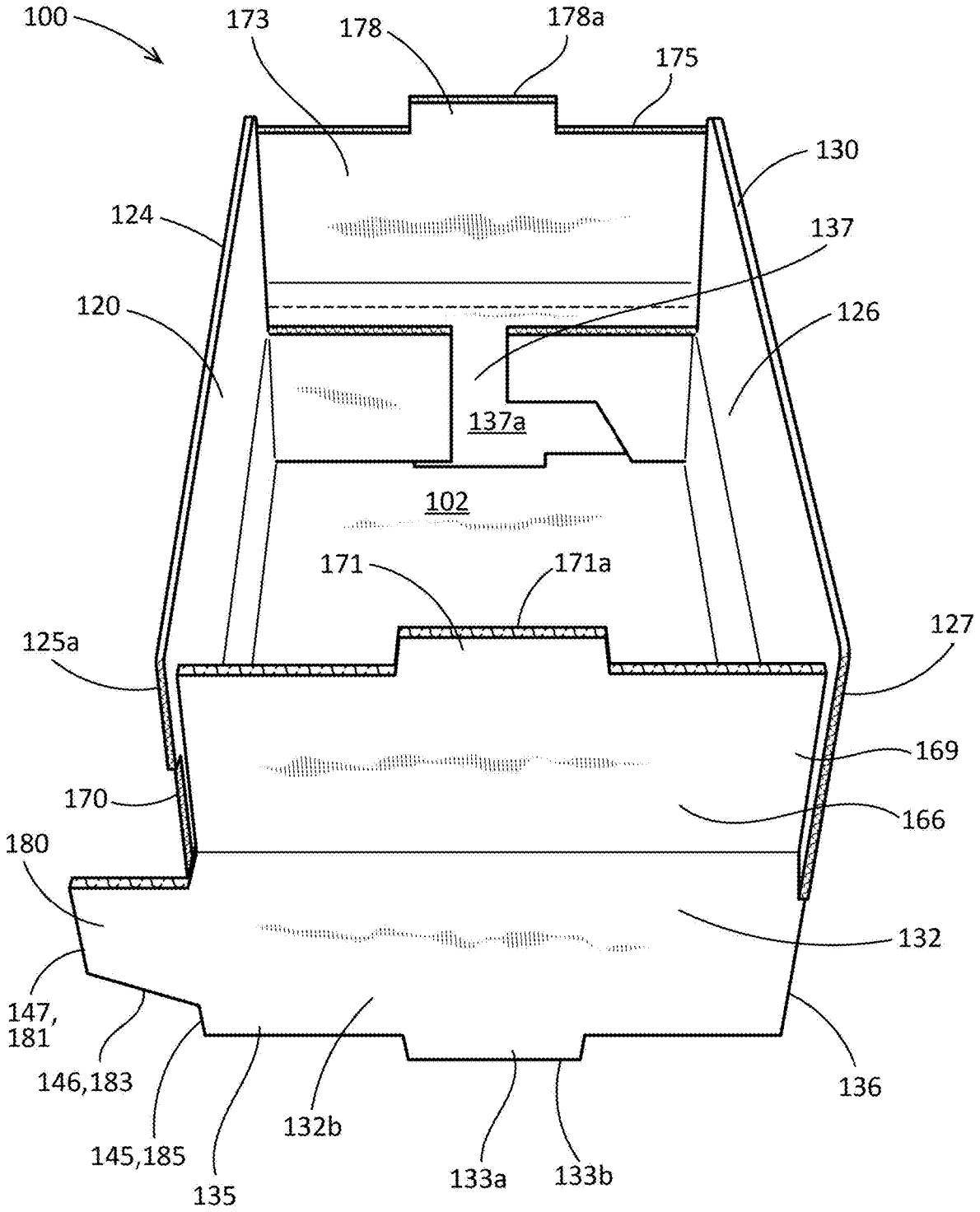
FIG. 5 is a top perspective view of the blank of FIG. 1, showing the blank in a further assembled condition resulting from continued folding after reaching the position shown in FIG. 4.

In FIG. 5, the end panels 132, 137 have been rotated fully upward, such that the locking tab edges 171*a*, 178*a* point straight up. In other words, the end panels 132, 137 and the reinforcement flaps 166, 173 are all substantially perpendicular to the bottom panel 102. In this position, the bottom tabs 133*a*,*c* (133*c* shown in FIG. 2A) have rotated fully downwardly and now both extend downwardly beneath the bottom panel 102 in an orientation substantially perpendicular to the bottom panel 102.

Figure 6:
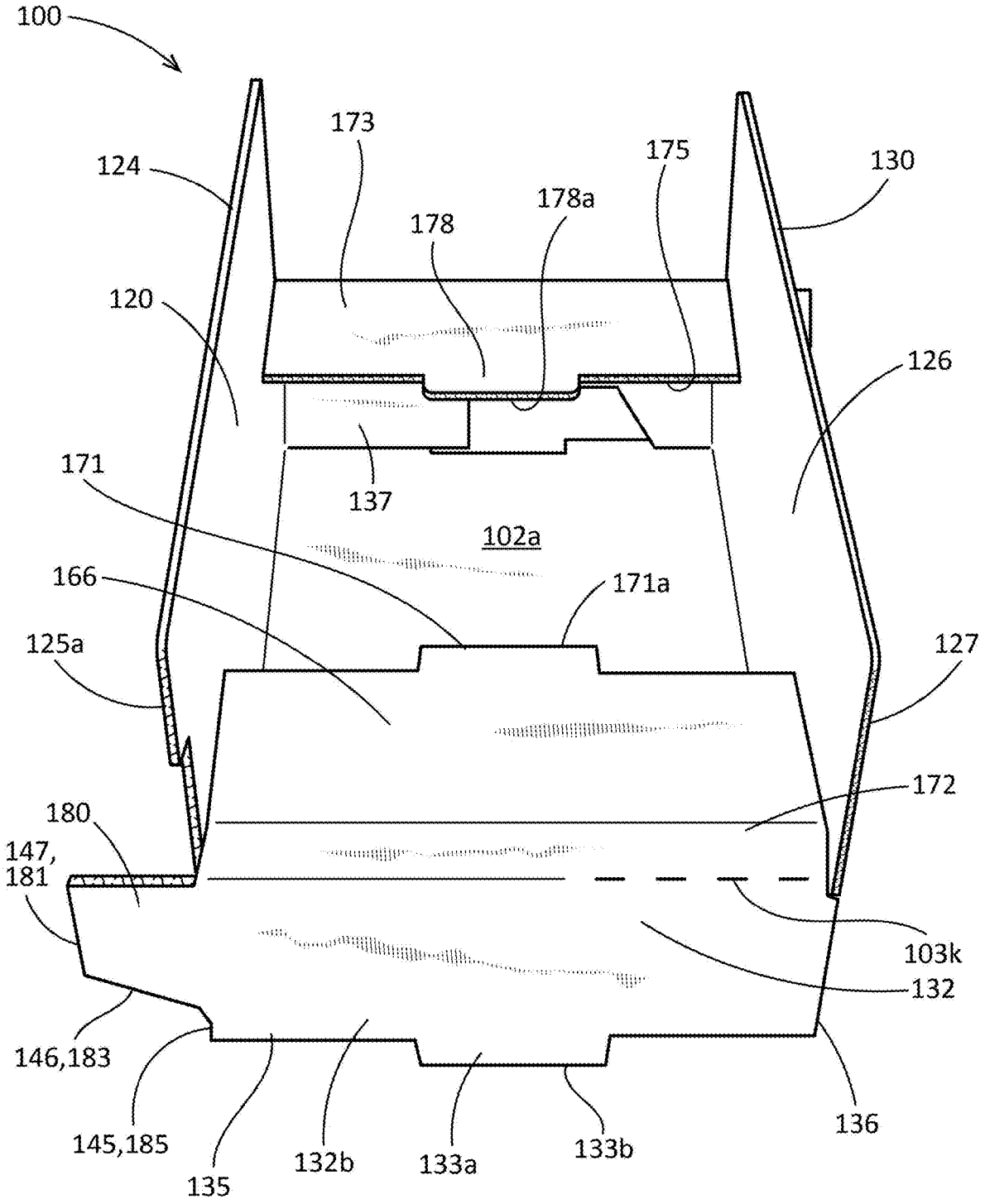
FIG. 6 is a top perspective view of the blank of FIG. 1, showing the blank in a further assembled condition resulting from continued folding after reaching the position shown in FIG. 5.

FIG. 6 shows the same blank configuration depicted in FIG. 5, except that the reinforcement flaps 166, 173 have begun to be folded inwardly about secondary fold lines 172 and 179 (FIG. 3), respectively, in the direction of first exterior surface 132*a* (FIG. 2A) of the front end panel 132 and of first exterior surface 137*a* (FIG. 5) of the rear end panel 137, respectively.

Figure 7:
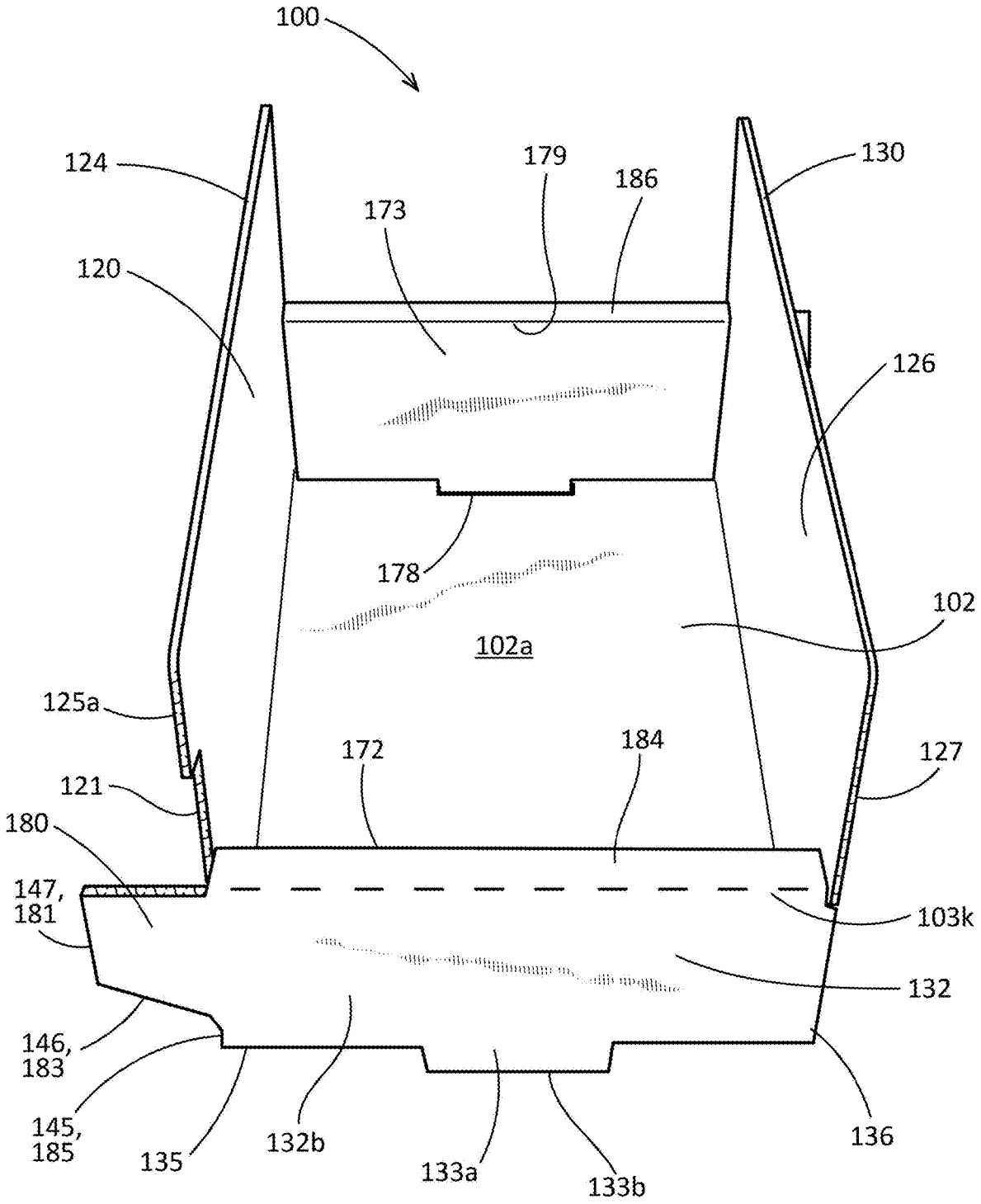
FIG. 7 is a top perspective view of the blank of FIG. 1, showing the blank in a further assembled condition resulting from continued folding after reaching the position shown in FIG. 6.

FIG. 7 depicts the conclusion of the inward rotation of the reinforcement flaps 166, 173 (166 shown in FIG. 1) about not only the secondary fold lines 172,179, respectively, but also about fold lines 103*k* and 103L (FIG. 3), respectively.

As first discussed above with regard to FIGS. FIGS. 1 and 2A, front reinforcement flap 166 has been double folded over the top ends 154, 157 (FIG. 4) of the first reinforcement panel 141 (FIG. 1) and the second reinforcement panel 142 (FIG. 1), respectively. Similarly, rear reinforcement flap 173 has been double folded over the top ends 161, 165 (FIG. 4) of the third reinforcement panel 143 (FIG. 1) and the fourth reinforcement panel 144 (FIG. 1), respectively. This double folding of the reinforcement flaps 166, 173 forms respective end rim portions 184, 186. In particular, end rim portion 184 comprises a portion of the front reinforcement flap 166 positioned between fold line 103*k* and secondary fold line 172, while end rim portion 186 comprises a portion of the rear reinforcement flap 173 positioned between the fold line 103L and the secondary fold line 179. In the position of FIG. 7, front locking tab 171 (FIG. 6) has been fully inserted into a first bottom panel opening 192 (FIG. 11) formed in the bottom panel 102 as a result the separation of the first bottom tab 133*a* from the bottom panel 102, and rear locking tab 178 has been fully inserted into a second bottom panel opening 194 (FIG. 11) formed in the bottom panel 102 as a result the separation of the second bottom tab 133*c* (FIG. 2A) from the bottom panel 102.

Figure 8:
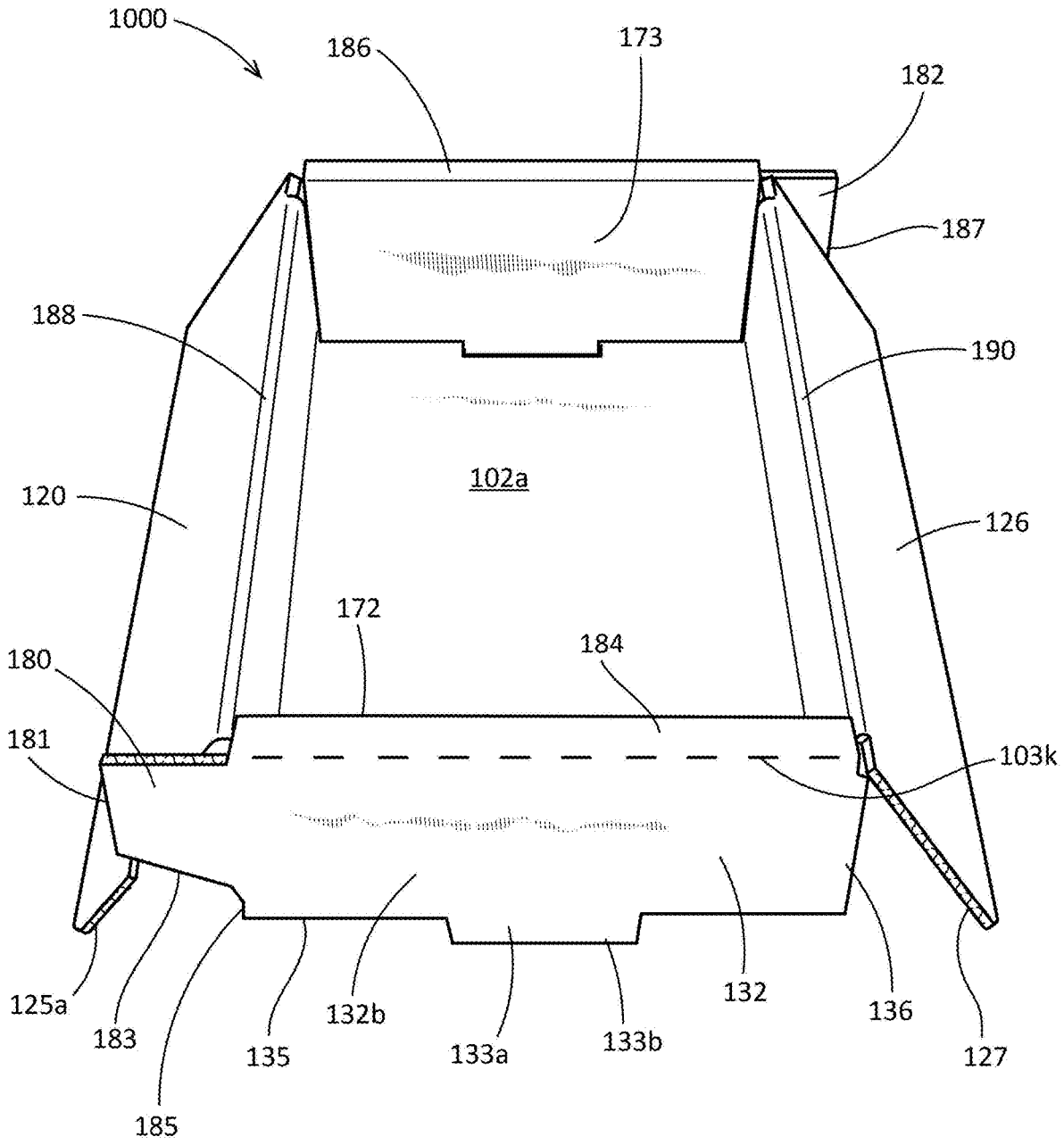
FIG. 8 is a top perspective view of a completed meal kit tray resulting from final folding of the blank of FIG. 1 from the position shown in FIG. 7.

FIG. 8 is a top perspective view of a completed meal kit tray 1000 resulting from final folding of the blank 100 of FIGS. FIGS. 1 and 2A from the position shown in FIG. 7. The sole change from the position of FIG. 7 is that the wings 120, 126 have now been folded downwardly about respective fold lines 103*c*, 103*d* (FIGS. FIGS. 1 and 2A), which have now respectively formed upper hinges 188, 190 in the meal kit tray 1000.

Figure 10:
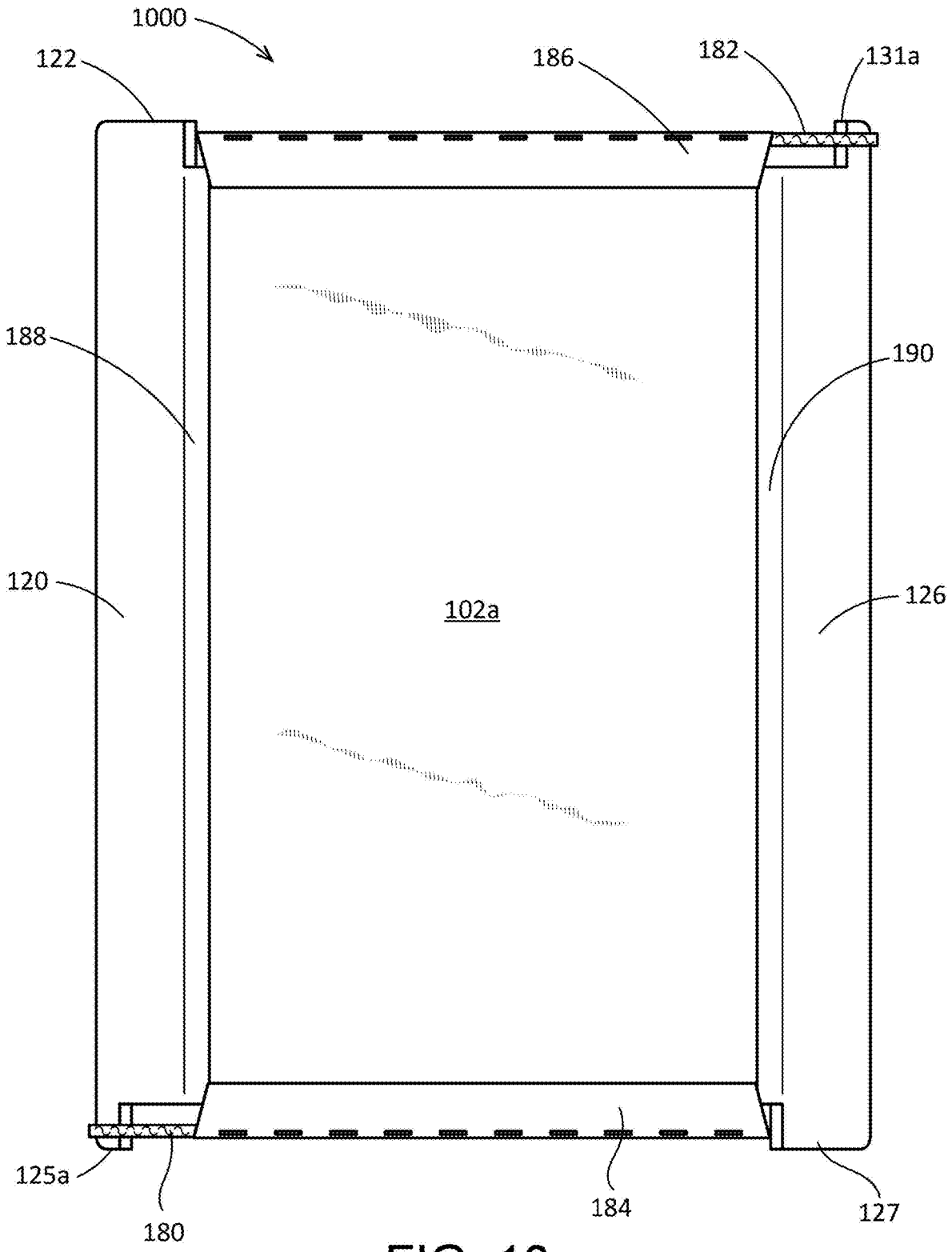
FIG. 10 is a top view of the assembled meal kit tray of FIG. 8.

FIG. 9 is a front view of the completed meal tray kit 1000 that provides a clear view of the first bottom tab 133*a* in its fully extended state, such that it fully extends downwardly beneath the bottom panel 102 (FIGS. FIGS. 1 and 2A) in an orientation substantially perpendicular to the bottom panel 102. Although not shown in FIG. 9, the second bottom tab 133*c* (FIGS. FIGS. 1 and 2A) is likewise in a fully extended state. In this state, the bottom tabs 133*a,c* function as shock absorbers to aid in protecting the meal kit tray 1000 from structural failure if the meal kit tray 1000 is dropped by a user. FIG. 9 also illustrates the downward extension of wings 120, 126 in greater detail. The first wing 120 extends downwardly from upper hinge 188 at an acute angle $\theta_3$ with respect to the vertical recessed edge 185 of the front end panel 132, and the second wing 126 extends downwardly from upper hinge 190 at an acute angle $\theta_4$ with respect to the end 136 of the front end panel 132. The magnitudes of the acute angles $\Theta_3$ and $\Theta_4$ may, but need not be, identical. FIG. 10 more generally illustrates, from a top view, the downward extension of the wings 120, 126 from the respective upper hinges 188, 190.

Figure 11:
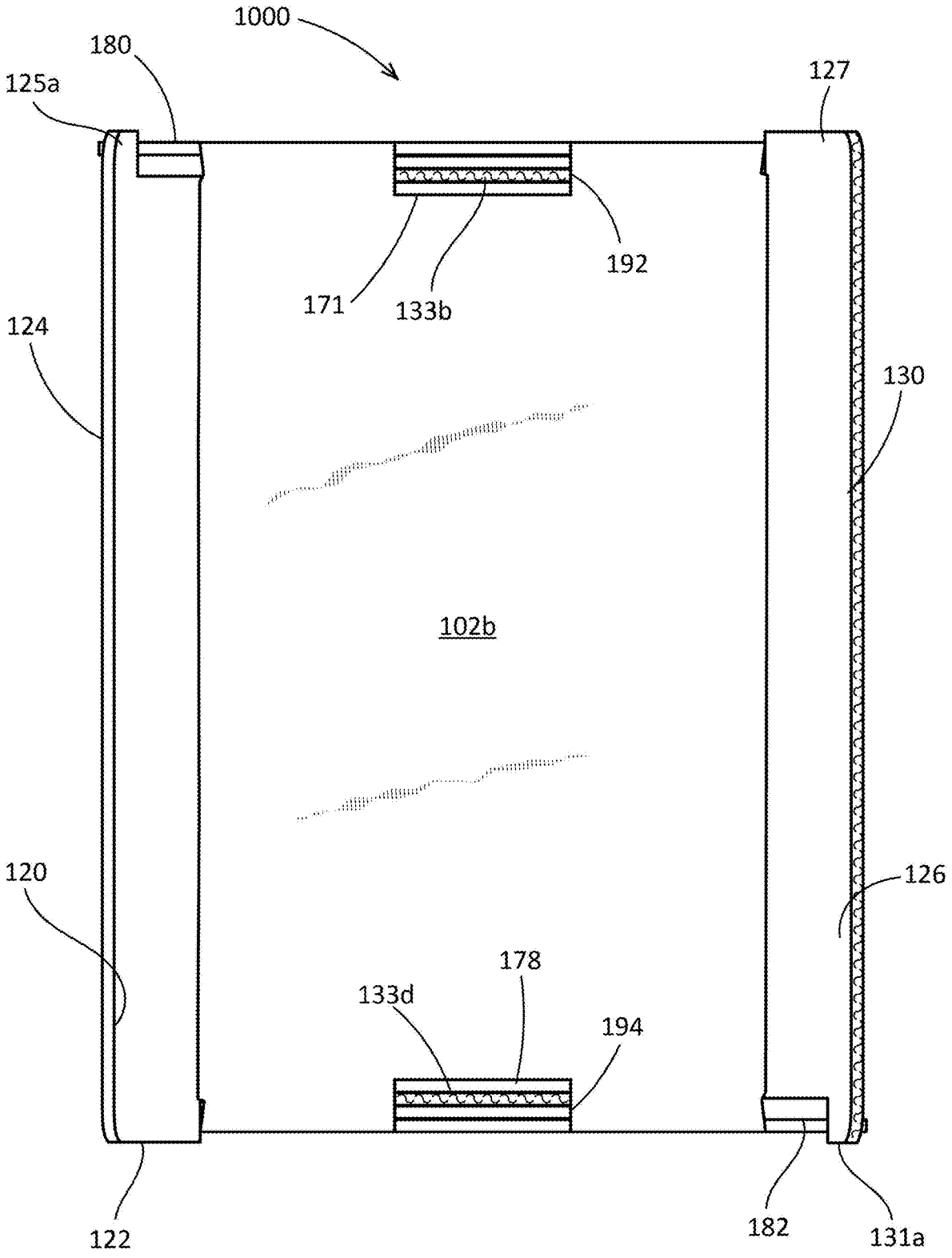
FIG. 11 is a bottom view of the assembled meal kit tray of FIG. 8.

FIG. 11 is a bottom view of the assembled meal kit tray 1000, showing the first bottom panel opening 192 and the second bottom panel opening 194 discussed above with regard to FIG. 7. In the assembled position shown, the first bottom tab edge 133*b* of the first bottom tab 133*a* (FIG. 2A) is shown protruding through the first bottom panel opening 192, and the second bottom tab edge 133*d* of the second bottom tab 133*c* (FIG. 2A) is shown protruding through the second bottom panel opening 194. Additionally, the front locking tab edge 171*a* of the front locking tab 171 can also protrude through the first bottom panel opening 192, and the rear locking tab edge 178*a* of the rear locking tab 178 can protrude through the second bottom panel opening 194. In this manner, the end panels 132, 137 are locked into the assembled position through the engagement of bottom panel openings 192, 194 by the locking tabs 171,178, respectively.

Figure 12:
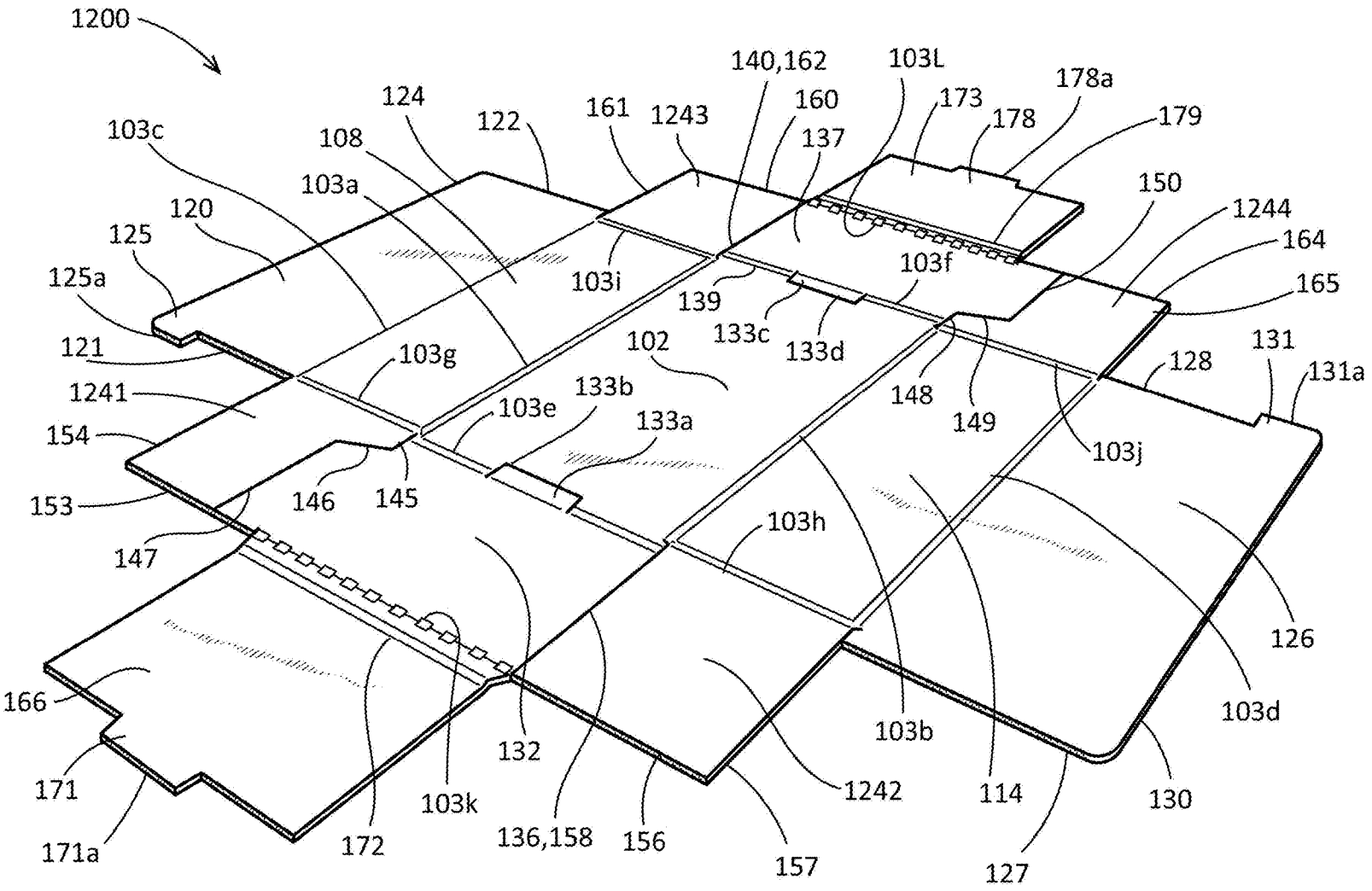
FIG. 12 is a top perspective view of a blank for a meal kit tray constructed in accordance with another aspect of the current disclosure.

FIG. 12 is a top perspective view of a blank 1200 for a meal kit tray 2000 (FIG. 20) constructed in accordance with another aspect of the current disclosure. Blank 1200 is constructed substantially identically to the blank 100 of FIGS. FIG. 1-7, except that in blank 1200, the lateral dimensions of the reinforcement panels 1241, 1242, 1243, 1244 differ from their counterparts in blank 100, in that the lateral dimensions of the reinforcement panels 1241, 1242, 1243, 1244 permit overlapping, in a manner to be described in detail with regard to FIGS. 14 and 15.

Figure 13:
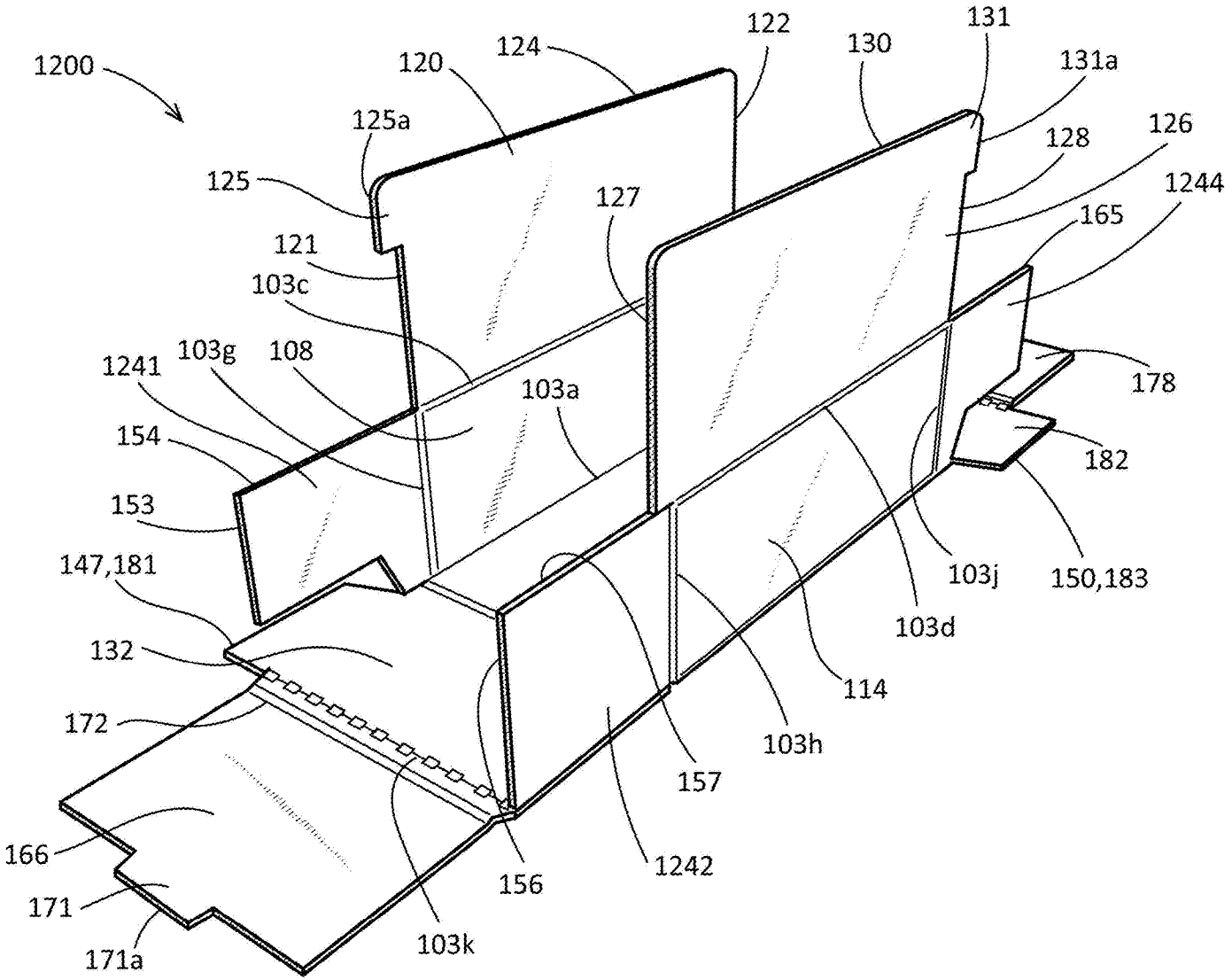
FIG. 13 is a perspective view of the blank of FIG. 12, the blank shown undergoing a folding method to form a meal kit tray from the blank.

FIG. 13 is a perspective view of the blank 1200 undergoing a folding method to form a meal kit tray 2000 (FIG. 20), the blank 1200 shown reaching a partially assembled configuration resembling that discussed with regard to FIG. 4 as to blank 100, except that in FIG. 13, the first reinforcement panel 1241, second reinforcement panel 1242, third reinforcement panel 1243 (FIG. 12), and fourth reinforcement panel 1244 are shown in a fully open position instead of a partially folded position. The orientations of the remaining panels and flaps of the blank 1200, including the fully raised position of the side panels 108, 114 and wings 120,126 are identical to that discussed with regard to FIG. 4 as to blank 100.

Figure 14:
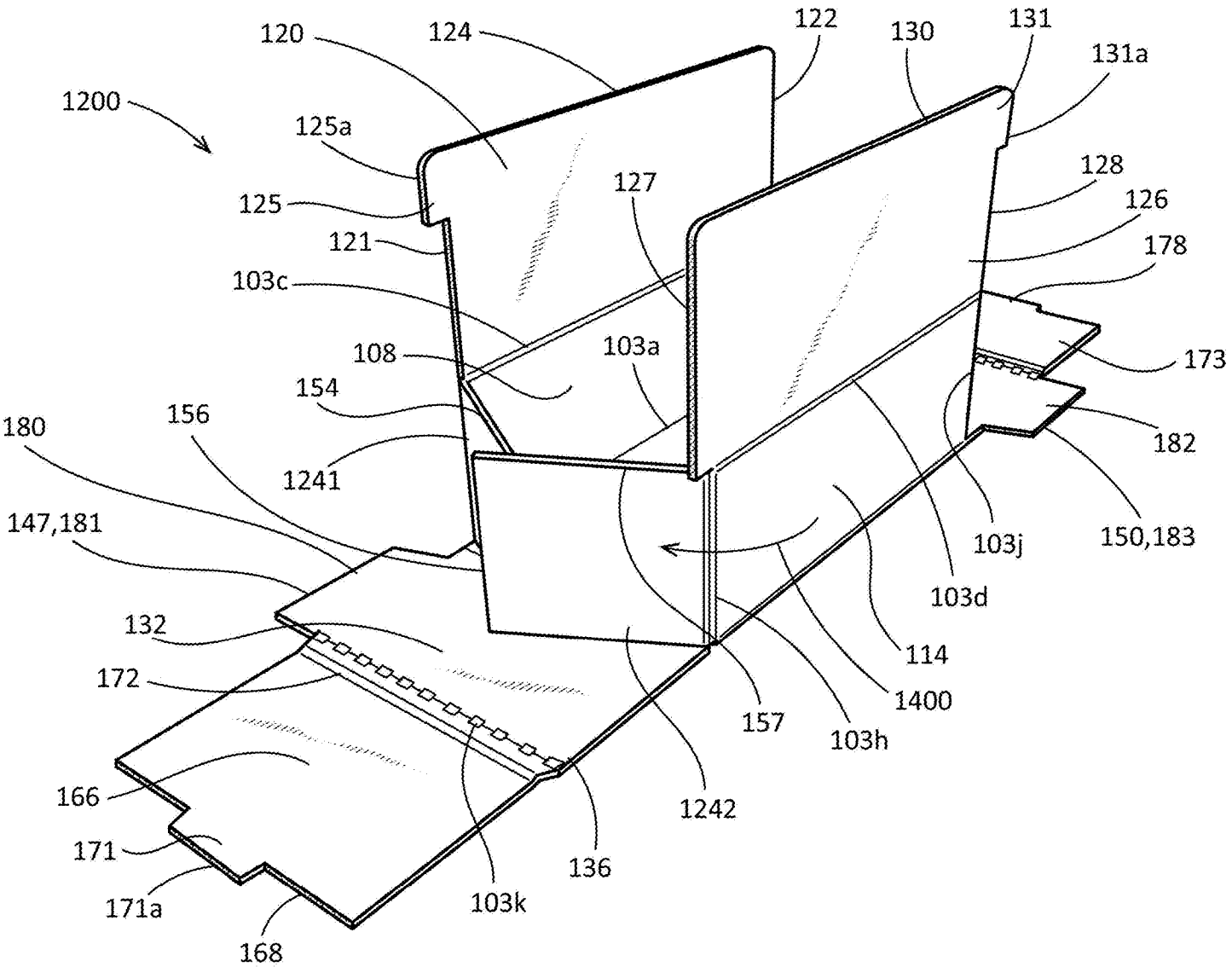
FIG. 14 is a perspective view of the blank of FIG. 12, showing the blank in a further assembled condition resulting from continued folding after reaching the position illustrated in FIG. 13.

FIG. 14 illustrates a partially assembled configuration of the blank 1200 that is identical to the configuration of FIG. 13, except that the first reinforcement panel 1241 and the second reinforcement panel 1242 are shown in a partially closed and overlapping configuration. In particular, the second reinforcement panel 1242 is shown having undergone inward movement about fold line 103*h* in the direction of arrow 1400. The first reinforcement panel 1241 has likewise undergone inward movement, but along fold line 103*g* (FIG. 12). The lateral dimension of the first reinforcement panel 1241 (extending in a direction parallel to top end 154), and/or the lateral dimension of the second reinforcement panel 1242 (extending in a direction parallel to top end 157) are sufficiently large to allow the second reinforcement panel 1242 to overlap with and, optionally, engage the first reinforcement panel 1241.

Figure 15:
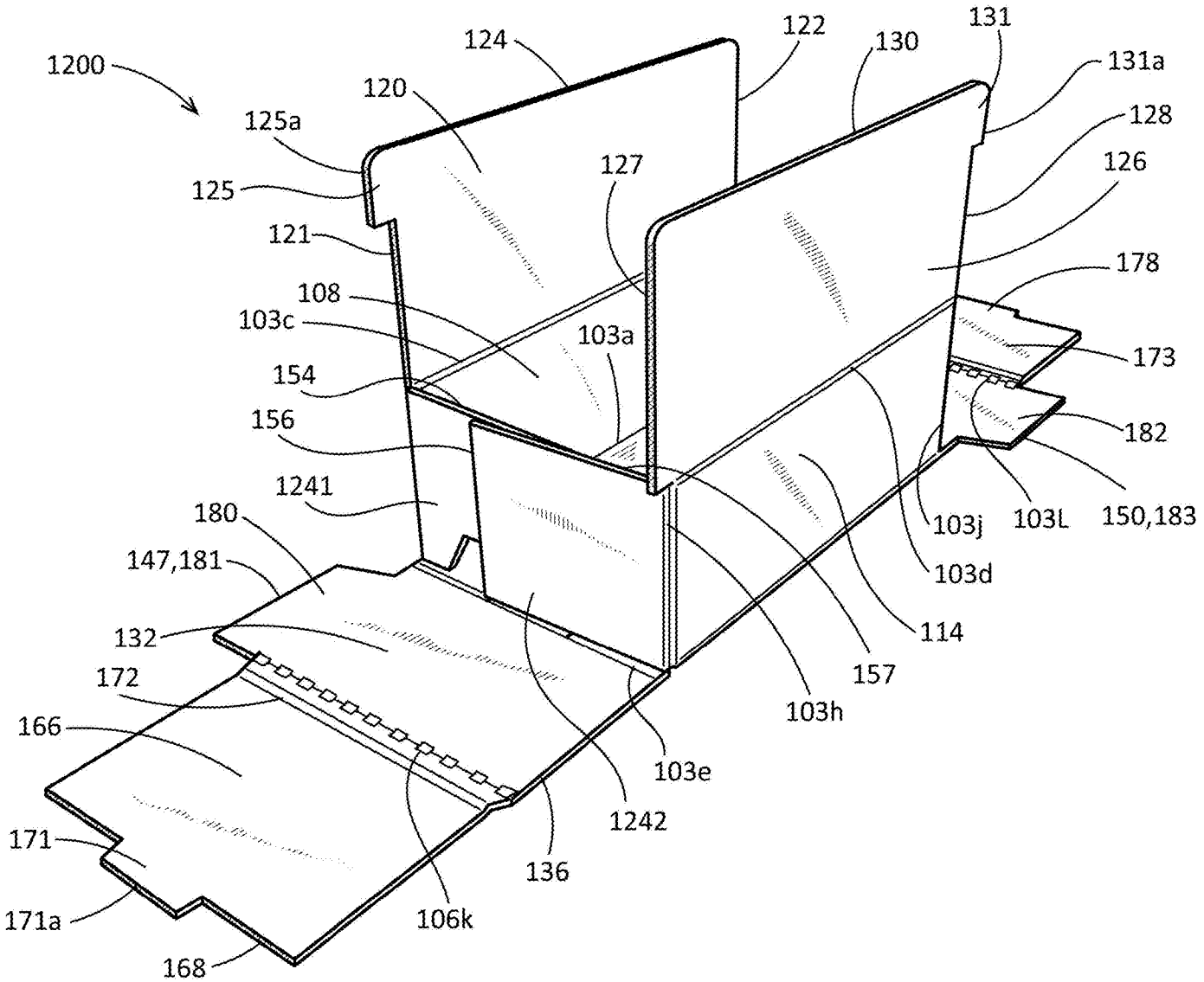
FIG. 15 is a perspective view of the blank of FIG. 12, showing the blank in a further assembled condition resulting from continued folding after reaching the position illustrated in FIG. 14.

FIG. 15 illustrates a partially assembled configuration of the blank 1200 that is identical to the configuration of FIG. 14, except that in FIG. 15, the first reinforcement panel 1241 and the second reinforcement panel 1242 have now assumed a completely closed position, such that the reinforcement panels 1241, 1242 overlap one another. Unlike the partially assembled construction of blank 100 shown in FIG. 4, there are no gaps between the free end 153 (FIG. 12) of the first reinforcement panel 1241 and the free end 156 of the second reinforcement panel 1242. Although not shown in FIG. 15, the third reinforcement panel 1243 (FIG. 12) and the fourth reinforcement panel 1244 (FIG. 12) can assume the same overlapping relationship as that shown with regard to the reinforcement panels 1241, 1242.

Figure 16:
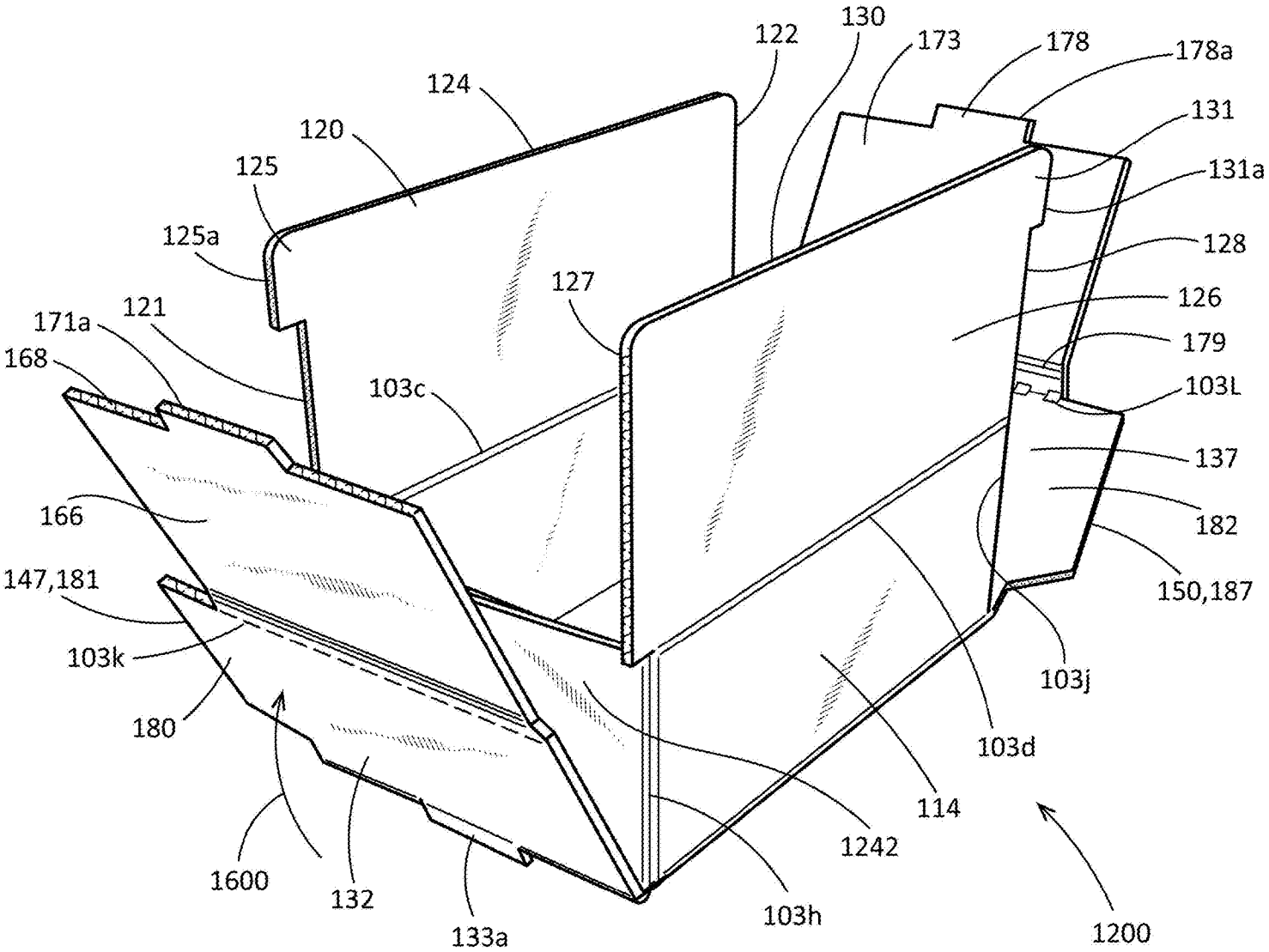
FIG. 16 is a perspective view of the blank of FIG. 12, showing the blank in a further assembled condition resulting from continued folding after reaching the position illustrated in FIG. 15.

FIG. 16 illustrates a continuation of the assembly of blank 1200 depicted in FIG. 15, such that the front end panel 132 and the front reinforcement flap 166 are rotated inwardly, in the direction of arrow 1600, about fold line 103*e* (FIG. 12). The rear end panel 137 and the rear reinforcement flap 173 are similarly rotated inwardly as a unit about fold line 103*f* (FIG. 12).

Figure 17:
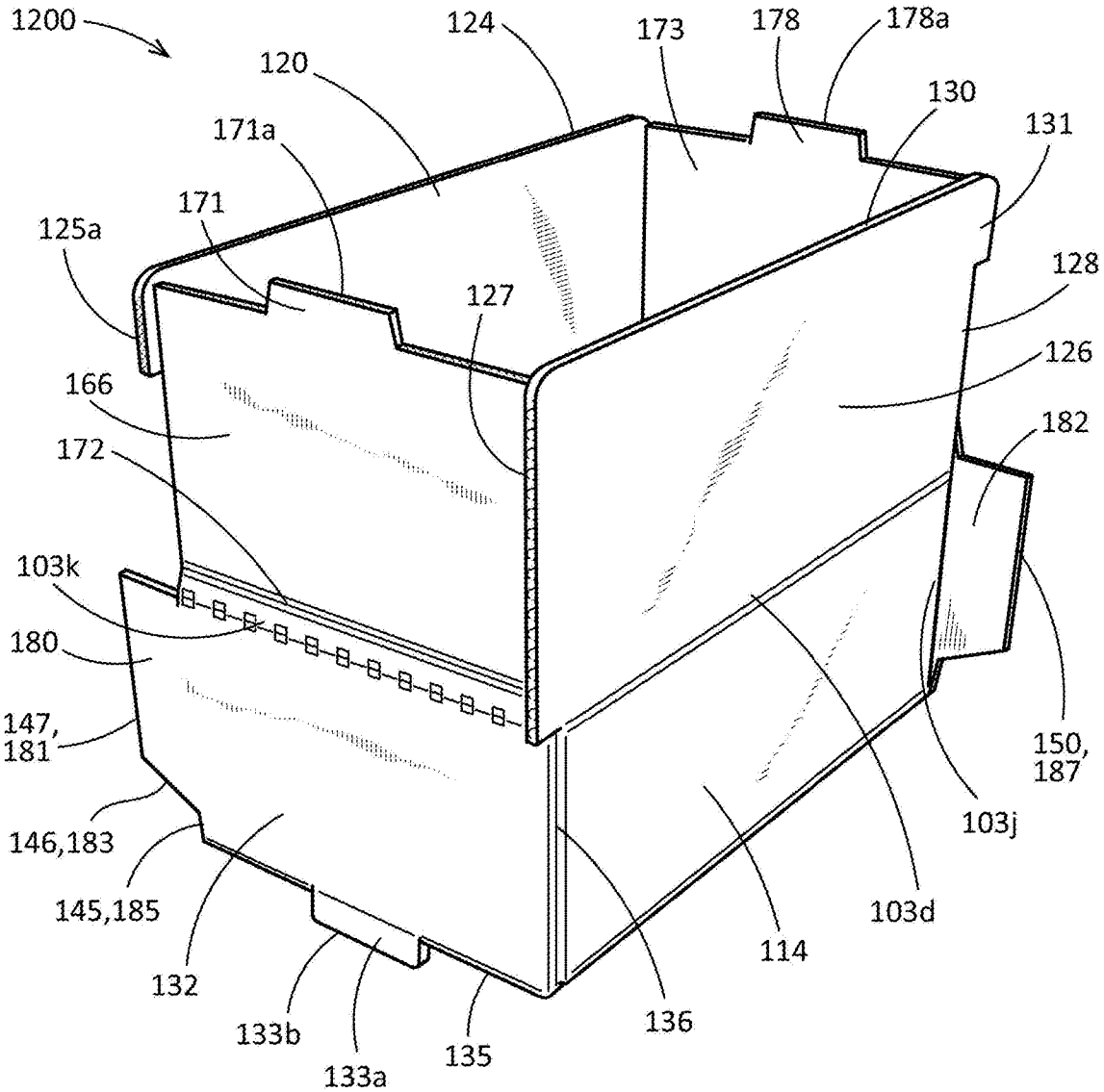
FIG. 17 is a perspective view of the blank of FIG. 12, showing the blank in a further assembled condition resulting from continued folding after reaching the position illustrated in FIG. 16.

FIG. 17 depicts further assembly of blank 1200, illustrating a partially assembled configuration of blank 1200 that is identical to the configuration discussed with regard to FIG. 5 as to blank 100.

Figure 18:
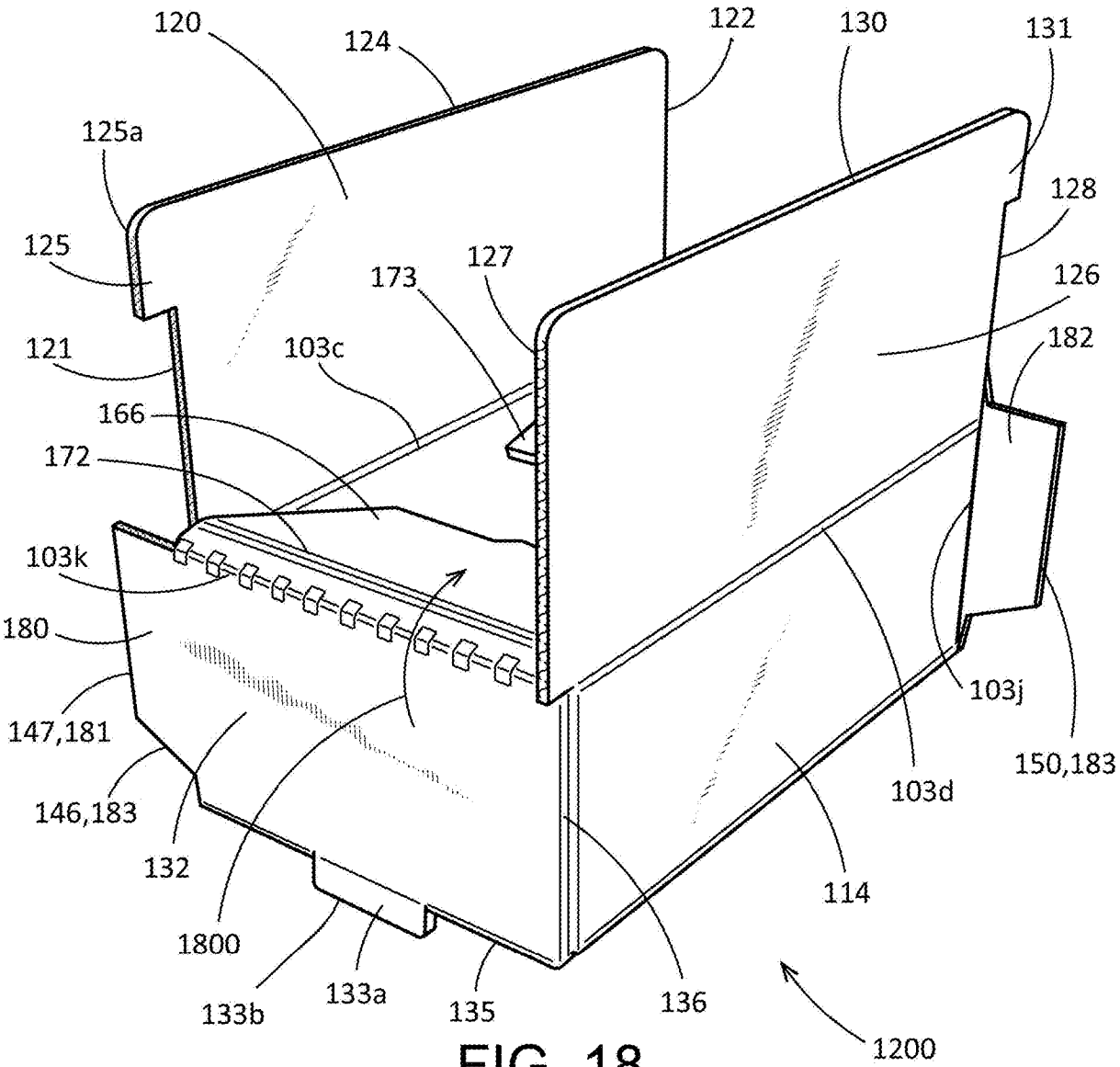
FIG. 18 is a perspective view of the blank of FIG. 12, showing the blank in a further assembled condition resulting from continued folding after reaching the position illustrated in FIG. 17.

FIG. 18 depicts still further assembly of blank 1200, illustrating a partially assembled configuration of blank 1200 that is identical to the configuration discussed with regard to FIG. 6 as to blank 100. The front reinforcement flap 166 is shown being pivoted inwardly, in the direction of arrow 1800, about fold line 103*k*. Although not completely shown in FIG. 18, the rear reinforcement flap 173 is similarly pivoted inwardly, though about fold line 103L (FIG. 12).

Figure 19:
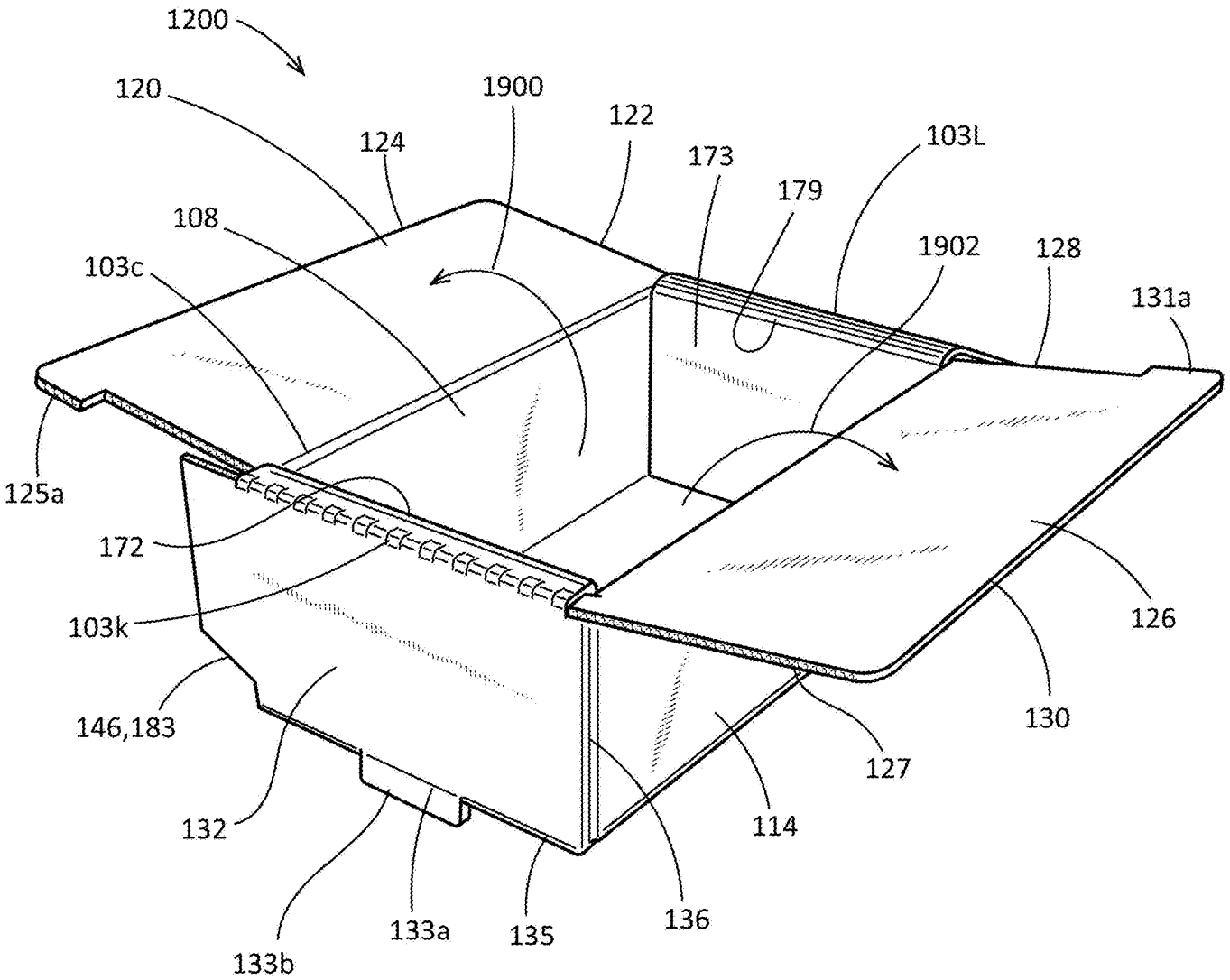
FIG. 19 is a perspective view of the blank of FIG. 12, showing the blank in a further assembled condition resulting from continued folding after reaching the position illustrated in FIG. 18.

FIG. 19 is a perspective view of the blank 1200, showing the blank 1200 in a further assembled condition resulting from continued folding after reaching the position illustrated in FIG. 18. Wings 120, 126 are shown being pivoted downwardly in the direction of arrows 1900 and 1902, respectively. The first wing 120 pivots about fold line 103*c*, and the second wing 126 pivots about fold line 103*d* (FIG. 18).

Figure 20:
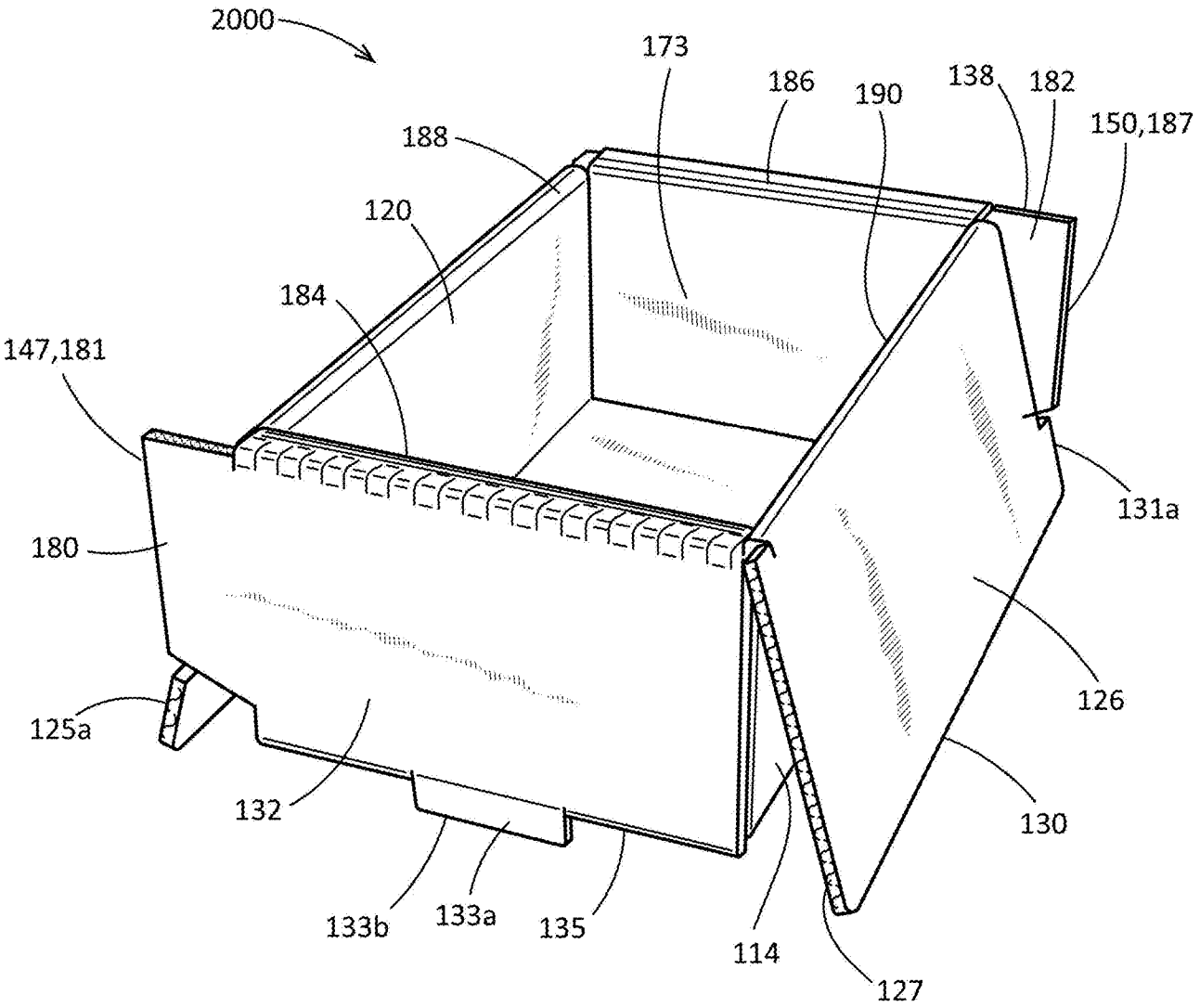
FIG. 20 is a perspective view of a completed meal kit tray resulting from final folding of the blank of FIG. 12 from the position shown in FIG. 19.

FIG. 20 is a perspective view of a completed meal kit tray 2000 resulting from final folding of the blank 1200 (FIG. 12) from the position shown in FIG. 19. Except for the blank-related differences discussed above with regard to FIGS. 12-15 as to the reinforcement panels 1241, 1242, 1243, 1244 (FIG. 12), meal kit tray 2000 is substantially identical to meal kit tray 1000.

FIG. 21 is an exploded perspective view of a shipping assembly 2100 for transporting refrigerated items, and an exploded view of the meal kit 2104. The meal kit 2104 can comprise a bag 2105 defining an interior cavity 2120 into which may be inserted vertically-stacked bag contents, namely, a first cold pack 2106, a second cold pack 2108, a food item 2110 such as a protein-based food positioned between the cold packs 2106,2108, and, optionally, an insulation panel 2119 to provide additional insulation between a lower portion of the interior of the bag 2105 (the internal space below the insulation panel 2119) and a remaining upper portion of the interior space of the bag 2105. The bag 2105 may be configured to compress to a minimal size for storage and transport, and to easily open for ease of use and loading. Additionally, the cold packs 2106, 2108 can be sized to fit snugly in the bottom of the bag 2105 to sandwich the food item 2110 and keep an upper chamber of the bag 2105 in the correct temperature range. These cold packs 2106,2108 can be thicker and have less surface area than standard 5-pound units in some aspects, thus improving thermal performance. In example aspects, the bag 2105 of the present aspect can comprise a temperature-preserving liner 3010 (shown in FIG. 30). The temperature-preserving liner 3010 can offer low emissivity and high reflectivity to radiant heat to improve the insulation of the bag 2105, as described in further detail below.

The meal kit tray 1000 can be inserted into an interior box cavity 2103 of an outer box 2102, the interior box cavity 2103 defined by inner surfaces of the outer box 2102 discussed below with regard to in FIGS. 23 and 24. The outer box 2102 can be conventionally collapsible as with other boxes when sealing tape is removed. As an alternative to the construction of the shipping assembly 2100 of FIG. 21, the insulation panel 2119 may be omitted from the inside of the bag 2105 and instead, a larger, insulation lifter pad may be inserted into the interior box cavity 2103 of the outer box 2102 before the meal kit tray 1000 is inserted into the cavity 2103. The dimensions of the insulation lifter pad would approximate those of a bottom 2117 (FIG. 23) of the outer box 2102 to allow a snug fit within the outer box 2102. The insulation panel 2119 or, alternatively, the insulation lifter pad, can each comprise one or more layers of corrugate cardboard joined together (such as by gluing), and the joined layers can be attached to opposed sides of a repulpable insulation batt, such as can be found in U.S. Pat. No. 10,882,682 or 11,338,985, the entire disclosures of which are hereby incorporated by reference as if set forth fully herein. Alternatively, instead of corrugate cardboard layers, a layer composed of a composite of both corrugate cardboard and paper material can be attached to each opposed side of the batt.

Figure 22A:
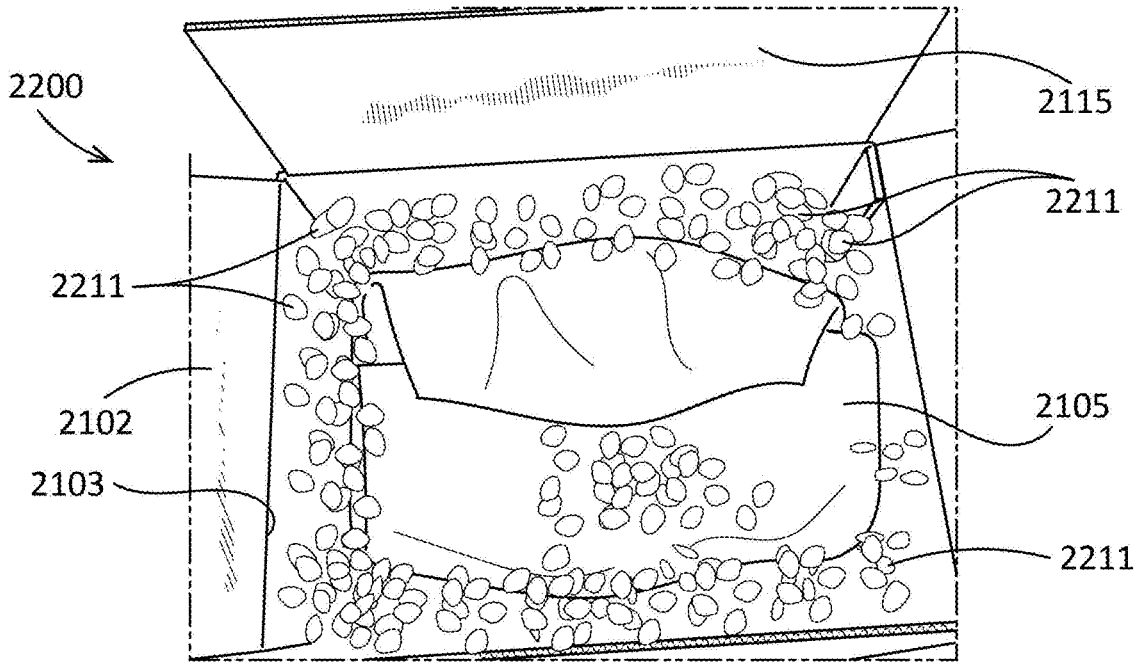
FIGS. 22A and 22B are top perspective views of alternative constructions of the meal kit shipping assembly of FIG. 21, with FIG. 22A depicting void filler elements composed of cellulose (starch) spheres, and FIG. 22B depicting void filler elements composed of crinkled paper material.
Figure 22B:
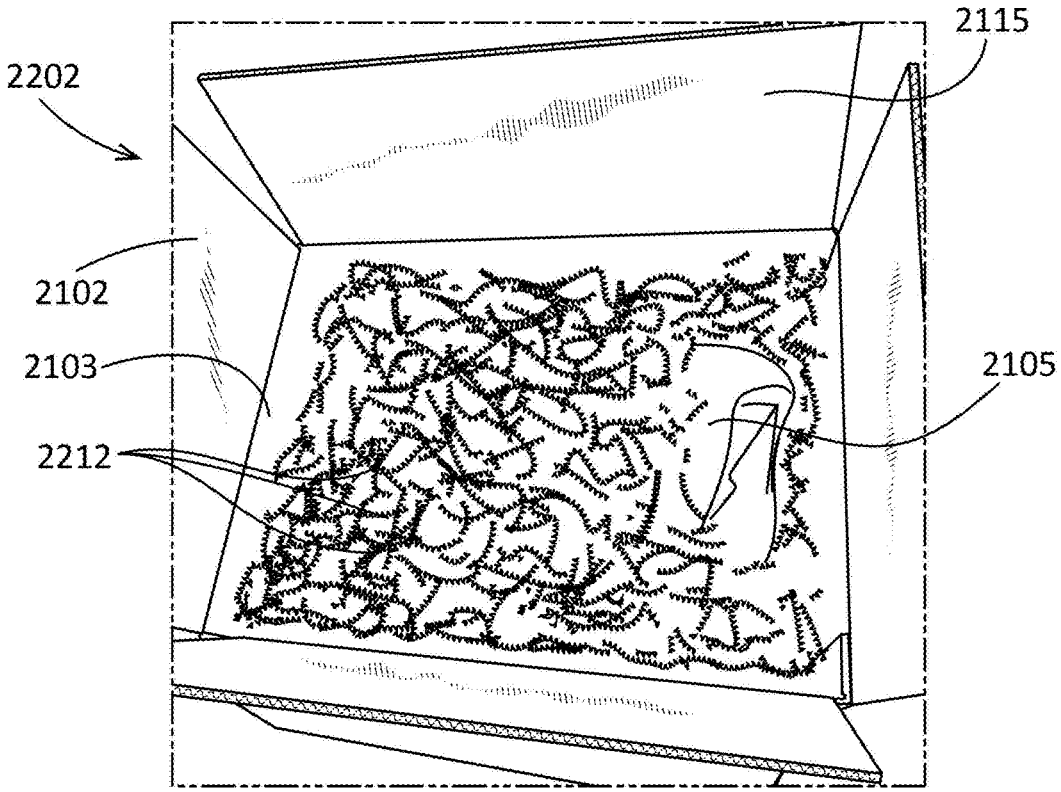

FIGS. 22A and 22B are top perspective views of alternative constructions of the meal kit shipping assembly 2100 of FIG. 21, with FIG. 22A depicting void filler elements composed of cellulose (starch) spheres, and FIG. 22B depicting void filler elements composed of crinkled paper material. In particular, FIG. 22A illustrates a shipping assembly 2200 comprising the same type of bag 2105 and the same outer box 2102 introduced in FIG. 21, the outer box 2102 including a top 2115. The shipping assembly 2200 further comprises a multitude of cellulose (starch) spheres 2211 that function as void filler material. The spheres 2211 can be inserted into the cavity 2103 along with the meal kit 2104 (FIG. 21) to provide additional insulation to the meal kit 2104. FIG. 22B illustrates a shipping assembly 2202 also comprising the same type of bag 2105 and the same outer box 2102 of FIG. 21, but further comprising crinkled paper material 2212 instead of the spheres 2211 of FIG. 22A. The crinkled paper material 2212 can be curb-recyclable in some aspects.

Figure 23:
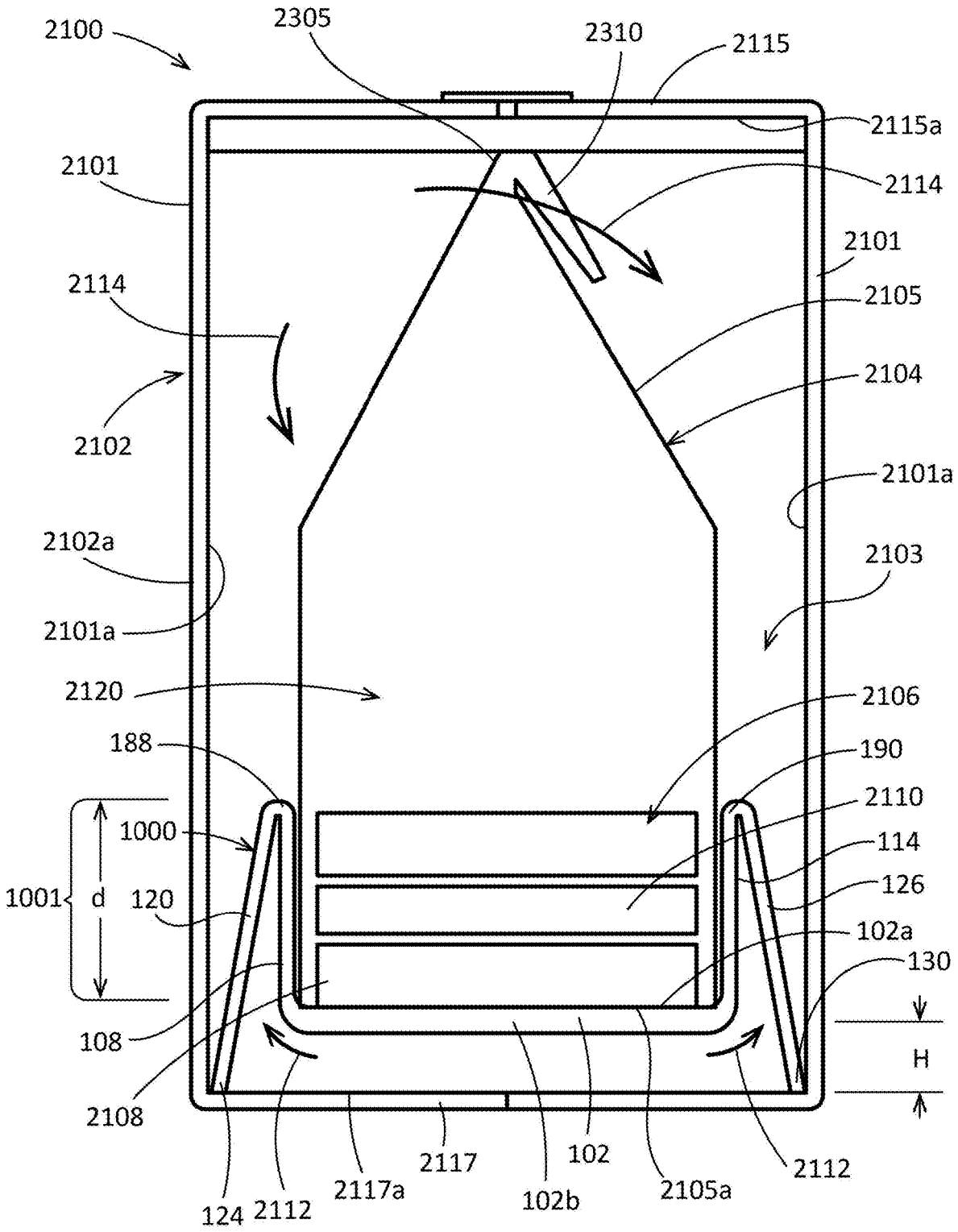
FIG. 23 is a sectional view of the meal kit shipping assembly of FIG. 21 in assembled form, showing the meal kit and the meal kit tray positioned within an outer (shipment) box, the meal kit tray constructed in accordance with the present disclosure, the meal kit tray supporting a meal kit bag containing cooling elements as well as a food item.
Figure 24:
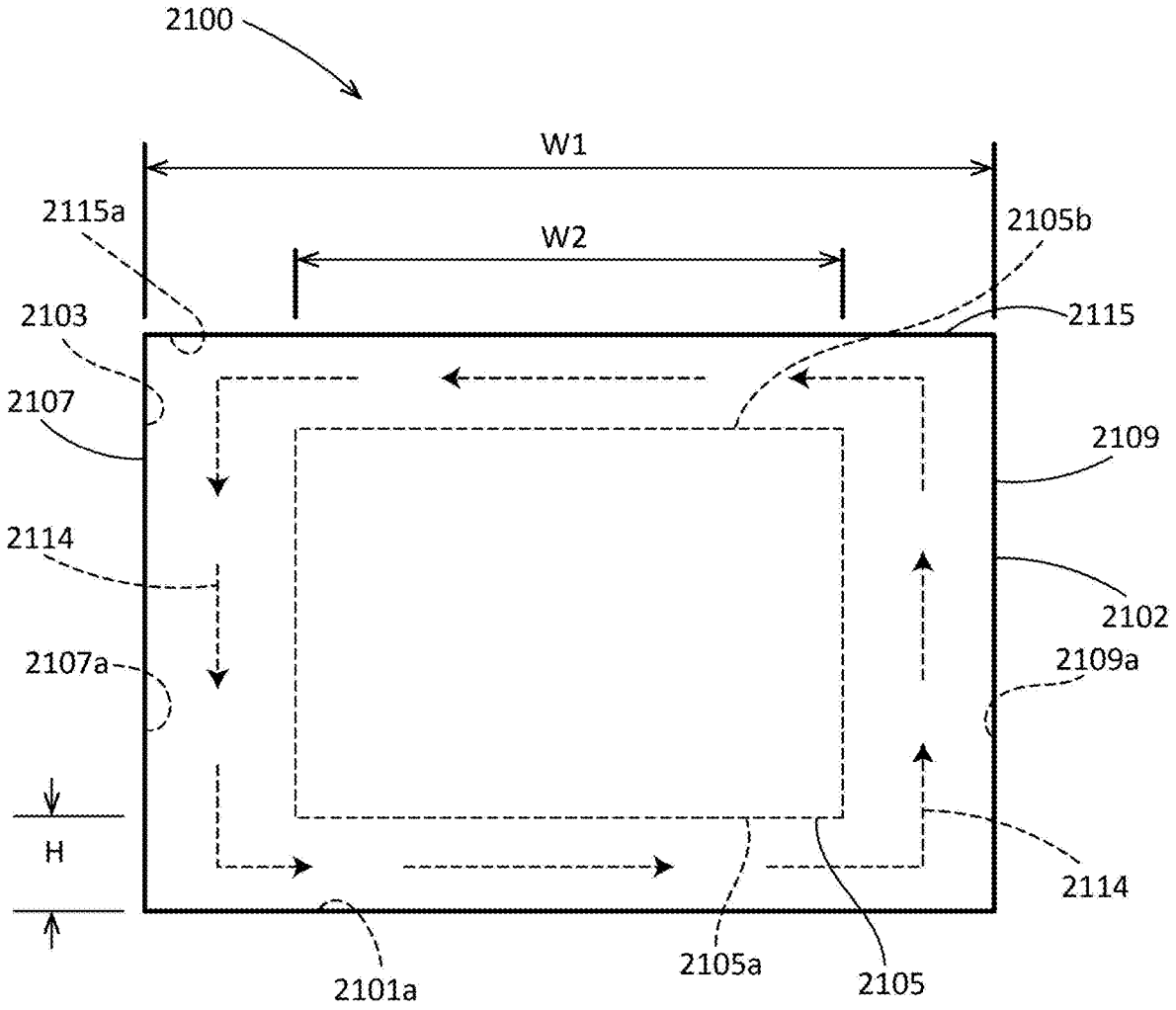
FIG. 24 is a simplified schematic side view of the assembled meal kit shipping assembly of FIG. 23.

Referring to FIGS. 23 and 24, the outer box 2102 can include the bottom 2117 defined by at least one bottom panel, two opposed side panels 2101 extending upwardly from respective opposed side edges of the bottom 2117, a front end 2107 (FIG. 24) extending upwardly from a front edge of the bottom 2117, a rear end 2109 (FIG. 24) extending upwardly from a rear edge of the bottom 2117, and the top 2115 defined by at least one upper flap connected to an upper end of a side panel 2101 or to an upper end of either of the ends 2107,2109. An upper surface of the bottom 2117 can define an inner bottom surface 2117*a* of the outer box 2102. The two side panels 2101 can define two inner side surfaces 2101*a* of the outer box 2102, front end 2107 can define an inner front surface 2107*a* (FIG. 24), and rear end 2109 can define an inner rear surface 2109*a* (FIG. 24). The inner surfaces 2117*a*,2101*a*,2107*a*,2109*a* define the cavity 2103 inside the outer box 2102. Cavity 2103 may be further defined by an inner top surface 2115*a* of the top 2115 when the top 2115 covers an upper opening of the outer box 2102 that would otherwise be formed at the upper ends of the side panels 2101, front end 2109, and rear end 2109, such a closed position illustrated in FIGS. 23 and 24. The outer box 2102 can also define four outer side surfaces 2102*a*.

FIG. 23 depicts the meal kit tray 1000 fully inserted into the cavity 2103 of outer box 2102, with the bottom panel 102 of the meal kit tray 1000 supporting a bottom 2105*a* of the meal kit bag 2105. In example aspects, an upper bag portion 2310 of the bag 2105 can be folded over to enclose the interior cavity 2120 at a top bag end 2305 of the bag 2105. The first wing 120 and the second wing 126 of the meal kit tray 1000 can position the bottom panel 102 of the meal kit tray 1000 above the inner bottom surface 2117*a* of the outer box 2102. In particular, both the free end 124 of the first wing 120 and the free end 130 of the second wing 126 can engage at least one of the inner side surfaces 2101*a* and the inner bottom surface 2117*a* of the outer box 2102. The spacing relationship provided by the wings 120, 126 is shown by the height H that designates a magnitude of spacing between the inner bottom surface 2117*a* of the outer box 2102 and the bottom surface 102*b* of the meal kit tray bottom panel 102. The magnitude of spacing comprising height H can allow the bottom tab edges 133*b,d* (FIG. 11) to be spaced above the inner bottom surface 2117*a* at a distance of, for example and without limitation, one-quarter of an inch (¼"). In the spatial arrangement exemplified in FIGS. 23 and 24, the meal kit tray 1000 can suspend the meal kit 2104 above the inner bottom surface 2117*a* of the outer box 2102, and thereby can protect the meal kit 2104 from conductive heat originating from external heat sources such as hot surfaces on which the shipping assembly 2100 may be placed (including, for example, a front porch of a residence). The arrangement of the shipping assembly 2100 herein described can also leverage insulation properties provided by the material from which the outer box 2102 is constructed.

The meal kit tray 1000 may define a seat depth d, which in FIG. 23 can be measured as the difference between an upper boundary taken at a height of the upper hinge 188 from the inner bottom surface 2117*a* and a lower boundary taken at a height of the upper surface 102*a* of the bottom panel 102 from the inner bottom surface 2117*a*. The meal kit tray 1000 can define a seat 1001 that can include the elements of the meal kit tray 1000, other than the wings 120,126, appearing between the aforementioned upper and lower boundaries that define seat depth d. The seat 1001 can be at least partially defined by the bottom panel 102 and the opposed side panels 108, 114 of the meal kit tray 1000. The seat depth d can equal the depth of seat 1001. The seat depth d can be sized in a manner that will focus a portion of cold air flow 2114 on the bag contents inside the bag 2105, such contents in the example of FIGS. 21 and 23 comprising the cold packs 2106,2108 and the food item 2110. For example, the seat depth d can be a predetermined magnitude that exceeds a combined height of the bag contents 2106,2108, 2110 arranged in a vertically stacked configuration, such that the stacked bag contents 2106,2108,2110 can be fully received within the seat 1001. However, the seat depth d need not exceed the combined height of the stacked bag contents 2106,2108,2110 to substantially attain the cooling objectives of the meal kit tray 1000. The focus of cold air flow 2114 on those bag contents can further benefit from the folded construction of the meal kit tray 1000, if the blank 100 (FIG. 1) from which the meal kit tray 1000 is constructed comprises insulative material. For example, if the blank 100 is comprised of a double-layer corrugated cardboard, which possesses insulative properties, then the seat 1001 of the meal kit tray 1000 can benefit from not only the dual-layered carboard insulation at the bottom panel 102 of the meal kit tray 1000, but also from quadruple-layered cardboard insulation at the sides. In particular, still referring to FIG. 23, one side of meal kit tray 1000 includes not only the first side panel 108 but also the folded-down first wing 120, each of the first side panel 108 and first wing 120 including double cardboard insulation, for a total of four cardboard layers at that side of the meal kit tray 1000. Similarly, the opposite side of the meal kit tray 1000 includes not only the second side panel 114, but also the folded-down second wing 126, thus providing four layers of cardboard insulation at that side of the meal kit tray 1000.

Still referring to FIGS. 23 and 24, The meal kit tray 1000 also isolates the bag 2105 of the meal kit 2104 from the inner surfaces 2101*a*,2107*a*,2109*a*,2115*a* of the outer box 2102 in terms of conductive heat transfer, as now herein further described. As discussed above with regard to FIG. 1, at least one of the wings 120, 126 can define an end engagement tab 125,131 (FIG. 1) having a tab edge (respectively, 125*a*, 131*a* in FIG. 11). The first end engagement tab 125 can extend horizontally toward the inner front surface 2107*a* of the front end 2107 (FIG. 24) of the outer box 2102, such that the front tab edge 125*a* can engage the inner front surface 2107*a*. Similarly, the second end engagement tab 131 can extend horizontally toward the inner rear surface 2109*a* of the rear end 2109 (FIG. 24) of the outer box 2102, such that the rear tab edge 131*a* can engage the inner rear surface 2109*a*. The end engagement tabs 125, 131 can be thereby configured to space the meal kit tray 1000 from the inner end surfaces 2107*a*,2109*a* of the outer box 2102. Additionally, although not shown in FIGS. 23 and 24, but discussed above with regard to FIG. 3, the leading edges 181,187 (FIGS. 3 and 8, respectively) of the side engagement tabs 180,182 (FIG. 9) can each engage an inner side surface 2101*a* of the outer box 2102 when the meal kit tray 1000 is inserted into the outer box 2102.

The elements of the shipping assembly 2100 can be suitably sized so as to allow the flow of air (indicated by arrows 2114) around not only the front and back of the meal kit bag 2105 (since the width W1 (FIG. 24) of the outer box 2102 is greater than the width W2 (FIG. 24) of the meal kit bag 2105), but also across the top 2105*b* (FIG. 24) of the meal kit bag 2105. Therefore, the dimensions and configuration of the meal kit tray 1000 also allow the top 2105*b* of the bag 2105 to be spaced from the inner top surface 2115*a* of the outer box 2102. Such spacing can be further attained by using a material for the bag 2105 that allows it to be rolled or folded down, which provides the additional advantage of reducing the volume of air inside the bag 2105 that needs to be cooled. The suspension of the meal kit 2104 above the inner bottom surface 2117*a* of the outer box 2102 can also allow air (arrows 2112) to flow underneath the bottom surface 102*b* of the meal kit tray bottom panel 102, thereby maximizing the volume of cooling air in the cavity 2103 about the meal kit 2104. Even though FIGS. 21-24 discuss the illustrated configurations with regard to meal kit tray 1000, is to be understood that alternative meal kit embodiments such as meal kit tray 2000 (FIGS. 12-20) may substituted for meal kit tray 1000.

Figure 25:
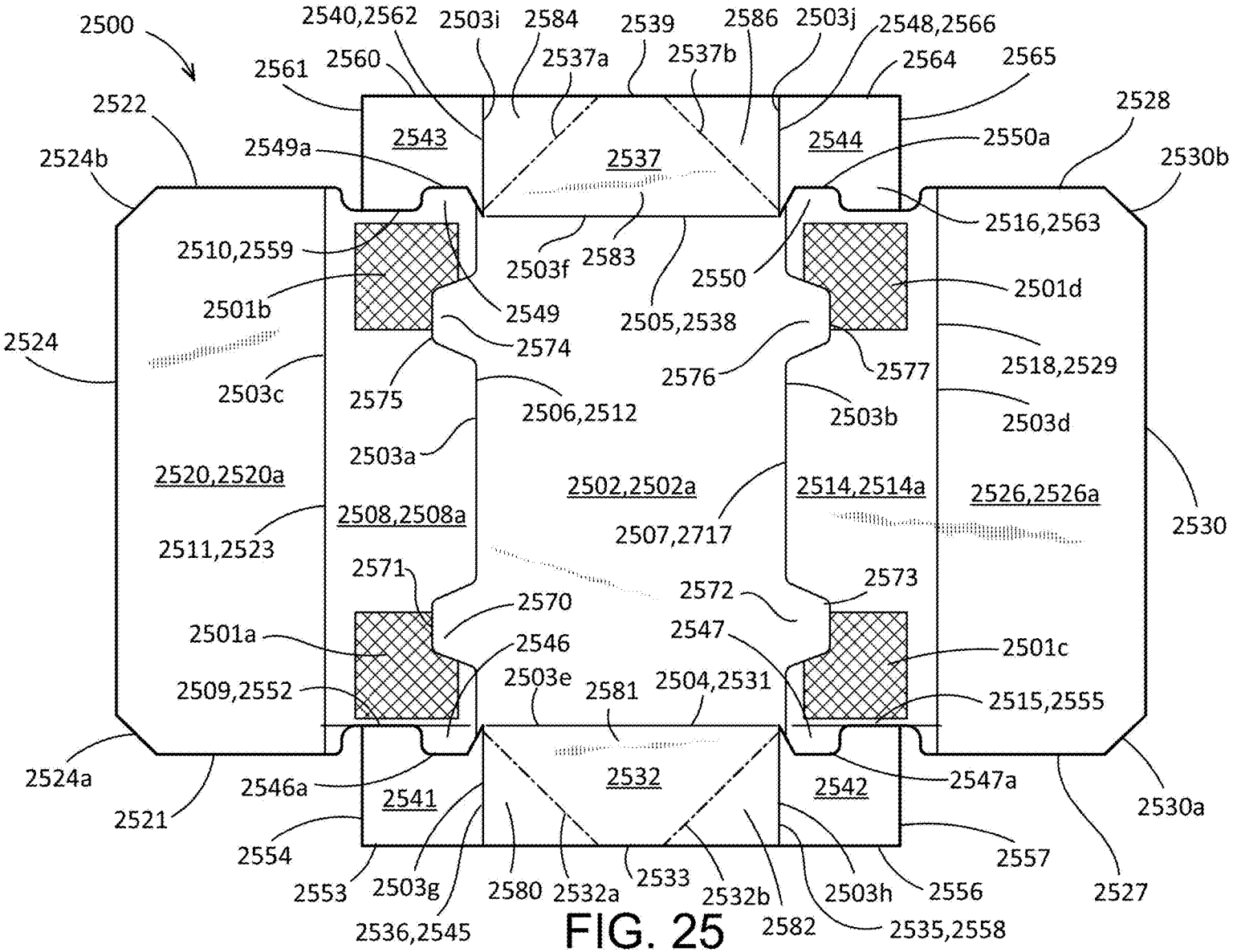
FIG. 25 is a top plan view of a blank for a collapsible meal kit tray constructed in accordance with another aspect of the current disclosure.

FIG. 25 is a top plan view of a blank 2500 for a collapsible meal kit tray 2600 (FIG. 26) constructed in accordance with another aspect of the current disclosure. The blank 2500 can comprise a bottom panel 2502 defining a first end 2504, a second end 2505, a third end 2506, and a fourth end 2507, the bottom panel 2502 configured to support the bottom 2105*a* (FIG. 23) of the bag 2105 (FIG. 21) comprising a portion of a meal kit 2104 (FIG. 21). As shown, the second end 2505 can be distal from the first end 2504, and the fourth end 2507 can be distal from the third end 2506. In some aspects, as shown, the bottom panel 2502 can define a rectangular shape. In other aspects, the bottom panel 2502 can define a non-rectangular shape such as polygonal shape with fewer than four or more than four sides or ends 2504, 2505, 2506, 2507 or even rounded shape. Adjacent ends such as the ends 2504, 2507, the ends 2507, 2506, the ends 2506, 2505, and the ends 2505, 2504 can intersect at corners of the bottom panel 2502. The bottom panel 2502 can further defines an upper surface 2502*a* and an opposed bottom surface 2502*b* (FIGS. 27 and 29) bounded by the ends 2504,2505,2506,2507.

A first side panel 2508 can extend outwardly from at least a portion of the third end 2506 of the bottom panel 2502. The first side panel 2508 can thereby be joined to the bottom panel 2502 along a fold line 2503*a* defining a joint between the bottom panel 2502 and the first side panel 2508. The first side panel 2508 can define a first end 2509, a second end 2510, a third end 2511, and a fourth end 2512. As shown, the second end 2510 can be distal from the first end 2509, and the fourth end 2512 can be distal from the third end 2511. In some aspects, as shown, the first side panel 2508 can define a rectangular shape. In other aspects, the first side panel 2508 can define a non-rectangular shape such as polygonal shape with fewer than four or more than four sides or ends 2509, 2510, 2511, 2512 or even a rounded shape. Adjacent ends such as the ends 2509, 2511, the ends 2511, 2510, the ends 2510, 2512, and the ends 2512, 2509, can intersect at corners of the first side panel 2508. The fold line 2503*a* may be interrupted by perforation line segments that each define standoffs 2570,2574 formed from the bottom panel 2502, the standoffs 2570,2574 extending laterally toward a first wing 2520 from the fold line 2503*a* and terminating in respective standoff edges 2571,2575. Each standoff 2570,2574 can be configured to separate from the first side panel 2508 as the first side panel 2508 is rotated upwardly about the fold line 2503*a* during assembly of the blank 2500 into the meal kit tray 2600.

A second side panel 2514 can extend outwardly from at least a portion of the fourth end 2507 of the bottom panel 2502. The second side panel 2514 can thereby be joined to the bottom panel 2502 along a fold line 2503*b* defining a joint between the panels 2502, 2514. The second side panel 2514 can define a first end 2515, a second end 2516, a third end 2517, and a fourth end 2518. As shown, the second end 2516 can be distal from the first end 2505, and the fourth end 2518 can be distal from the third end 2517. In some aspects, as shown, the first side panel 2508 can define a rectangular shape. In other aspects, the second side panel 2514 can define a non-rectangular shape such as polygonal shape with fewer than four or more than four sides or ends 2515, 2516, 2517, 2518 or even a rounded shape. Adjacent ends such as the ends 2515, 2517, the ends 2517, 2516, the ends 2516, 2518, and the ends 2518, 2515, can intersect at corners of the second side panel 2514. The fold line 2503*b* may be interrupted by perforation line segments that each define standoffs 2572,2576 formed from the bottom panel 2502, the standoffs 2572,2576 extending laterally toward the second wing 2526 from the fold line 2503*b* and terminating in respective standoff edges 2573,2577. Each standoff 2572, 2576 can be configured to separate from the second side panel 2514 as the second side panel 2514 is rotated upwardly about the fold line 2503*b* during assembly of the blank 2500 into the meal kit tray 2600.

Still referring to FIG. 25, the blank 2500 can further comprise the first wing 2520, which can extend outwardly from the third end 2511 of the first side panel 2508. The first wing 2520 can thereby be joined to the first side panel 2508 along a fold line 2503*c* defining a joint between the first side panel 2508 and the first wing 2520. The first wing 120 can define a front end 2521, a rear end 2522, a proximal end 2523, and a free end 2524. As shown, the rear end 2522 can be distal from the front end 2521, and the free end 2524 can be distal from the proximal end 2523. In some aspects, as shown, the first wing 2520 can define a rectangular shape and, in some aspects, a square shape. Adjacent ends 2524, 2522, the ends 2522, 2523, and the ends 2523, 2521 can intersect at corners of the first wing 2520. FIG. 25 also shows that the free end 2524 of the first wing 2520 can define a first chamfered portion 2524*a* and a second chamfered portion 2524*b*, each chamfered portion 2524*a,b* configured to facilitate insertion of the meal kit tray 2600 (FIGS. 26-29) into an outer box such as the outer box 2102 of FIG. 21.

A second wing 2526 can extend outwardly from the fourth end 2518 of the second side panel 2514. The second wing 2520 can thereby be joined to the second side panel 2514 along a fold line 2503*d* defining a joint between the second side panel 2514 and the second wing 2526. The second wing 2526 can define a front end 2527, a rear end 2528, a proximal end 2529, and a free end 2530. As shown, the rear end 2528 can be distal from the front end 2527, and the free end 2530 can be distal from the proximal end 2529. In some aspects, as shown, the second wing 2526 can define a rectangular shape and, in some aspects, a square shape. Adjacent ends 2527, 2529, the ends 2529, 2528, and the ends 2530, 2527, can intersect at corners of the second wing 2526. FIG. 25 also shows that the free end 2530 of the second wing 2526 can define a first chamfered portion 2530*a* and a second chamfered portion 2530*b*, each chamfered portion 2530*a,b* configured to facilitate insertion of the meal kit tray 2600 (FIGS. 26-29) into an outer box such as the outer box 2102 of FIG. 21.

Figure 28:
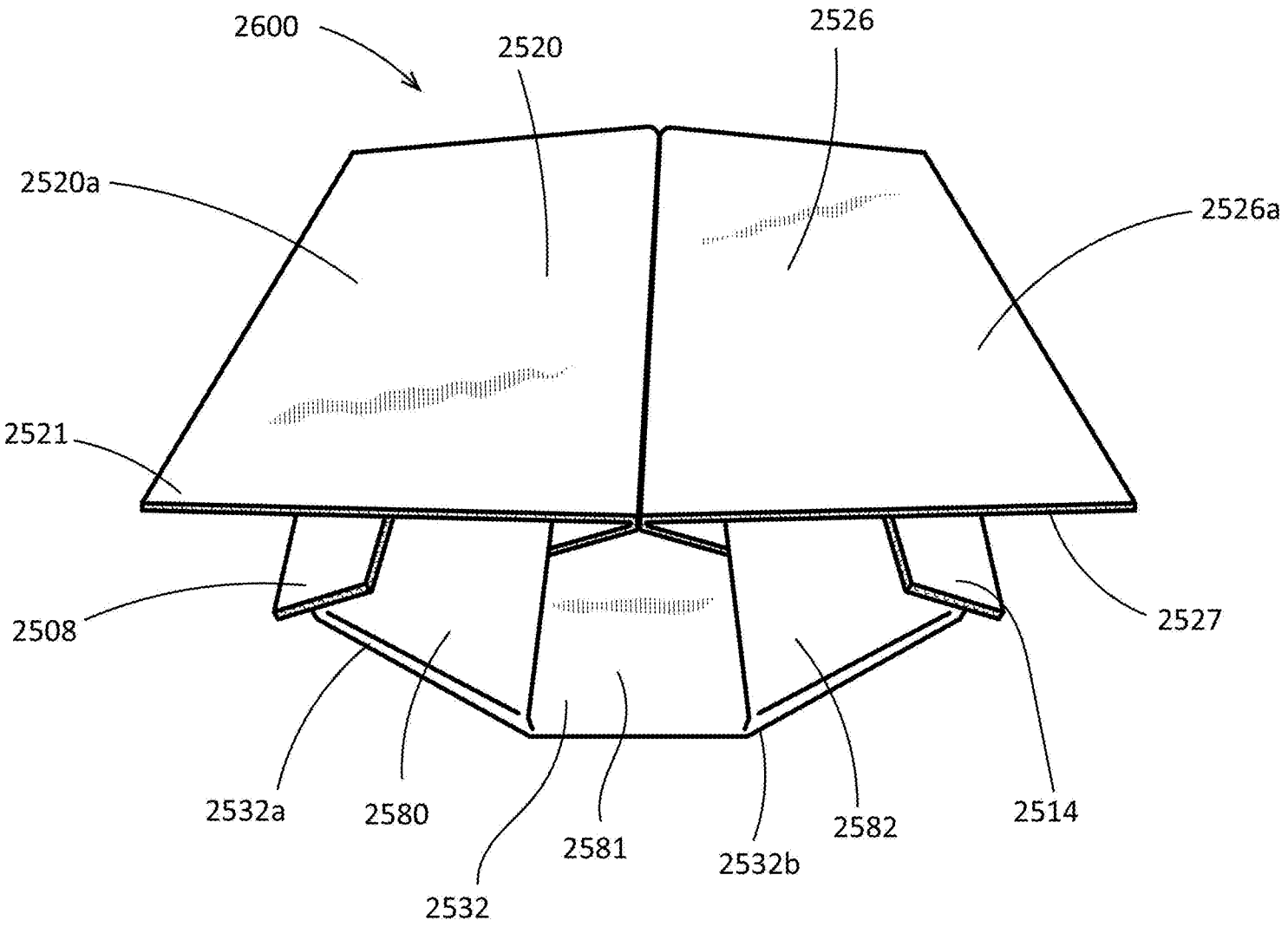
FIG. 28 is a perspective view of the collapsible meal kit tray formed from the blank of FIG. 25, the meal kit tray shown in a collapsed state.
Figure 29:
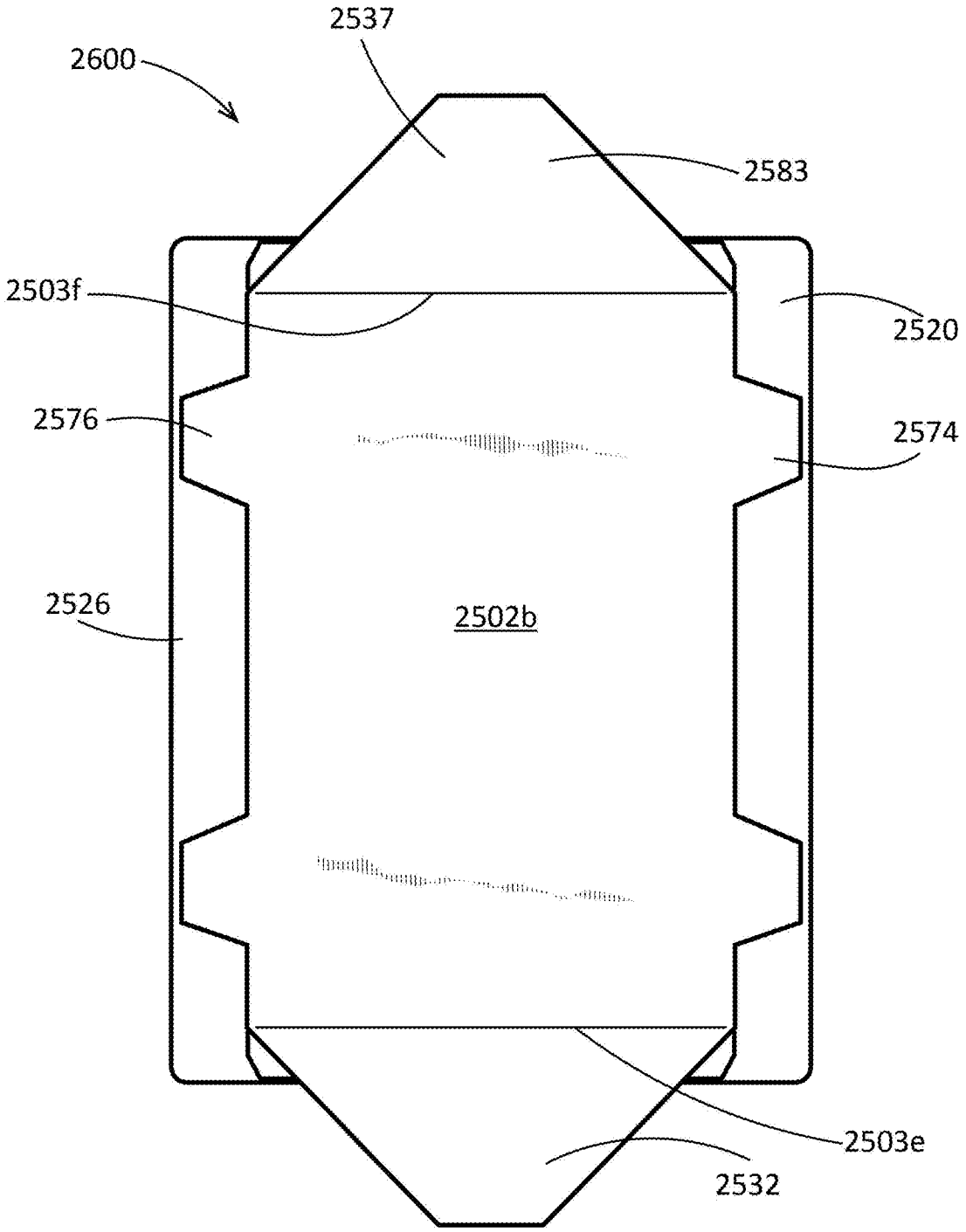
FIG. 29 is a bottom view of the collapsed meal kit tray illustrated in FIG. 28.

Still referring to FIG. 25, the blank 2500 may further comprise a front end panel 2532 extending forward from the first end 2504 of the bottom panel 2502. The front end panel 2532 can thereby be joined to the bottom panel 2502 along a fold line 2503*e* defining a joint between the bottom panel 2502 and the front end panel 2532. The front end panel 2532 can define a first end 2531, a second end 2533, a third end 2535, and a fourth end 2536. As shown, the second end 2533 can be distal from the first end 2531, and the fourth end 2536 can be distal from the third end 2535. In some aspects, as shown, the front end panel 2532 can define a rectangular shape. In other aspects, the front end panel 2532 can define a non-rectangular shape such as polygonal shape with fewer than four or more than four sides or ends 2531,2533,2535, 2536 or even a rounded shape. Adjacent ends such as the ends 2531,2535, the ends 2535,2533, the ends 2533,2536, and the ends 2536,2531, can intersect at corners of the front end panel 2532. A first transverse fold line 2532*a* can extend across the front end panel 2532, the first transverse fold line 2532*a* extending to the second end 2533 of the front end panel 2532 from a first corner formed by the intersection of adjacent ends 2536,2531. A second transverse fold line 2532*b* can extend across the front end panel 2532, the second transverse fold line 2532*b* extending to the second end 2533 of the front end panel 2532 from a second corner formed by the intersection of adjacent ends 2531,2535. The transverse fold lines 2532*a,b* can subdivide the front end panel 2532 into a primary section 2581, a first secondary section 2580, and a second secondary section 2582. The transverse fold lines 2532*a,b* can be configured to permit a folding of the secondary sections 2580,2582 atop the primary section 2581 when the meal kit tray 2600 formed from the blank 2500 changes from an assembled state (FIGS. 26-2729) to a collapsed state (FIGS. 28-29).

The blank 2500 may further comprise a rear end panel 2537 extending rearwardly from the second end 2505 of the bottom panel 2502. The rear end panel 2537 can thereby be joined to the bottom panel 2502 along a fold line 2503*f* defining a joint between the bottom panel 2502 and the rear end panel 2537. The rear end panel 2537 can define a first end 2538, a second end 2539, a third end 2540, and a fourth end 2548. As shown, the second end 2539 can be distal from the first end 2538, and the fourth end 2548 can be distal from the third end 2540. In some aspects, as shown, the rear end panel 2537 can define a rectangular shape. In other aspects, the rear end panel 2537 can define a non-rectangular shape such as polygonal shape with fewer than four or more than four sides or ends 2538,2539,2540,2548 or even a rounded shape. Adjacent ends such as the ends 2538,2540, the ends 2540,2539, the ends 2539,2548, and the ends 2548,2538, can intersect at corners of the rear end panel 2537. A third transverse fold line 2537*a* can extend across the rear end panel 2537, the third transverse fold line 2537*a* extending to the second end 2539 of the rear end panel 2537 from a first corner formed by the intersection of adjacent ends 2538, 2540. A fourth transverse fold line 2537*b* can extend across the rear end panel 2537, the fourth transverse fold line 2537*b* extending to the second end 2539 of the rear end panel 2537 from a second corner formed by the intersection of adjacent ends 2538,2548. The transverse fold lines 2537*a,b* can subdivide the rear end panel 2537 into a primary section 2583, a first secondary section 2584, and a second secondary section 2586. The transverse fold lines 2537*a,b* can be configured to permit a folding of the secondary sections 2584,2586 atop the primary section 2583 when the meal kit tray 2600 formed from the blank 2500 changes from an assembled state (FIGS. 26-27) to a collapsed state (FIGS. 28-29).

Still referring to FIG. 25, the blank 2500 may further comprise a first reinforcement panel 2541 extending from the fourth end 2536 of the front end panel 2532, a second reinforcement panel 2542 extending from the third end 2536 of the front end panel 2532, a third reinforcement panel 2543 extending from the third end 2540 of the rear end panel 2537, and a fourth reinforcement panel 2544 extending from the fourth end 2548 of the rear end panel 2537. The first reinforcement panel 2541 can thereby be joined to the front end panel 2532 along a fold line 2503*g* defining a joint between the panels 2532,2541; the second reinforcement panel 2542 can thereby be joined to the front end panel 2532 along a fold line 2503*h* defining a joint between the panels 2532,2542; the third reinforcement panel 2543 can thereby be joined to the rear end panel 2357 along a fold line 2503*i* defining a joint between the panels 2537,2543; and the fourth reinforcement panel 2544 can thereby be joined to the rear end panel 2537 along a fold line 2503*j* defining a joint between the panels 2537,2544.

The first reinforcement panel 2541 can define a proximal end 2545, a distal end 2554, a top end 2553, and a separable end 2552. As shown, the distal end 2554 can be distal from the proximal end 2545, and the top end 2553 can be distal from the separable end 2540. In some aspects, as shown, the first reinforcement panel 2541 can define a rectangular shape. In other aspects, the first reinforcement panel 2541 can define a non-rectangular shape such as polygonal shape with fewer than four or more than four sides or ends 2545,2554,2553,2552 or even a rounded shape. Adjacent ends such as the ends 2545,2553, the ends 2553, 2554, the ends 2554,2552, and the ends 2552,2545, can intersect at corners of the first reinforcement panel 2541. The separable end 2552 can be joined to at least a portion of the first end 2509 of the first side panel 2508 along a first perforation line segment. At least a portion of the first perforation line segment can outline a first front tab 2546 extending forward from the first end 2509 of the first side panel 2508. The first perforation line segment is configured to facilitate separation of the first reinforcement panel 2541 from the first side panel 2508 when the blank 2500 is assembled into the meal kit tray 2600 (FIGS. 26-29), so as to form the first front tab 2546 when the first reinforcement panel 2541 is separated from the first side panel 2508. The first front tab 2546 can define a leading edge 2546*a* formed from panel separation along the first perforation line segment, the leading edge 2546*a* configured to engage the inside wall 2107*a* of the front end 2107 of the outer box 2102 (FIGS. 21, 23, and 24) when the meal kit tray 2600 (FIGS. 26-29) is inserted into the outer box 2102.

The second reinforcement panel 2542 can define a proximal end 2558, a distal end 2557, a top end 2556, and a separable end 2555. As shown, the distal end 2557 can be distal from the proximal end 2558, and the top end 2556 can be distal from the separable end 2555. In some aspects, as shown, the second reinforcement panel 2542 can define a rectangular shape. In other aspects, the second reinforcement panel 2542 can define a non-rectangular shape such as polygonal shape with fewer than four or more than four sides or ends 2555-58 or even a rounded shape. Adjacent ends such as the ends 2558,2556, the ends 2556, 2557, the ends 2557,2555, and the ends 2555,2558, can intersect at corners of the second reinforcement panel 2542. The separable end 2555 can be joined to at least a portion of the first end 2515 of the second side panel 2514 along a second perforation line segment. At least a portion of the second perforation line segment can outline a second front tab 2547 extending forward from the first end 2515 of the second side panel 2514. The second perforation line segment can be configured to facilitate separation of the second reinforcement panel 2542 from the second side panel 2514 when the blank 2500 is assembled into the meal kit tray 2600 (FIGS. 26-29), so as to form the second front tab 2547 when the second reinforcement panel 2542 is separated from the second side panel 2514. The second front tab 2547 can define a leading edge 2547*a* formed from panel separation along the second perforation line segment, the leading edge 2546*a* configured to engage the inside wall 2107*a* of the front end 2107 of the outer box 2102 (FIGS. 21, 23, and 24) when the meal kit tray 2600 (FIGS. 26-29) is inserted into the outer box 2102.

The third reinforcement panel 2543 can define a proximal end 2562, a distal end 2561, a top end 2560, and a separable end 2559. As shown, the distal end 2561 can be distal from the proximal end 2562, and the top end 2560 can be distal from the separable end 2559. In some aspects, as shown, the third reinforcement panel 2543 can define a rectangular shape. In other aspects, the third reinforcement panel 2531 can define a non-rectangular shape such as polygonal shape with fewer than four or more than four sides or ends 2559-62 or even a rounded shape. Adjacent ends such as the ends 2562,2560, the ends 2560, 2561, the ends 2561,2559, and the ends 2559,2562, can intersect at corners of the third reinforcement panel 2543. The separable end 2559 can be joined to at least a portion of the second end 2510 of the first side panel 2508 along a third perforation line segment. At least a portion of the third perforation line segment can outline a first rear tab 2549 extending rearwardly from the second end 2510 of the first side panel 2508. The third perforation line segment can be configured to facilitate separation of the third reinforcement panel 2543 from the first side panel 2508 when the blank 2500 is assembled into the meal kit tray 2600 (FIGS. 26-29), so as to form the first rear tab 2549 when the third reinforcement panel 2543 is separated from the first side panel 2508. The first rear tab 2549 can define a leading edge 2549*a* formed from panel separation along the third perforation line segment, the leading edge 2549*a* configured to engage the inside wall 2109*a* of the rear end 2109 of the outer box 2102 (FIGS. 21, 23, 24) when the meal kit tray 2600 (FIGS. 26-29) is inserted into the outer box 2102.

The fourth reinforcement panel 2544 can define a proximal end 2566, a distal end 2565, a top end 2564, and a separable end 2563. As shown, the distal end 2565 can be distal from the proximal end 2566, and the top end 2564 can be distal from the separable end 2563. In some aspects, as shown, the fourth reinforcement panel 2544 can define a rectangular shape. In other aspects, the fourth reinforcement panel 2544 can define a non-rectangular shape such as polygonal shape with fewer than four or more than four sides or ends 2563-66 or even a rounded shape. Adjacent ends such as the ends 2566,2564, the ends 2564, 2565, the ends 2565,2563, and the ends 2563,2566, can intersect at corners of the fourth reinforcement panel 2544. The separable end 2563 can be joined to at least a portion of the second end 2516 of the second side panel 2514 along a fourth perforation line segment. At least a portion of the fourth perforation line segment can outline a second rear tab 2550 extending forward from the second end 2516 of the second side panel 2514. The fourth perforation line segment can be configured to facilitate separation of the fourth reinforcement panel 2544 from the second side panel 2514 when the blank 2500 is assembled into the meal kit tray 2600 (FIGS. 26-29), so as to form the second rear tab 2550 when the fourth reinforcement panel 2544 is separated from the second side panel 2514. The second rear tab 2549 can define a leading edge 2549*a* formed from panel separation along the fourth perforation line segment, the leading edge 2549*a* configured to engage the inside wall 2109*a* of the rear end 2109 of the outer box 2102 (FIGS. 21, 23, and 24) when the meal kit tray 2600 (FIGS. 26-29) is inserted into the outer box 2102.

During assembly of the blank 2500 into the meal kit tray 2600, each of the reinforcement panels 2541-44 can be joined to the side panels 2508,2514 by any suitable means such as with an adhesive. In particular, the first side panel 2508 can define a first side panel outer surface 2508*a* bounded by the first side panel ends 2504,2505,2506,2507, and the second side panel 2514 can define a second side panel outer surface 2514*a* bounded by the second side panel ends 2515,2516,2517,2518. A first adhesive region 2501*a* may be applied onto the first side panel outer surface 2508*a* proximate the first end 2509 of the first side panel 2508. A second adhesive region 2501*b* may be applied onto the first side panel outer surface 2508*a* proximate the second end 2510 of the first side panel 2508. A third adhesive region 2501*c* may be applied onto the second side panel outer surface 2514*a* proximate the first end 2515 of the second side panel 2514. A fourth adhesive region 2501*d* may be applied onto the second side panel outer surface 2514*a* proximate the second end 2516 of the second side panel 2514.

Figure 26:
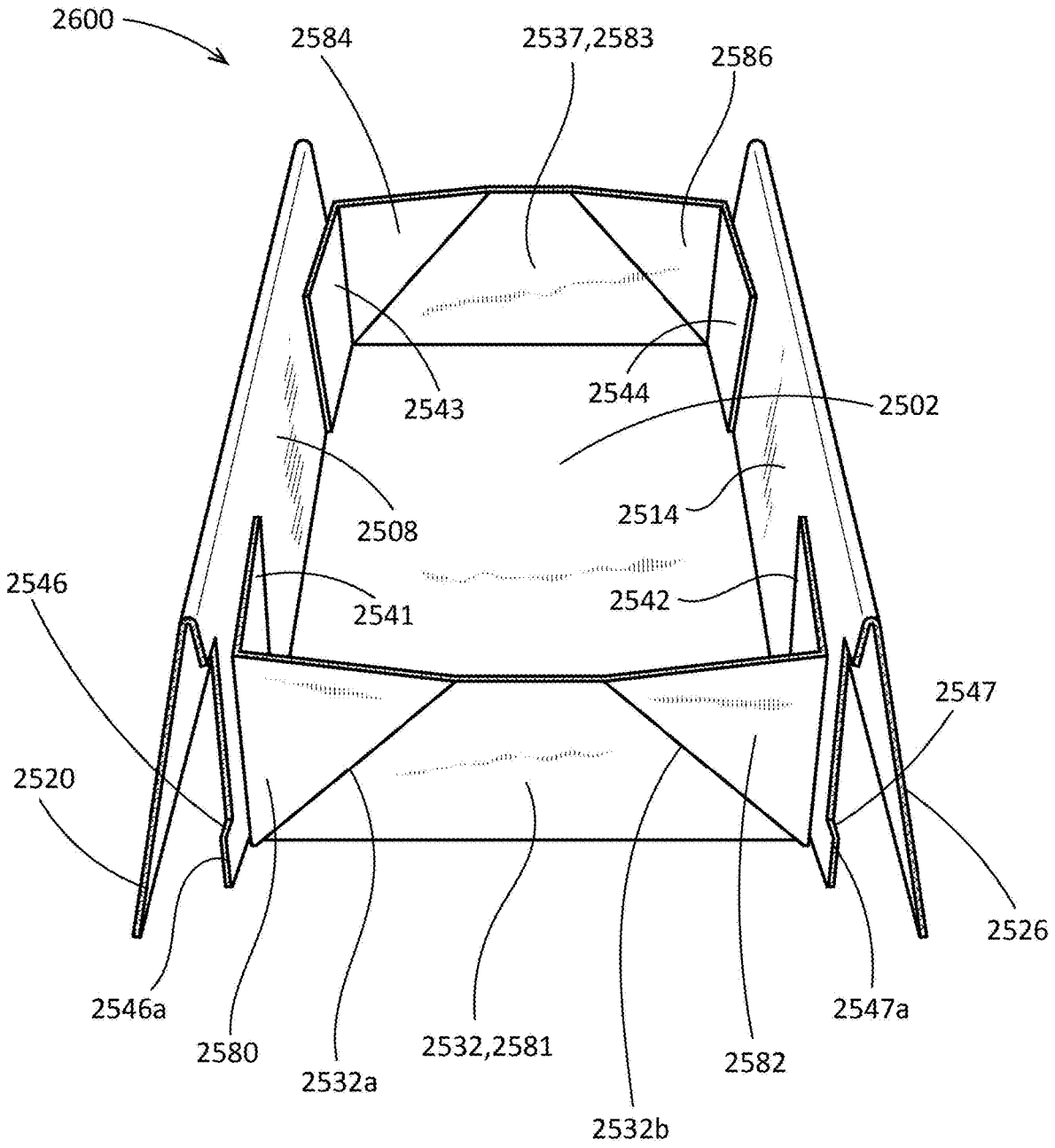
FIG. 26 is a top perspective view of a collapsible meal kit tray formed from the blank of FIG. 25, the meal kit tray shown in an assembled state.
Figure 27:
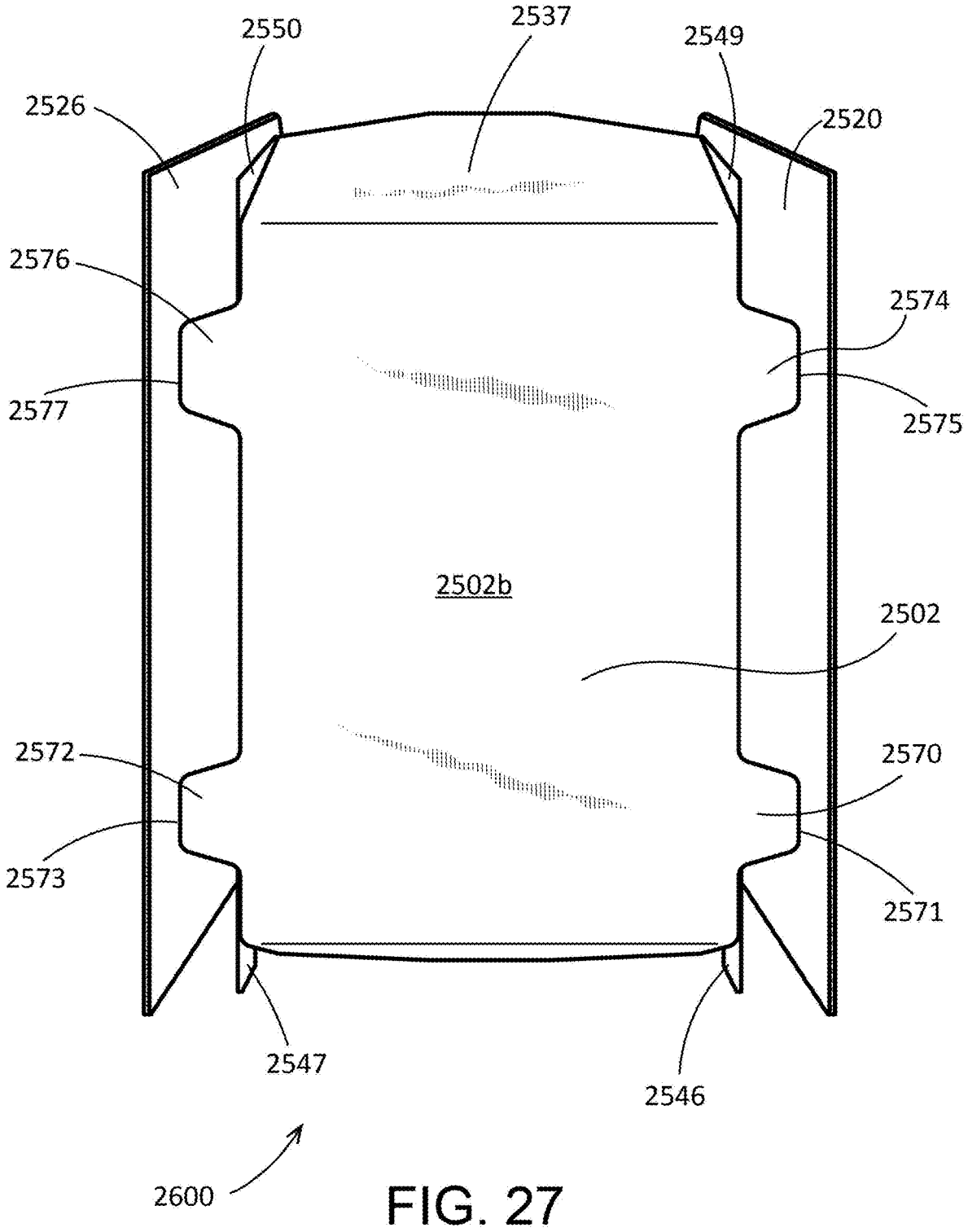
FIG. 27 is a bottom perspective view of the assembled meal kit tray illustrated in FIG. 26.

FIGS. 26-29 illustrate a collapsible meal kit tray 2600 formed from the blank 2500 (FIG. 25), showing the tray 2600 in both an assembled state (FIGS. 26-27) and a collapsed state (FIGS. 28-29). The meal kit tray 2600 may be assembled from the blank 2500 by first rotating the reinforcement panels 2541,2542 inwardly about their respective fold lines 2503*g,h* (FIG. 25) toward the front end panel 2532, and by rotating the reinforcement panels 2543, 2544 inwardly about their respective fold lines 2503*i,j* (FIG. 25) toward the rear end panel 2537. Once the reinforcement panels 2541-44 are positioned at approximate right angles with respect to their respective end panels 2532,2537, the end panels 2532,2537 can be rotated upwardly about their respective fold lines 2503*e,f* (FIG. 25) until each end panel 2532,2537 is oriented at an approximate right angle to the bottom panel 2502. Preferably, the combination of the aforementioned reinforcement panel rotations and the end panel rotations separate the first side panel 2508 from the reinforcement panels 2541,2543, thereby forming the first front tab 2546 and first rear tab 2549 (FIG. 27), and separate the second side panel 2514 from the reinforcement panels 2542,2544, thereby forming the second front tab 2547 and second rear tab 2550 (FIG. 27). However, it is contemplated that these separations could be attained from only the reinforcement panel rotations or only the end panel rotations. The side panels 2508,2514 can then be rotated upwardly about their respective fold lines 2503*a,b* (FIG. 25) until each side panel 2508,2514 can be oriented at an approximate right angle to the bottom panel 2502. This side panel rotation can cause the standoffs 2570,2574 (FIG. 27) to separate from the first side panel 2508, and causes the standoffs 2572,2576 (FIG. 27) to separate from the second side panel 2514. Outer surfaces of the reinforcement panels 2541-44, namely, the surfaces of those panels opposite the surfaces visible in the drawing sheet of FIG. 25, are then brought into contact with their corresponding adhesive regions 2501*a-d* (FIG. 25), thereby joining the reinforcement panels 2541-44 to their respective side panels 2508, 2514. In particular, this assembly step can join the reinforcement panels 2541,543 to the first side panel 2508, and can join the reinforcement panels 2542,2544 to the second side panel 2514. Next, the wings 2520,2526 can be rotated downwardly about their respective fold lines 2503*c,d* (FIG. 25) until they contact respective standoffs 2570,2572,2574, 2576 in the manner described below with regard to FIG. 27. The wings 2520,2526 can assume the angular orientations shown in FIG. 26, which may resemble the angular orientations previously described with respect to the meal kit tray 1000 (FIG. 9). The aforementioned steps to assemble the meal kit tray 2600 need not be performed in the exact sequence described above, so long as the steps still result in the transition of blank 2500 to the meal kit tray exemplified at 2600.

FIGS. 26 and 27 illustrate the meal kit tray 2600 in an assembled state. FIG. 27 clearly shows the bottom surface 2502*b* of the bottom panel 2502, and also clearly shows all four standoffs 2570,2572,2574,2576 and their respective standoff edges 2571,2573,2575,2577. In the assembled state, the standoffs 2570,2572,2574,2576 can center the meal kit tray 2600 and the bag 2105 (FIG. 21) inside the outer box 2102 (FIG. 21) to create air space around the meal kit 2104 (FIG. 21). To achieve such centering, the standoffs 2570, 2572,2574,2576 may all be sized identically to one another. In FIG. 27, the standoff edges 2571,2575 can contact a surface of the first wing 2520, and the standoff edges 2573,2577 contact a surface of the second wing 2526.

FIGS. 28 and 29 illustrate the meal kit tray 2600 in a collapsed state. The meal kit tray 2600 can be collapsed from its assembled state by causing each of the secondary sections 2580,2582 (2580 shown in FIG. 25) of the end panels 2532,2537 (2537 shown in FIG. 29) to be folded atop their corresponding end panel primary sections 2581,2583 (2583 shown in FIG. 29, as depicted in FIG. 28. In particular, each side panel 2508,2514 can be rotated inwardly (toward the upper surface 2502*a* of the bottom panel 2502, shown in FIG. 25) about their respective fold lines 2503*a,b* (FIG. 25). Since the reinforcement panels 2541-44 (FIG. 25) are respectively joined at their surfaces to the side panels 2508,2514 as described above, and also to respective end panels 2532,2537 at respective fold lines as also described above, the inward rotation of the side panels 2508,2514 pushes the end panels 2532,2537 such that they each rotate downwardly about their respective fold lines 2503*e,f* (FIG. 29). As the front end panel 2532 is rotated downwardly, the secondary sections 2580,2582 can be folded inwardly about their respective transverse fold lines 2532*a,b* until each secondary section 2580,2582 is positioned atop the primary section 2581 of the front end panel 2532. Similarly (though not visible from the perspective of FIG. 28), as the rear end panel 2537 (FIG. 29) is rotated downwardly, the secondary sections 2584,2586 (FIG. 25) can be folded inwardly about their respective transverse fold lines 2537*a,b* (FIG. 25) until each secondary section 2584,2586 is positioned atop the primary section 2583 (FIG. 29) of the rear end panel 2537. Further collapsing occurs when the wings 2520,2526 can then folded downwardly about their respective fold lines 2503*c,d* (FIG. 25) until a surface of the first wing 2520 (the surface opposite an outer surface 2520*a*) contacts an outer surface of the first side panel 2508, and a surface of the second wing 2526 (the surface opposite an outer surface 2526*a*) contacts an outer surface of the second side panel 2514. In the fully collapsed position of FIG. 28, the respective outer surfaces 2520*a*,2526*a* of the wings 2520,2526 can point substantially upwardly, such that the front end 2521 of the first wing 2520 and the front end 2527 of the second wing 2526 can both become oriented substantially horizontally. This collapsing can advantageously allows the meal kit tray 2600 to compress to a minimal size for storage and transport. Yet the meal kit tray 2600 can also be easily opened from a collapsed state, for ease of use and loading, by reversing the aforementioned collapsing steps.

In some aspects, any of the panels of the blank 2500 (FIG. 25) and the meal kit tray 2600 (FIGS. 26-29) that are described as being rectangular can be substantially rectangular (i.e., rectangular in shape minus any notches, chamfers, or other edge treatments). In some aspects, any of the panels of the blank 2500 and the meal kit tray 2600 that are described as being or defining some non-rectangular shape can be substantially that shape (i.e., that shape minus any notches, chamfers, or other edge treatments).

The meal kit trays, exemplified at 1000,2000,2600, are preferably comprised entirely of curbside recyclable material, such as double-layered recyclable corrugated cardboard or Kraft paper, to provide added strength for transport and advantageous insulation properties. Bag 2105 is also preferably comprised of a curbside recyclable material. Alternatively, the meal kit trays 1000,2000,2600 can be constructed entirely of repulpable material, or comprised of some elements that are comprised of curbside recyclable material and some other elements that are comprised of repulpable material.

Components of the blanks 100, 1200,2500 or the meal kit trays 1000,2000,2600 and their arrangement, can comprise both functional and aesthetic elements, and any feature described as having functional aspects can have or define any one of several aesthetic designs without altering the respective parts' functions. If aesthetic elements are shown in the drawings or possibly fall within the scope of broader claim elements without being directly claimed, such disclosure or claims should not be interpreted as assigning any function to such aesthetic elements which may therefore be separately protectable.

Figure 30:
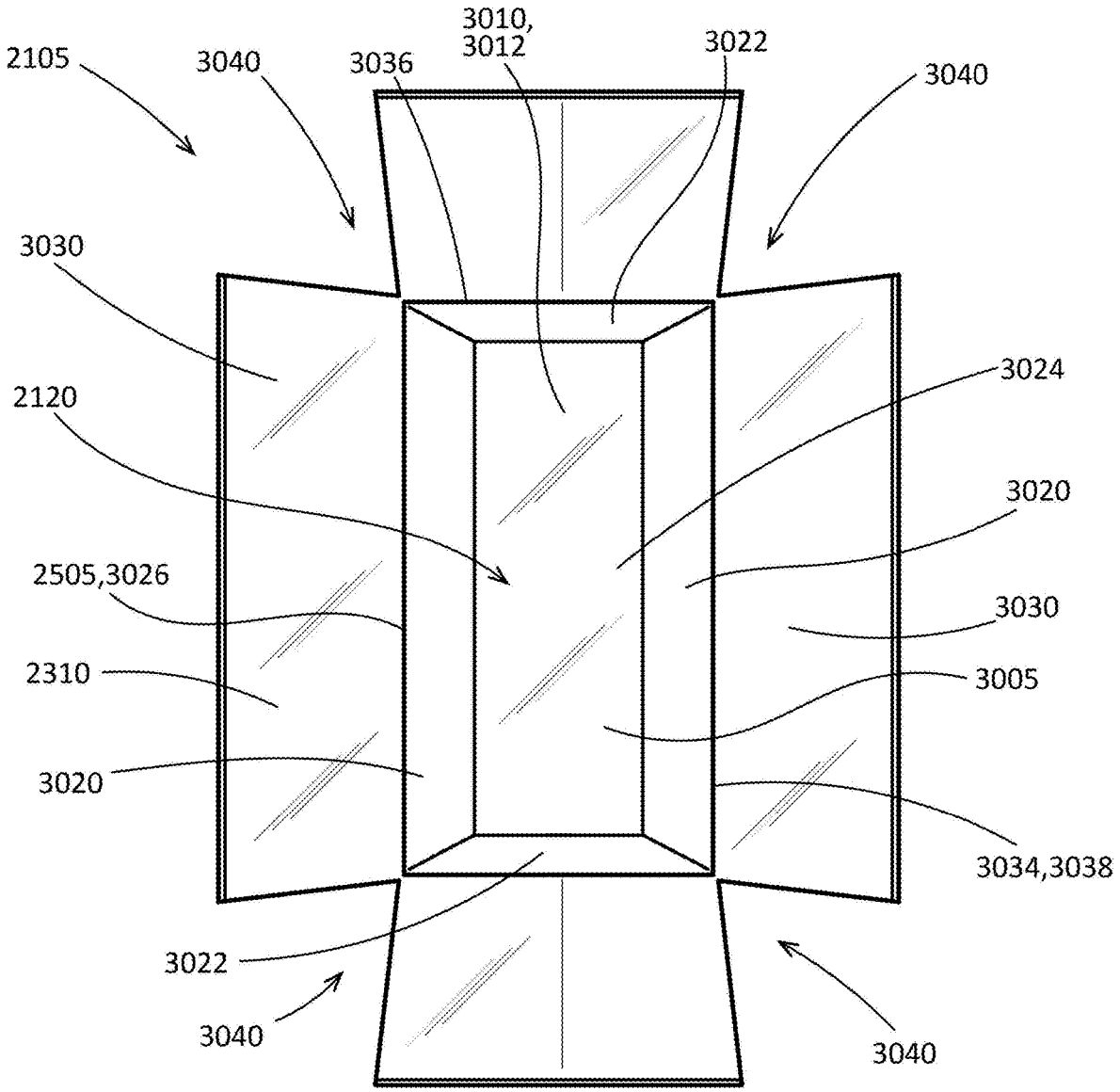
FIG. 30 is a top view of the meal kit bag in an open orientation, in accordance with another aspect of the present disclosure.
Figure 31:
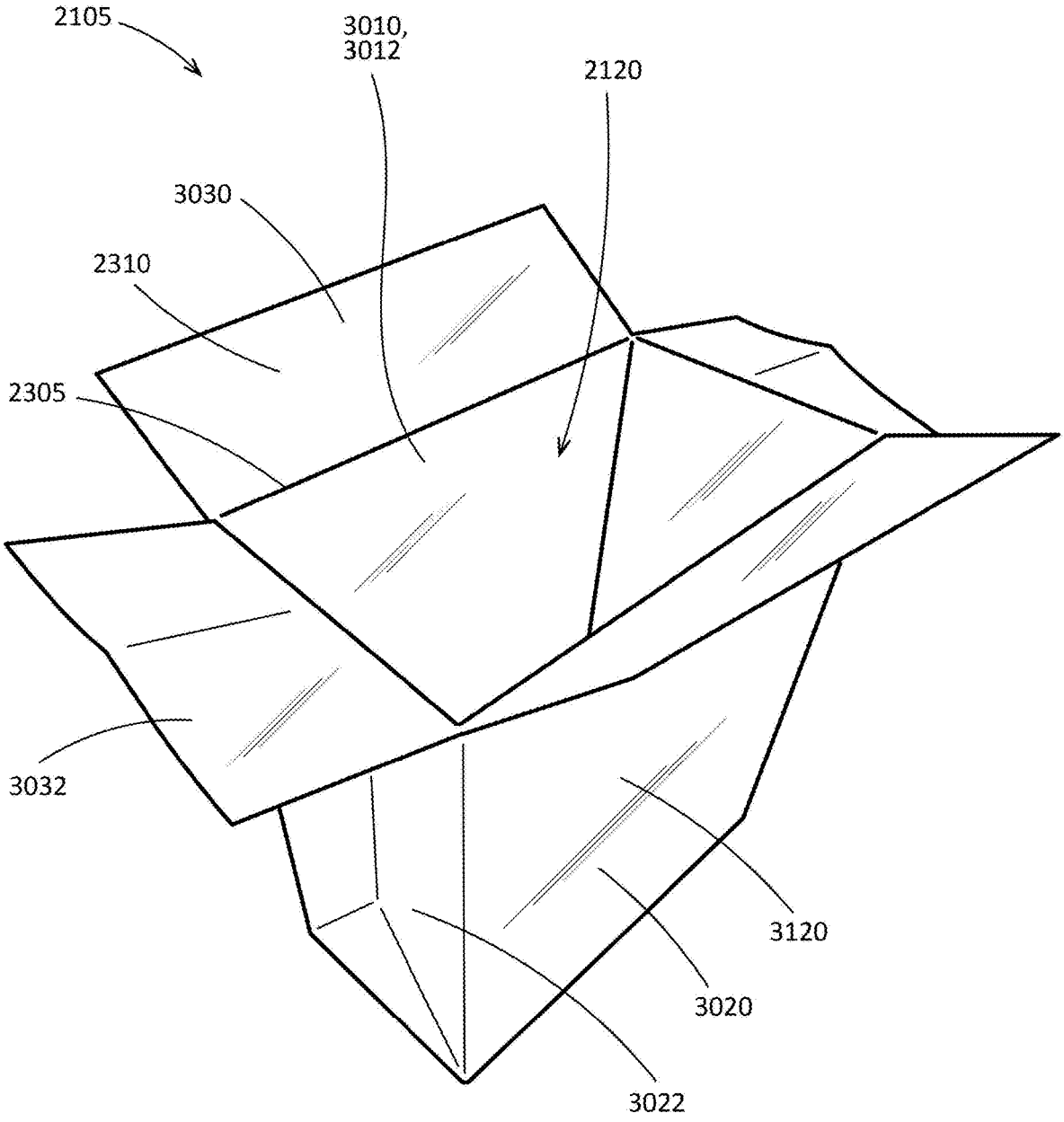
FIG. 31 is a top perspective view of the meal kit bag of FIG. 30 in the open orientation, the meal kit bag comprising a film.

FIGS. 30-34 illustrate another example aspect of the bag 2105 comprising the temperature-preserving liner 3010. The temperature-preserving liner 3010 can also be applied to any of the previously described bags 2105. Referring to FIGS. 30 and 31, the bag 2105 can define a pair of opposing main panels 3020 and a pair of opposing side panels 3022. The pair of opposing side panels 3022 and the pair of opposing main panels 3020 can define the top bag end 2305 and a bottom bag end 3005 of the bag 2105. The bag 2105 can further comprise the bottom panel 3024 (similar to the bottom 2105*a*, shown in FIG. 23) disposed at the bottom bag end 3005 thereof. The opposing side panels 3022, the pair of opposing main panels 3020, and the bottom panel 3024 can at least partially define the interior cavity 2120 of the bag 2105, into which various contents (such as the first cold pack 2106, the second cold pack 2108, the food item 2110, and the insulation panel 2119, all shown in FIG. 21) can be inserted.

Figure 32:
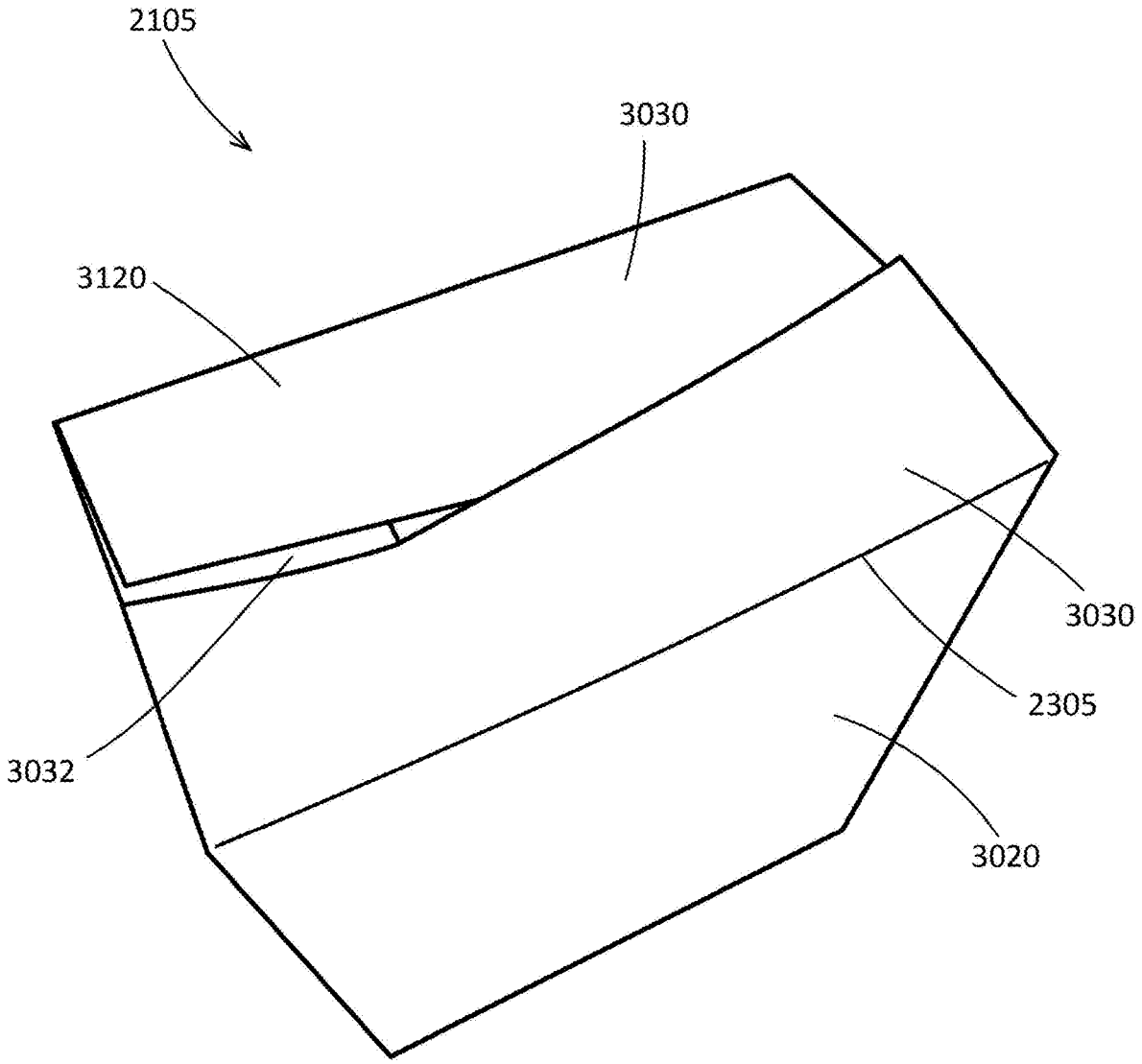
FIG. 32 is a top perspective view of the meal kit bag of FIG. 30 in a closed orientation.

The upper bag portion 2310 of the bag 2105 can extend from the opposing side panels 3022 and the opposing main panels 3020 at the top bag end 2305 of the bag 2105. Furthermore, a cavity opening 3026 allowing access to the interior cavity 2120 can be defined at the top bag end 2305 of the bag 2105. The bag 2105 can be configured in an open orientation, as shown in FIGS. 30, 31, 33, and 34, and a closed orientation, as shown in FIG. 32. In the open orientation, the cavity opening 3026 can be uncovered to allow for the insertion of the contents into or removal of the contents from the interior cavity 2120. In the closed orientation, the cavity opening 3026 can be covered by the upper bag portion 2310 for retaining the contents in the interior cavity 2120.

The bag 2105 can comprise a base layer 3120 (shown in FIG. 31) and the temperature-preserving liner 3010. The temperature-preserving liner 3010 can be formed as a film 3012 in the present aspect. Example aspects of a similar bag 2105 comprising such a film 3012 are disclosed in U.S. Provisional Application No. 63/462,800, filed on Apr. 28, 2023, which is incorporated by reference in its entirety herein. In example aspects, the base layer 3120 can comprise one or more paper layers. The film 3012 can be applied to the base layer 3120 and can define the interior cavity 2120 of the bag 2105, as shown. Example aspects of the film 3012 can comprise at least a reflective layer. Some aspects of the film 3012 can further comprise a protective layer positioned over the reflective layer. The reflective layer can comprise a thermally treated material. In some aspects, the protective layer can comprise an FDA-certified material. The FDA-certified protective layer can be the innermost layer of the bag 2105 and can define the interior cavity 2120. It can thus be safe for the inside of the bag 2105 to contact the contents received within the interior cavity 2120. The reflective layer can be disposed between the protective layer and the base layer 3120. The film 3102 and specifically the reflective layer, can have low emissivity and high reflectivity to improve the insulation of the bag 2105.

In some example aspects, the bag 2105 can further comprise one or more intermediate layers disposed between the base layer 3120 and the film 3102. In the present aspect, the intermediate layer can be a treated substrate layer, which can comprise a polyester film in some aspects. In other aspects, the treated substrate layer can comprise a starch-based film, such as a plant-based starch film, or any other suitable material known in the art. The reflective layer of the film 3012 can be disposed between the intermediate layer and the protective layer, and either or both of the intermediate layer and the protective layer can be configured to protect the reflective layer from various factors, such as from oxidation or mechanical abrasion for example and without limitation, that might degrade the emissivity of the reflective layer.

The bag 2105 can provide various benefits. For example, the bag 2105 can be water-resistant or water-proof in some aspects, which can improve the performance of the bag 2105 in wet weather conditions, such as humidity, rain, or snow, and/or if condensation or a leak should occur within the interior cavity 2120 of the bag 2105. In some aspects, the film 3012 can be substantially water-resistant and/or the paper base layer 3120 can be treated to be substantially water-resistant. The bag 2105 furthermore can optionally be provided with a coolant disposed within the interior cavity 2120 to further improve the refrigeration of the bag 2105. That is, a coolant, such as dry ice, a frozen ice pack, or a frozen gel pack for example and without limitation, can optionally be provided within the interior cavity 2120 to decrease the temperature within the interior cavity 2120 and/or to prolong the refrigeration of the contents therein. For example, the first cold pack 2106 and/or the second cold pack 2108 (both shown in FIG. 21) can be provided as the coolant. In some aspects, the bag 2105 can perform suitably (e.g., stay below 63° within the interior cavity 2120) in high temperature conditions (e.g., around about) 90° for up to or beyond about 7 hours without a coolant, and up to or beyond about 12 hours with a coolant.

Another advantage of the bag 2105 is that it can be entirely recyclable, including the film 3012 and the insulation panel 2119 (shown in FIG. 21), and a recipient of the bag 2105 can easily recycle the bag 2105 via standard curbside pickup. In some aspects, the paper material of the bag 2105 (e.g., the paper base layer 3120 and the insulation panel 2119 or portions thereof) can be made from 100% recycled paper material. The bag 2105 can also be repulpable in example aspects. That is, the bag 2105 can be converted back into paper pulp after recycling and then formed as a new paper product, with any non-paper materials of the bag 2105 being filtered out in the repulping process. Furthermore, the paper base layer 3120 can be easily customized with unique branding. The base layer 3120 can provide a substantially blank canvas on which custom indicia can be printed or otherwise applied (such as by adhesive labels or the like).

Additionally, the multiple layers of the bag 2105, as well as the optionally-provided the insulation panel 2119, can increase the strength and structural durability of the bag 2105 to better support heavy contents therein. For example, in some aspects, the bag 2105 can support up to or beyond about 25 lbs. of food items or other contents. The one-piece design of the bag 2105 can simplify the manufacturing process and the use of the bag 2105. For example, the bag 2105 can be manufactured as a singular blank, and can simply be folded and sealed in the bag configuration shown. The bag 2105 is then ready for use by merely opening the bag 2105 and inserting the contents into the interior cavity 2120. Furthermore, the bag 2105 can stand upright on its own to streamline setting up the bag 2105 and loading the contents therein. The bag 2105 can also be lightweight, can be easy to handle, and can have a small footprint. The bag 2105 can be folded flat for efficient storage and shipping and can take up minimal space at an assembly station or register counter.

In some aspects, as shown in FIG. 23, the upper bag portion 2310 of the bag 2105 can be cinched and folded over one of the opposing main panels 3020 or opposing side panels 3022 to enclose the interior cavity 2120 at the top bag end 2305. In the present aspect, the upper bag portion 2310 can define a pair of opposing main top flaps 3030 and a pair of opposing side top flaps 3032. Each of the main top flaps 3030 can be hingedly connected to a corresponding one of the main panels 3020 at a main top hinge 3034 at the top bag end 2305 of the bag 2105, and each of the side top flaps 3032 can be hingedly connected to a corresponding one of the side panels 3022 at a side top hinge 3036 at the top bag end 2305 of the bag 2105. The main top hinges 3034 and the side top hinges 3036 at the top bag end 2305 of the bag 2105 can define a maximum fill line 3038 of the bag 2105, indicating a height to which the bag 2105 can be filled with contents. A top slit 3040 can be defined between each adjacent pair of the side top flaps 3032 and the main top flaps 3030.

In the present aspect, the temperature-preserving liner 3010 can be applied to each of the side panels 3022, the main panels 3020, the side top flaps 3032, the main top flaps 3030, and the bottom panel 3024. In other aspects, the temperature-preserving liner 3010 may not be applied to all of the side panels 3022, the main panels 3020, the side top flaps 3032, the main top flaps 3030, and the bottom panel 3024. According to example aspects, as shown in FIG. 32, the side top flaps 3032 can be folded towards one another and the main top flaps 3030 can be folded towards one another to cover the cavity opening 3026 (shown in FIG. 30) in the closed orientation. In some aspects, the side top flaps 3032 and/or main top flaps 3030 can further be sealed in the closed orientation, such as by an adhesive (e.g., glue or tape) or any other suitable fastener known in the art. In example aspects, the bag 2105 can be substantially cuboidal in shape in the closed orientation. In some aspects, the cuboidal shape of the bag 2105 can provide the interior cavity 2120 (shown in FIG. 30) with a larger volume than a bag 2105 that is cinched at the top bag end 2305 (such as the bag 2105 of FIG. 23). The cuboidal shape of the interior cavity 2120 and the increased volume thereof can allow for more and/or larger contents to be received therein.

Figure 33:
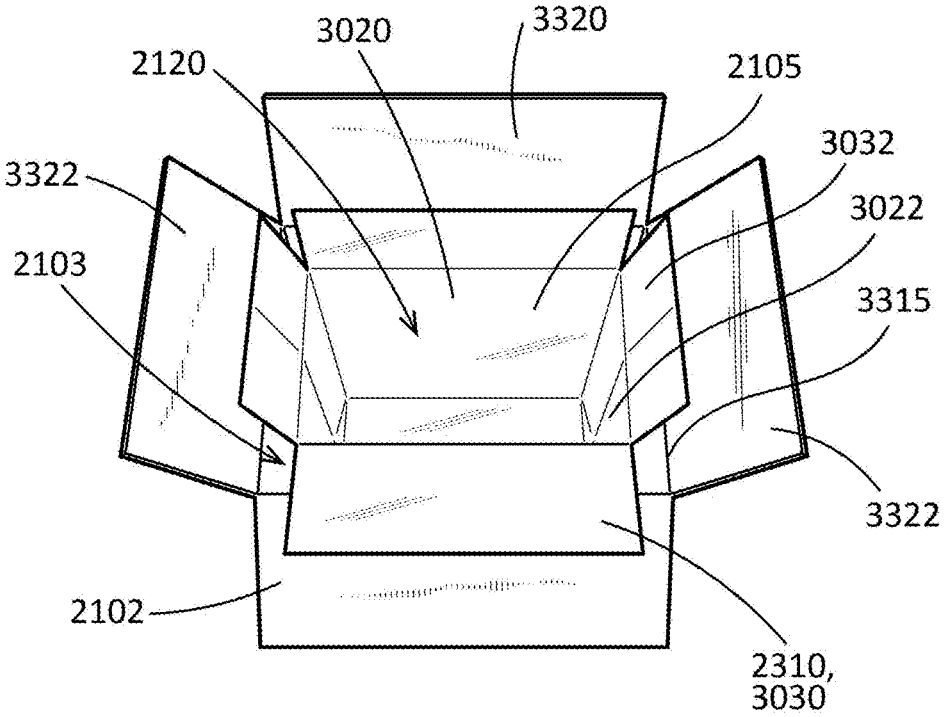
FIG. 33 is a top perspective view of the meal kit bag of FIG. 30 received in the outer box, in accordance with another aspect of the present disclosure.
Figure 34:
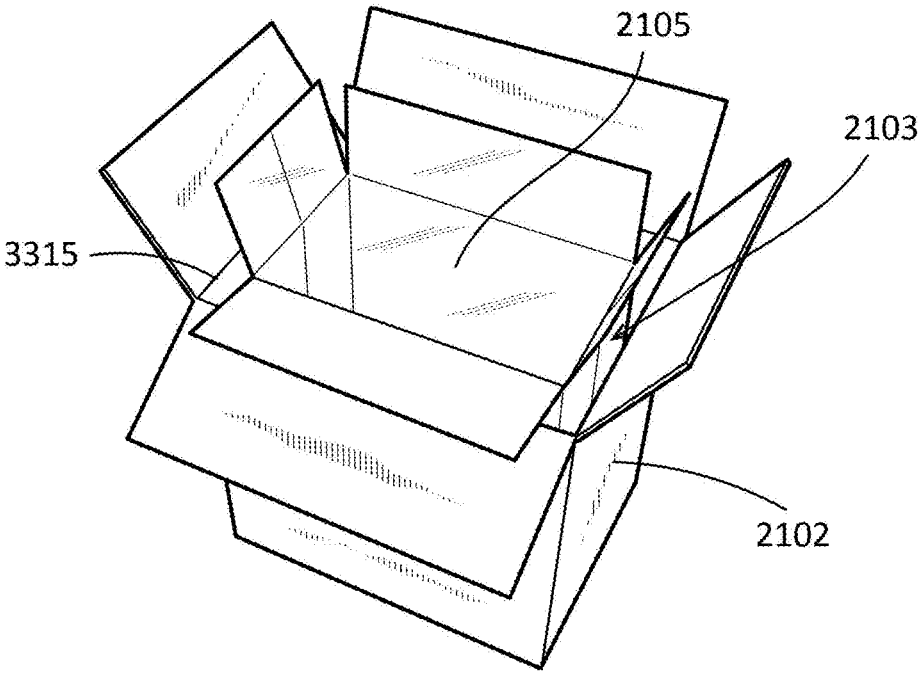
FIG. 34 is another top perspective view of the meal kit bag of FIG. 30 received in the outer box of FIG. 33.

FIGS. 33 and 34 illustrate the bag 2105 in the open orientation and disposed within the outer box 2102. As previously described, the meal kit tray 1000 (shown in FIG. 21) can be received within the outer box 2102 prior to inserting the bag 2105, and the bag 2105 can be supported on the meal kit tray 1000 within the interior box cavity 2103 of the outer box 2102. As shown, the hinged connection of the main top flaps 3030 and the side top flaps 3032 of the bag to the corresponding main panels 3020 and side panels 3022, respectively, can allow the main top flaps 3030 and the side top flaps 3032 to fold outward and downward in the open orientation of the bag 2105, as opposed to standing substantially upright like the upper bag portion 2310 of FIG. 21. This can allow for easy loading of the contents into the interior cavity 2120, because the contents can be loaded at a lower elevation. Thus, workers loading the contents into the bag 2105 will not have to reach up and over the main top flaps 3030 and the side top flaps 3032 when loading, which can minimize stress on the workers and reduce loading time. In some aspects, the top bag end 2305 of the bag 2105 can be about level with a top box end 3315 of the outer box 2102, and the main top flaps 3030 and the side top flaps 3032 of the bag 2105 can fold over corresponding main box top flaps 3320 and side box top flaps 3322 of the top 2115 of the outer box 2102, as shown.

Figure 35:
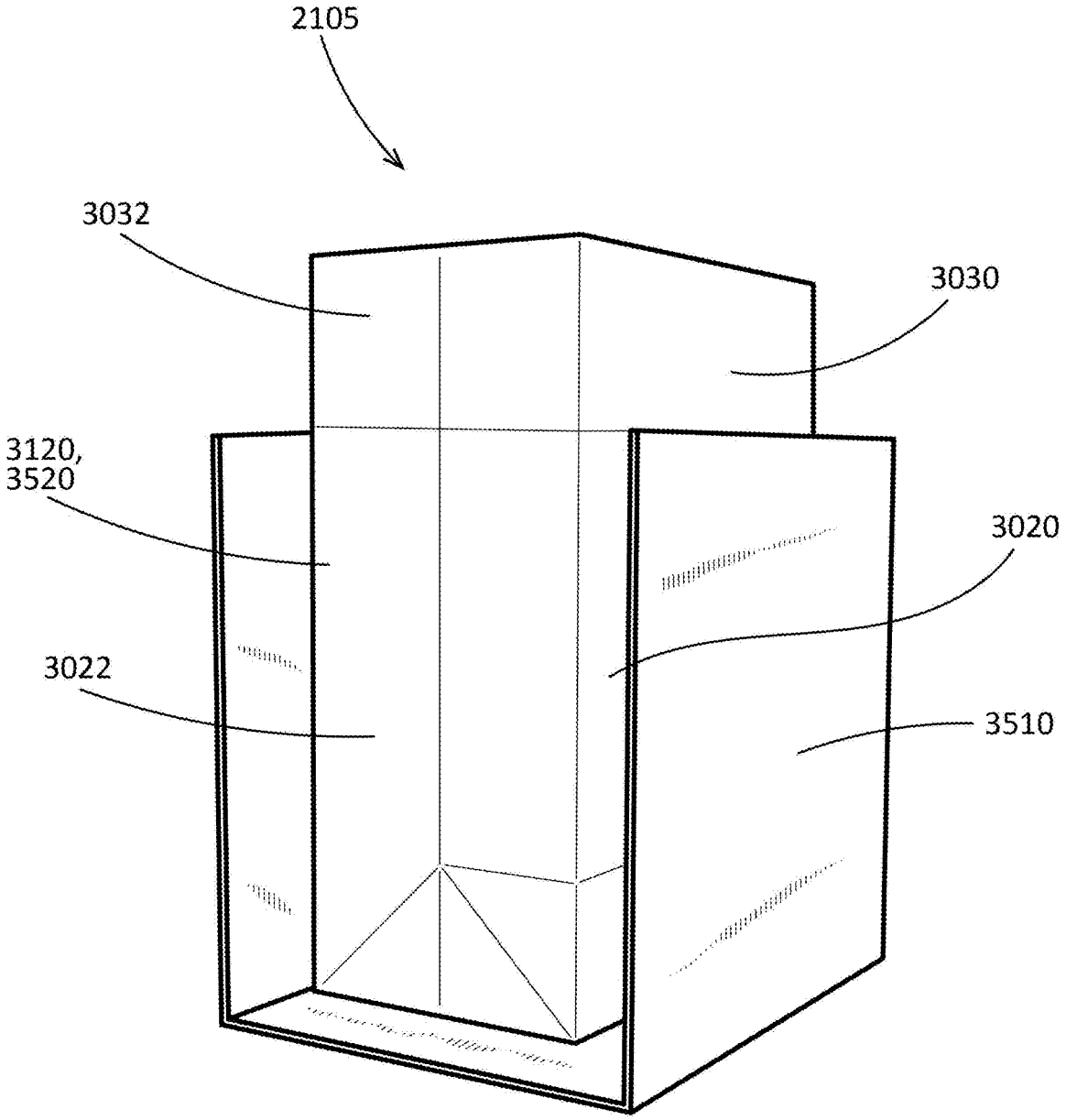
FIG. 35 is perspective view of the meal kit bag further comprising a second film, in accordance with another example aspect of the present disclosure.

FIG. 35 illustrates a second temperature-preserving liner 3510 for application to an outer surface 3520 of the base layer 3120 of the bag 2105. The second temperature-preserving liner 3510 can be the same as or similar to the temperature-preserving liner 3010 (shown in FIG. 30) in some aspects. Some aspects of the bag 2105 can comprise the second temperature-preserving liner 3510, in addition to the temperature-preserving liner 3010, for further enhancing the insulation of the bag 2105. Other aspects of the bag 2105 may comprise the second temperature-preserving liner 3510 only. In the present aspect, the second temperature-preserving liner 3510 can be applied to the pair of opposing main panels 3020 and the bottom panel 3024 (shown in FIG. 30) of the bag 2105. In other aspects, the second temperature-preserving liner 3510 can also or additionally be applied to any of the side panels 3022, the side top flaps 3032, and the main top flaps 3030.

As previously noted, the temperature-preserving liner 3010, such as the film 3012, can be applied to any of the bag 2105 embodiments previously disclosed. In some aspects, the temperature-preserving liner 3010 can define or can partially define an inner surface of the bag 2105 and/or an outer surface of the bag 2105. Additionally, the temperature-preserving liner 3010 can also or alternatively be applied to any of the meal kit tray 1000,2000,2600 embodiments previously disclosed. In some aspects, the temperature-preserving liner 3010 can be applied to at least some or all of the portions of the meal kit tray 1000,2000,2600 that contact and/or face the bag 2105. For example, in a particular example aspect, the temperature-preserving liner 3010 can be applied to the surfaces of the bottom panel 102, the first and second side panels 108,114, and the front and rear reinforcement flaps 166, 173 that contact and/or face the bag 2105.

One should note that conditional language, such as, among others, "can," "could," "might," or "may," unless specifically stated otherwise, or otherwise understood within the context as used, is generally intended to convey that certain aspects include, while other aspects do not include, certain features, elements and/or steps. Thus, such conditional language is not generally intended to imply that features, elements and/or steps are in any way required for one or more particular aspects or that one or more particular aspects necessarily comprise logic for deciding, with or without user input or prompting, whether these features, elements and/or steps are included or are to be performed in any particular aspect.

It should be emphasized that the above-described aspects are merely possible examples of implementations, merely set forth for a clear understanding of the principles of the present disclosure. Any process descriptions or blocks in flow diagrams should be understood as representing modules, segments, or portions of code which comprise one or more executable instructions for implementing specific logical functions or steps in the process, and alternate implementations are included in which functions may not be included or executed at all, may be executed out of order from that shown or discussed, including substantially concurrently or in reverse order, depending on the functionality involved, as would be understood by those reasonably skilled in the art of the present disclosure. Many variations and modifications may be made to the above-described aspect(s) without departing substantially from the spirit and principles of the present disclosure. Further, the scope of the present disclosure is intended to cover any and all combinations and sub-combinations of all elements, features, and aspects discussed above. All such modifications and variations are intended to be included herein within the scope of the present disclosure, and all possible claims to individual aspects or combinations of elements or steps are intended to be supported by the present disclosure.

That which is claimed is:

1. A method of assembling a meal kit tray from a single tray blank comprising a bottom panel, wherein:

the bottom panel is configured to support a bag containing refrigerated items and a cold pack, the bottom panel defining a first end, a second end, a third end, and a fourth end;

the single tray blank further comprises:

a side panel extending outwardly from at least a portion of the second end of the bottom panel, the side panel joined to the bottom panel along a first fold line defining a joint between the bottom panel and the side panel, the side panel defining a first end, a second end, a third end, and a fourth end;

wherein the first fold line is interrupted by at least one perforation line segment defining a standoff extending laterally from the first fold line and terminating in a standoff edge, the standoff configured to separate from the side panel as the side panel is rotated upwardly about the first fold line during assembly of the single tray blank into the meal kit tray; and a wing extending outwardly from the third end of the side panel, the wing joined to the side panel along a second fold line defining a joint between the side panel and the wing, the wing defining a front end, a rear end, a proximal end, and a free end; and the method comprises the steps of:

rotating the side panel upwardly about the first fold line to cause the standoff to separate from the side panel; and rotating the wing downwardly about the second fold line to cause the wing to contact the standoff.

2. The method of claim 1, wherein the single tray blank further comprises:

an end panel extending from the first end of the bottom panel, the end panel joined to the bottom panel along a third fold line defining a joint between the bottom panel and the end panel, the end panel defining a first end, a second end, a third end, and a fourth end; and a reinforcement panel extending from the fourth end of the end panel, the reinforcement panel joined to the end panel along a fourth fold line defining a joint between the reinforcement panel and the end panel, the reinforcement panel defining a proximal end, a distal end, a top end, and a separable end joined to at least a portion of the first end of the side panel along a perforation line segment.

3. The method of claim 2, wherein:

at least a portion of the perforation line segment outlines a front tab extending forward from the first end of the side panel, the perforation line segment configured to facilitate separation of the reinforcement panel from the side panel when the single tray blank is assembled into the meal kit tray; and the method further comprises the step of separating the reinforcement panel from the side panel along the perforation line segment, the separation of the reinforcement panel from the side panel forming the front tab, the front tab defining a leading edge formed from panel separation along the perforation line segment, the leading edge configured to engage a front inside wall of a front end of an outer box when the meal kit tray is inserted into the outer box.

4. The method of claim 3, wherein the step of separating the reinforcement panel occurs before the step of rotating the side panel upwardly.

5. The method of claim 3, wherein the step of separating the reinforcement panel from the side panel comprises the step of rotating the end panel upwardly about the third fold line.

6. The method of claim 5, wherein the step of separating the reinforcement panel from the side panel further comprises the step of rotating the reinforcement panel inwardly about the fourth fold line toward the end panel.

7. The method of claim 3, wherein:

the side panel defines a side panel outer surface, wherein the reinforcement panel defines a reinforcement panel outer surface, and the single tray blank further comprises an adhesive region on the side panel outer surface proximate the first end of the side panel; and the method further comprises the steps of:

rotating the reinforcement panel inwardly toward the end panel about the fourth fold line; and bringing the reinforcement panel outer surface into contact with the adhesive region.

8. A method of collapsing a meal kit tray assembled from a single tray blank comprising a bottom panel, wherein:

the bottom panel is configured to support a bag containing refrigerated items and a cold pack, the bottom panel defining an upper surface, a first end, a second end, a third end, and a fourth end;

the single tray blank further comprises:

a side panel extending outwardly from at least a portion of the second end of the bottom panel, the side panel joined to the bottom panel along a first fold line defining a joint between the bottom panel and the side panel, the side panel defining a first end, a second end, a third end, and a fourth end;

a wing extending outwardly from the third end of the side panel, the wing joined to the side panel along a second fold line defining a joint between the side panel and the wing, the wing defining a front end, a rear end, a proximal end, and a free end; and an end panel extending from the first end of the bottom panel, the end panel joined to the bottom panel along a third fold line defining a joint between the bottom panel and the end panel, the end panel defining a first end, a second end, a third end, and a fourth end;

wherein the end panel defines a corner located at an intersection of the first end of the end panel with the fourth end of the end panel;

wherein a transverse fold line extends from the corner to the second end of the end panel, the transverse fold line subdividing the end panel into a primary section and a secondary section;

wherein a reinforcement panel extending from the fourth end of the end panel, the reinforcement panel joined to the end panel along a fourth fold line defining a joint between the reinforcement panel and the end panel, the reinforcement panel defining a proximal end, a distal end, a top end, and a separable end joined to at least a portion of the first end of the side panel along a perforation line segment;

wherein the side panel defines a side panel outer surface, wherein the reinforcement panel defines a reinforcement panel outer surface, and the single tray blank further comprises an adhesive region on the side panel outer surface proximate the first end of the side panel; and wherein the reinforcement panel is joined to the side panel due to contact between the reinforcement panel outer surface and the adhesive region; and the method comprises a step of causing the secondary section to be folded atop the primary section comprising a step of rotating the side panel inwardly toward the upper surface of the bottom panel to cause the reinforcement panel to push the end panel outwardly until the secondary section is folded inwardly about the transverse fold line onto the primary section.

9. The method of claim 8, wherein the side panel outer surface is a first side panel outer surface, wherein the side panel further defines a second side panel outer surface opposite the first side panel outer surface, and wherein the method further comprises the step of rotating the wing downwardly about the second fold line until a surface of the wing contacts the second side panel outer surface.

* * * * *